US008136395B2

(12) United States Patent
Pop et al.

(10) Patent No.: US 8,136,395 B2
(45) Date of Patent: Mar. 20, 2012

(54) SYSTEMS AND METHODS FOR WELL DATA ANALYSIS

(75) Inventors: Julian Pop, Houston, TX (US); Jean-Marc Follini, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 808 days.

(21) Appl. No.: 11/968,026

(22) Filed: Dec. 31, 2007

(65) Prior Publication Data

US 2009/0165548 A1 Jul. 2, 2009

(51) Int. Cl.
*E21B 47/00* (2006.01)

(52) U.S. Cl. ..... 73/152.51

(58) Field of Classification Search ..... 73/152.51, 73/152.27; 166/250.01; 702/6; 175/40, 175/48

See application file for complete search history.

(56) References Cited

U.S. PATENT DOCUMENTS

| | | | |
|---|---|---|---|
| 3,321,965 | A | 5/1967 | Johnson et al. |
| 3,352,361 | A | 11/1967 | Urbanosky |
| 3,448,611 | A | 6/1969 | Lebourg |
| 3,811,321 | A | 5/1974 | Urbanosky |
| 3,859,851 | A | 1/1975 | Urbanosky |
| 3,898,877 | A | 8/1975 | McArthur |
| 3,934,468 | A | 1/1976 | Brieger |
| 4,416,152 | A | 11/1983 | Wilson |
| 4,507,957 | A | 4/1985 | Montgomery et al. |
| 4,513,612 | A | 4/1985 | Shalek |
| 4,597,290 | A | 7/1986 | Bourdet et al. |
| 4,742,459 | A | 5/1988 | Lasseter |
| 4,745,802 | A | 5/1988 | Purfurst |
| 4,803,873 | A | 2/1989 | Ehlig-Economides |
| 4,843,878 | A | 7/1989 | Purfurst et al. |
| 4,860,581 | A | 8/1989 | Zimmerman et al. |
| 4,879,900 | A | 11/1989 | Gilbert |
| 4,890,487 | A | 1/1990 | Dussan et al. |
| 4,936,139 | A | 6/1990 | Zimmerman et al. |
| 4,949,575 | A | 8/1990 | Rasmus |
| 4,953,399 | A | 9/1990 | Ferti et al. |
| 5,095,745 | A | 3/1992 | Desbrandes |

(Continued)

FOREIGN PATENT DOCUMENTS

EP 1703076 9/2006

OTHER PUBLICATIONS

FJ Kuchuk, "Multiprobe Wireline Formation Tester Pressure Behavior in Crossflow layered Reservoirs," In Situ (1996) 20,1,1.

(Continued)

*Primary Examiner* — Hezron E Williams
*Assistant Examiner* — Tamiko Bellamy
(74) *Attorney, Agent, or Firm* — Michael L. Flynn; Brigitte J. Echols; Jeffrey E. Griffin

(57) ABSTRACT

Examples of techniques for analyzing well data which may be encountered during formation testing are disclosed. Certain portions of the tests may exhibit an indication of anomalous behavior, defects, errors or events that may have occurred during testing. One or more confidence tokens may be identified during or after the execution of a test. One or more of these confidence tokens may be analyzed to determine whether such anomalous behavior, defects, errors or events have occurred during the test. These confidence tokens may then be used to determine a level of confidence in the results derived from the tests performed and/or their underlying data and interpretation.

20 Claims, 35 Drawing Sheets

U.S. PATENT DOCUMENTS 5,144,589 A 9/1992 Hardage
5,184,508 A 2/1993 Desbrandes
5,230,244 A 7/1993 Gilbert
5,233,866 A 8/1993 Desbrandes
5,247,830 A 9/1993 Goode
5,265,015 A 11/1993 Auzerais et al.
5,269,180 A 12/1993 Dave et al.
5,285,015 A 2/1994 West
5,303,582 A 4/1994 Miska
5,329,811 A 7/1994 Schultz et al.
5,335,542 A 8/1994 Ramakrishnan et al.
5,353,637 A 10/1994 Plumb et al.
5,517,854 A 5/1996 Plumb et al.
5,555,945 A 9/1996 Schultz et al.
5,602,334 A 2/1997 Proett et al.
5,635,631 A 6/1997 Yesudas et al.
5,644,076 A 7/1997 Proett et al.
5,703,286 A 12/1997 Proett et al.
5,708,204 A 1/1998 Kasap
5,741,962 A 4/1998 Birchak et al.
5,770,798 A 6/1998 Georgi et al.
5,789,669 A 8/1998 Flaum
5,799,733 A 9/1998 Ringgenberg et al.
5,803,186 A 9/1998 Berger et al.
5,934,374 A 8/1999 Hrametz et al.
5,959,203 A 9/1999 Ajjoul
5,969,240 A 10/1999 Eadington et al.
5,969,241 A 10/1999 Auzerais
6,006,834 A 12/1999 Skinner
6,026,915 A 2/2000 Smith et al.
6,047,239 A 4/2000 Berger et al.
6,058,773 A 5/2000 Zimmerman et al.
6,147,437 A 11/2000 Matsumoto et al.
6,157,032 A 12/2000 Into
6,157,893 A 12/2000 Berger et al.
6,176,323 B1 1/2001 Weirich et al.
6,178,815 B1 1/2001 Felling et al.
6,230,557 B1 5/2001 Ciglenec et al.
6,236,620 B1 5/2001 Schultz et al.
6,325,146 B1 12/2001 Ringgenberg et al.
6,334,489 B1 1/2002 Shwe et al.
6,340,062 B1 1/2002 Skinner
6,343,507 B1 2/2002 Felling et al.
6,343,650 B1 2/2002 Ringgenberg
6,427,530 B1 8/2002 Krueger et al.
6,474,152 B1 11/2002 Mullins et al.
6,568,487 B2 5/2003 Meister et al.
6,609,568 B2 8/2003 Krueger et al.
6,672,386 B2 1/2004 Krueger et al.
6,758,090 B2 7/2004 Bostrom et al.
6,761,062 B2 7/2004 Shapiro
6,820,702 B2 * 11/2004 Niedermayr et al. ..... 175/57
6,832,515 B2 12/2004 Follini et al.
6,843,118 B2 1/2005 Weintraub et al.
6,932,167 B2 8/2005 Proett et al.
7,011,155 B2 3/2006 Meister et al.
7,024,930 B2 4/2006 Follini et al.
7,036,579 B2 5/2006 Follini et al.
7,059,179 B2 6/2006 Proett et al.
7,114,562 B2 10/2006 Fisseler et al.
7,117,734 B2 10/2006 Follini et al.
7,181,960 B2 2/2007 Sheng et al.
7,210,344 B2 5/2007 Follini et al.
7,234,521 B2 6/2007 Shammai et al.
7,263,880 B2 9/2007 Pop et al.
7,290,443 B2 11/2007 Follini et al.
7,373,812 B2 5/2008 Ma et al.
7,395,703 B2 * 7/2008 Niemeyer et al. ..... 73/152.24
2002/0112854 A1 8/2002 Krueger et al.
2003/0167834 A1 * 9/2003 Weintraub et al. ..... 73/152.05
2003/0214879 A1 11/2003 Proett et al.
2004/0026125 A1 2/2004 Meister et al.
2004/0045706 A1 3/2004 Pop et al.
2004/0231841 A1 * 11/2004 Niemeyer et al. ..... 166/264
2004/0231842 A1 11/2004 Shammai et al.
2005/0039527 A1 2/2005 Dhruva et al.
2005/0109538 A1 5/2005 Fisseler et al.
2009/0037206 A1 * 2/2009 Byrne et al. ..... 705/1
2009/0132458 A1 * 5/2009 Edwards et al. ..... 706/50

OTHER PUBLICATIONS

E Karstad & BS Aadnoy, "Density Behavior of Drilling Fluids during High Pressure High Temperature Drilling Operations," IADC/SPE 47806 (1998).

MA Proett et al., "Sample Quality Prediction with Integrated Oil and Water-based Mud Invasion Modeling," SPE 77964 (2002).

M Proett et al., "Formation Testing while Drilling, a New Era in Formation Testing," SPE 84087 (2003).

M. Meister et al., "Formation Pressure Testing during Drilling: Challenges and Benefits," SPE 84088 (2003).

M. Proett et al., "Formation Pressure Testing in the Dynamic Drilling Environment," IADC/SPE 87090 (2004).

S. Frank et al., "Field Experience with a New Formation Pressure Testing-During -Drilling Tool," IADC/SPE 87091 (2004).

R. Desbrandes, "Wireline Formation Testing: A New Extended Drawdown Technique," Petroleum Engineer International (May 1991).

* cited by examiner

Fig. 4
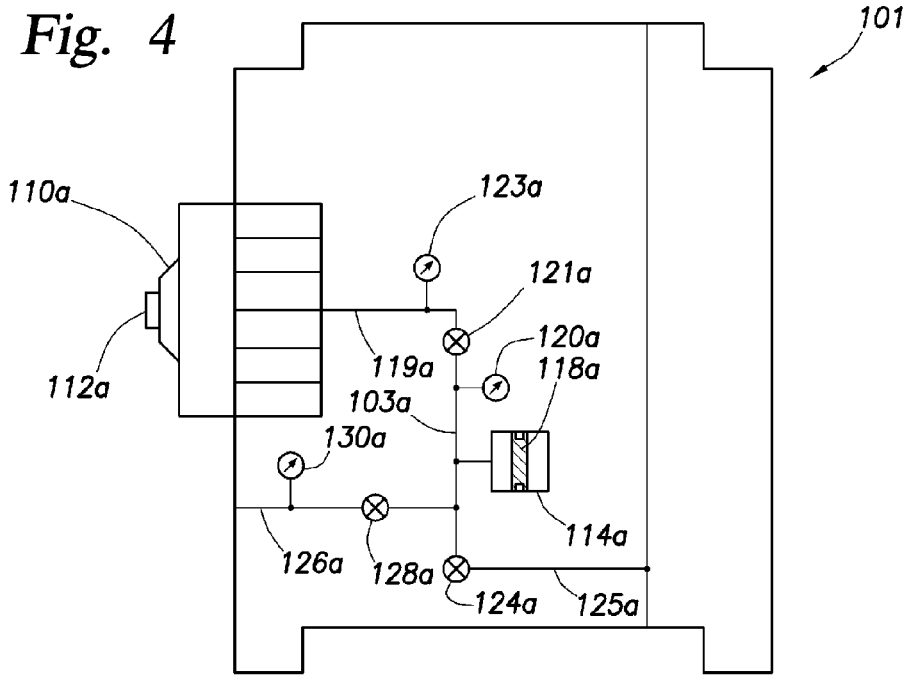
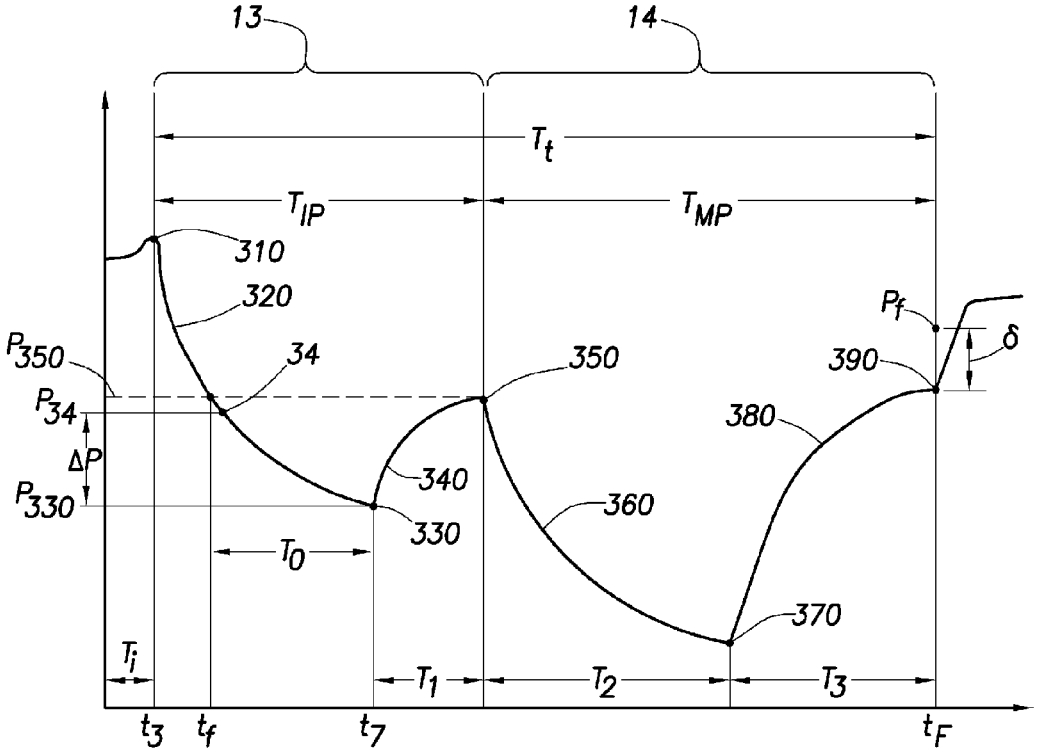
Fig. 5

P
t
11a
12
13
14
512
510
511
530
520
540
575
580
570
550
560
561
512a
511a
610
620
711
720
740
741
760
710
730
770
731
12c
752
753
12b
750
12
751
780
310 t
+Q
−
12c
12b
12

SYSTEMS AND METHODS FOR WELL DATA ANALYSIS

BACKGROUND OF THE INVENTION

1. Field of the Invention

The present disclosure relates generally to the field of well logging. More particularly, the disclosure relates to techniques for evaluating data collected by a downhole formation tester.

2. Background Art

Over the past several decades, highly sophisticated techniques have been developed for identifying and producing hydrocarbons, commonly referred to as oil and gas, from subsurface formations. These techniques facilitate the discovery, assessment, and production of hydrocarbons from subsurface formations.

When a subsurface formation containing an economically producible amount of hydrocarbons is believed to have been discovered, a borehole is typically drilled from the earth surface to the desired subsurface formation and tests are performed on the formation to determine whether the formation is likely to produce hydrocarbons of commercial value. Typically, tests performed on subsurface formations involve interrogating penetrated formations to determine whether hydrocarbons are actually present and to assess the amount of producible hydrocarbons therein. These preliminary tests are conducted using formation testing tools, often referred to as formation testers. Formation testers are typically lowered into a wellbore by a wireline cable, tubing, drill string, or the like, and may be used to determine various formation characteristics which assist in determining the quality, quantity, and conditions of the hydrocarbons or other fluids located therein. Other formation testers may form part of a drilling tool, such as a drill string, for the measurement of formation parameters during the drilling process.

Formation testers typically comprise slender tools adapted to be lowered into a borehole and positioned at a depth in the borehole adjacent to the subsurface formation for which data is desired. Once positioned in the borehole, these tools are placed in fluid communication with the formation to collect data from the formation. Typically, a probe, snorkel or other device is sealably engaged against the borehole wall to establish such fluid communication.

Formation testers are typically used to measure downhole parameters, such as wellbore pressures, formation pressures and formation mobilities, among others. They may also be used to collect samples from a formation so that the types of fluid contained in the formation and other fluid properties can be determined. The formation properties determined during a formation test are important factors in determining the commercial value of a well and the manner in which hydrocarbons may be recovered from the well. Moreover, formation properties determined by measurements while drilling (MWD) may be highly valuable in controlling further drilling operations.

The operation of formation testers may be more readily understood with reference to the structure of a conventional wireline formation tester shown in FIGS. 1A and 1B. As shown in FIG. 1A, the wireline tester 100 is lowered from an oil rig 2 into an open wellbore 3 filled with a fluid commonly referred to in the industry as "mud." The wellbore is lined with a mudcake 4 deposited onto the wall of the wellbore during drilling operations. The wellbore penetrates a formation 5.

The operation of a conventional modular wireline formation tester having multiple interconnected modules is described in more detail in U.S. Pat. Nos. 4,860,581 and 4,936,139 issued to Zimmerman et al. FIG. 2 depicts a graphical representation of a pressure trace over time measured by the formation tester during a conventional wireline formation testing operation used to determine parameters, such as formation pressure.

Referring now to FIGS. 1A and 1B, in a conventional wireline formation testing operation, a formation tester 100 is lowered into a wellbore 3 by a wireline cable 6. After lowering the formation tester 100 to the desired position in the wellbore, pressure in the flowline 119 in the formation tester may be equalized to the hydrostatic pressure of the fluid in the wellbore by opening an equalization valve (not shown). A pressure sensor or gauge 120 is used to measure the hydrostatic pressure of the fluid in the wellbore. The measured pressure at this point is graphically depicted along line 103 in FIG. 2. The formation tester 100 may then be "set" by anchoring the tester in place with hydraulically actuated pistons, positioning the probe 112 against the sidewall of the wellbore to establish fluid communication with the formation, and closing the equalization valve to isolate the interior of the tool from the well fluids. The point at which a seal is made between the probe and the formation and fluid communication is established, referred to as the "tool set" point, is graphically depicted at 105 in FIG. 2. Fluid from the formation 5 is then drawn into the formation tester 100 by retracting a piston 118 in a pretest chamber 114 to create a pressure drop in the flowline 119 below the formation pressure. This volume expansion cycle, referred to as a "drawdown" cycle, is graphically illustrated along line 107 in FIG. 2.

When the piston 118 stops retracting (depicted at point 111 in FIG. 2), fluid from the formation continues to enter the probe 112 until, given a sufficient time, the pressure in the flowline 119 is the same as the pressure in the formation 5, depicted at 115 in FIG. 2. This cycle, referred to as a "build-up" cycle, is depicted along line 113 in FIG. 2. As illustrated in FIG. 2, the final build-up pressure at 115, frequently referred to as the "sandface" pressure, is usually assumed to be a good approximation to the formation pressure.

The shape of the curve and corresponding data generated by the pressure trace may be used to determine various formation characteristics. For example, pressures measured during drawdown (107 in FIG. 2) and build-up (113 in FIG. 2) may be used to determine formation mobility, that is the ratio of the formation permeability to the formation fluid viscosity. When the formation tester probe (112 FIG. 1B) is disengaged from the wellbore wall, the pressure in flowline 119 increases rapidly as the pressure in the flowline equilibrates with the wellbore pressure, shown as line 117 in FIG. 2. After the formation measurement cycle has been completed, the formation tester 100 may be disengaged and repositioned at a different depth and the formation test cycle repeated as desired.

During this type of test operation for a wireline-conveyed tool, pressure data collected downhole is typically communicated to the surface electronically via the wireline communication system. At the surface, an operator typically monitors the pressure in flowline 119 at a console and the wireline logging system records the pressure data in real time. Data recorded during the drawdown and buildup cycles of the test may be analyzed either at the well site computer in real time or later at a data processing center to determine crucial formation parameters, such as formation fluid pressure, the mud overbalance pressure, i.e. the difference between the wellbore pressure and the formation pressure, and the mobility of the formation.

Wireline formation testers allow high data rate communications for real-time monitoring and control of the test and tool through the use of wireline telemetry. This type of communication system enables field engineers to evaluate the quality of test measurements as they occur and, if necessary, to take immediate actions to abort a test procedure and/or adjust the pretest parameters before attempting another measurement. For example, by observing the data as they are collected during the pretest drawdown, an engineer may have the option to change the initial pretest parameters, such as drawdown rate and drawdown volume, to better match them to the formation characteristics before attempting another test. Examples of prior art wireline formation testers and/or formation test methods are described, for example, in U.S. Pat. No. 3,934,468 issued to Brieger; U.S. Pat. Nos. 4,860,581 and 4,936,139 issued to Zimmerman et al.; and U.S. Pat. No. 5,969,241 issued to Auzerais. These patents are assigned to the assignee of the present invention.

Formation testers may also be used during drilling operations. For example, one such downhole drilling tool adapted for collecting data from a subsurface formation during drilling operations is disclosed in U.S. Pat. No. 6,230,557 B1 issued to Ciglenec et al., which is assigned to the assignee of the present invention. Other examples of downhole drilling tools with formation testing capabilities are described in U.S. Pat. Nos. 5,803,186, 7,114,562, and 5,233,866 among others.

Various techniques have been developed for performing specialized formation testing operations, or pretests. For example, U.S. Pat. Nos. 5,095,745 and 5,233,866 both issued to DesBrandes describe a method for determining formation parameters by analyzing the point at which the pressure deviates from a linear draw down. Other examples of such techniques are provided in Patent/Application Nos. U.S. Pat. Nos. 6,932,167, 7,011,155, US 2004/0231842 and US 2005/0039527.

Despite the advances made in developing methods for performing pretests, there remains a need to eliminate delays and errors in the pretest process, and to improve the accuracy of the parameters derived from such tests. Because formation testing operations are used throughout drilling operations, the duration of the test and the absence of real-time communication with the tools are major constraints that must be considered. The problems associated with real-time communication for these operations are largely due to the current limitations of the telemetry typically used during drilling operations, such as mud-pulse telemetry. Limitations, such as uplink and downlink telemetry data rates for most logging while drilling (LWD) or measurement while drilling (MWD) tools, result in slow exchanges of information between the downhole tool and the surface. For example, a simple process of sending a pretest pressure trace to the surface, followed by an engineer sending a command downhole to retract the probe based on the data transmitted may result in substantial delays which tend to adversely impact drilling operations.

Delays also increase the possibility of tools becoming stuck in the wellbore. To reduce the possibility of sticking, drilling operation specifications based on prevailing formation and drilling conditions are often established to dictate how long a drill string may be immobilized in a given borehole. Under these specifications, the drill string may only be allowed to be immobile for a limited period of time to deploy a probe and perform a pressure measurement. Accordingly, it may not be feasible to transmit all the data acquired during a test in real-time due to limitations associated with telemetry bandwidth, and thus appropriate data analysis and/or control may not be possible.

Formation pressure while drilling (FPWD) measurements, wherein a two phase test protocol is implemented, illustrates the need for real-time formation testing data communication. For example, a FPWD pretest may comprise a first phase, perhaps including drawdown and buildup cycles, conducted as an investigation phase and a second phase, perhaps again including drawdown and buildup cycles, conducted as a measurement phase. Data from the investigation phase may used to configure/perform the measurement phase. If the data from the investigation phase is not provided uphole, appropriate analysis and/or control with respect to configuring the measurement phase, continuing the test, etc. may not be possible. Similarly, if data from the measurement phase is not provided uphole, appropriate analysis and/or control with respect to continued drilling operations, further testing, etc. may not be possible. A 5 minute time-limited pretest having a 15 Hz sampling rate with 16 bits/sample, for example, produces 72000 bits per data channel. However, where mud pulse telemetry is implemented, the communication channel capacity is typically limited to between 0.5 to 12 bits/sec. Such a communication channel is typically insufficient to carry the aforementioned FPWD pretest data in real-time.

Advances have been made in developing methods for formation testing, but there remains a need to improve the evaluation of data generated during downhole testing and/or improving testing sequences through testing data quality control. For example, errors that occur in the testing process that affect the test results need to be evaluated. Moreover, harsh downhole conditions may affect the performance of the equipment, the measurement of downhole parameters and/or various other factors which may affect the overall data provided. Incorrect decisions may be made due to faulty test results. It is, therefore, desirable to provide techniques for detecting potential problems or errors in the data. It is further desirable that such a system provide techniques (automatic or manual) for analyzing the downhole measurements to determine the accuracy of the results and/or a measure of the confidence in the results.

Therefore, systems and methods are desired that enable the determination of confidence in pretest data obtained by a downhole tool. These systems and methods should provide confidence token preferably in real-time or near real-time. It is further desired that these systems and methods be capable of transmitting confidence token using low bandwidth communication channels, and be capable of adapting the test sequence of the tool based on a confidence token computed from previously acquired data.

BRIEF SUMMARY OF THE DISCLOSURE

Examples of techniques for analyzing pressure traces which may be encountered during formation testing are disclosed. Certain portions of the tests may exhibit an indication of anomalous behavior, defects, errors or events that may have occurred during testing. One or more confidence tokens may be identified during or after the execution of a test. One or more of these confidence tokens may be analyzed to determine whether such anomalous behavior, defects, errors or events have occurred during the test. These confidence tokens may then be used to determine a level of confidence in the results derived from the tests performed and/or their underlying data and interpretation.

Accordingly, one aspect of the disclosure provides a method for determining a confidence in measurements taken by a while drilling testing tool. The method includes establishing a pressure coupling between a pressure sensor conveyed by the testing tool and the formation, performing a first drawdown with the testing tool, measuring data indicative of pressure with the pressure sensor, determining at least one confidence token based on the pressure data, and displaying the at least one confidence token.

According to another aspect of the disclosure a method for determining a confidence in measurements taken by a testing tool is provided. The method includes establishing a pressure coupling between a pressure sensor conveyed by the testing tool and the formation, performing a first drawdown with the testing tool, measuring data indicative of a pressure with the pressure sensor, determining at least one confidence token based on the pressure data using one of a trend analysis technique and a noise scattering analysis technique, and displaying the at least one confidence token.

According to yet another aspect of the disclosure, a method for determining a confidence in measurements taken by a downhole tool is provided. The method includes selecting a plurality of downhole conditions, associating a different integer to each of the plurality of the downhole conditions, performing a downhole measurement, identifying one of the plurality of downhole conditions, wherein the identifying is based on the downhole measurement, transmitting to a surface display an integer associated with the identified condition, receiving the integer at the surface display, and displaying indicia indicative of the identified downhole condition.

The foregoing has outlined rather broadly the features and technical advantages of the present disclosure in order that the detailed description that follows may be better understood. Additional features and advantages will be described hereinafter which form the subject of the claims. It should be appreciated by those skilled in the art that the conception and specific embodiment disclosed may be readily utilized as a basis for modifying or designing other structures for carrying out the same purposes. It should also be realized by those skilled in the art that such equivalent constructions do not depart from the spirit and scope of the invention as set forth in the appended claims. The disclosure will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWING

For a more complete understanding of the present invention, reference is now made to the following descriptions taken in conjunction with the accompanying drawing, in which:

FIG. 4 shows a schematic of components of a module of a formation tester suitable for practicing embodiments of the invention;

FIG. 5 shows a graphical representation of a pressure measurement versus time plot for performing the pretest of FIG. 3;

FIGS. 16A-C show flow chart detailing the steps involved in performing the mud filtration phase of the flow chart of FIG. 13, wherein FIG. 16A shows a mud filtration phase, FIG. 16B shows a modified mud filtration phase with a repeat compression cycle, and FIG. 16C shows a modified mud filtration phase with a decompression cycle;

DETAILED DESCRIPTION OF THE DISCLOSURE

Figure 3:
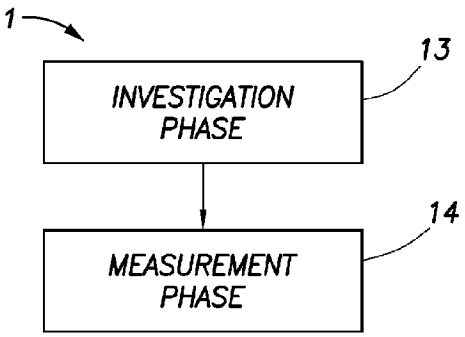
FIG. 3 shows a flow chart of steps involved in a pretest according to an embodiment of the invention.

An embodiment for estimating formation properties (e.g. formation pressures and mobilities) is shown in the block diagram of FIG. 3. As shown in FIG. 3, the method includes an investigation phase 13 and a measurement phase 14.

Figure 1A:
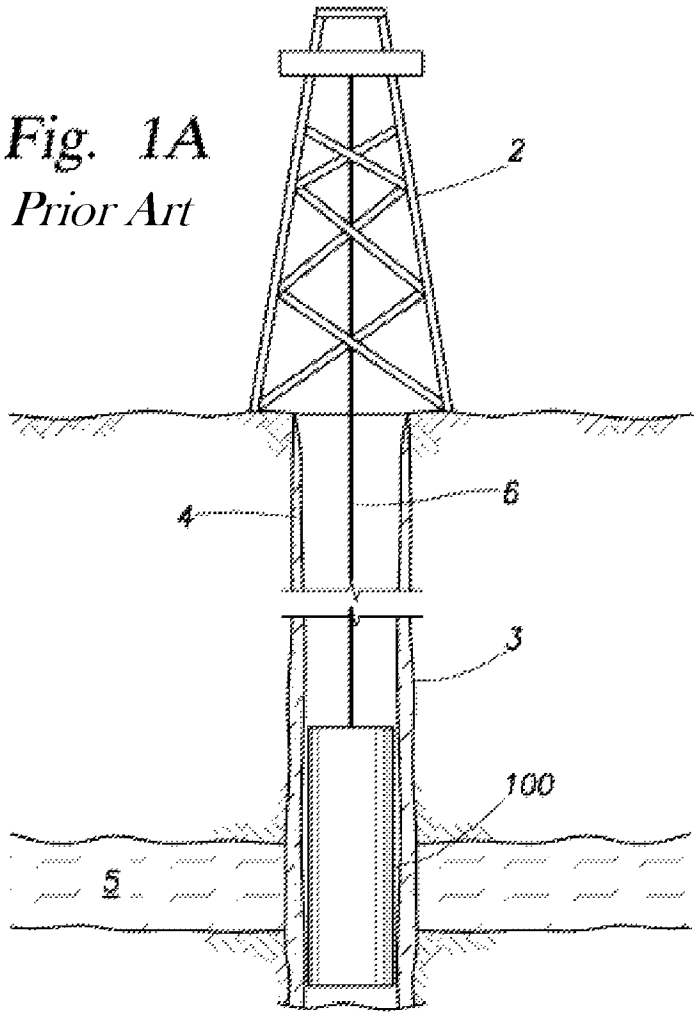
Fig. 1A Prior Art
FIG. 1A shows a conventional wireline formation tester disposed in a wellbore.
Figure 1B:
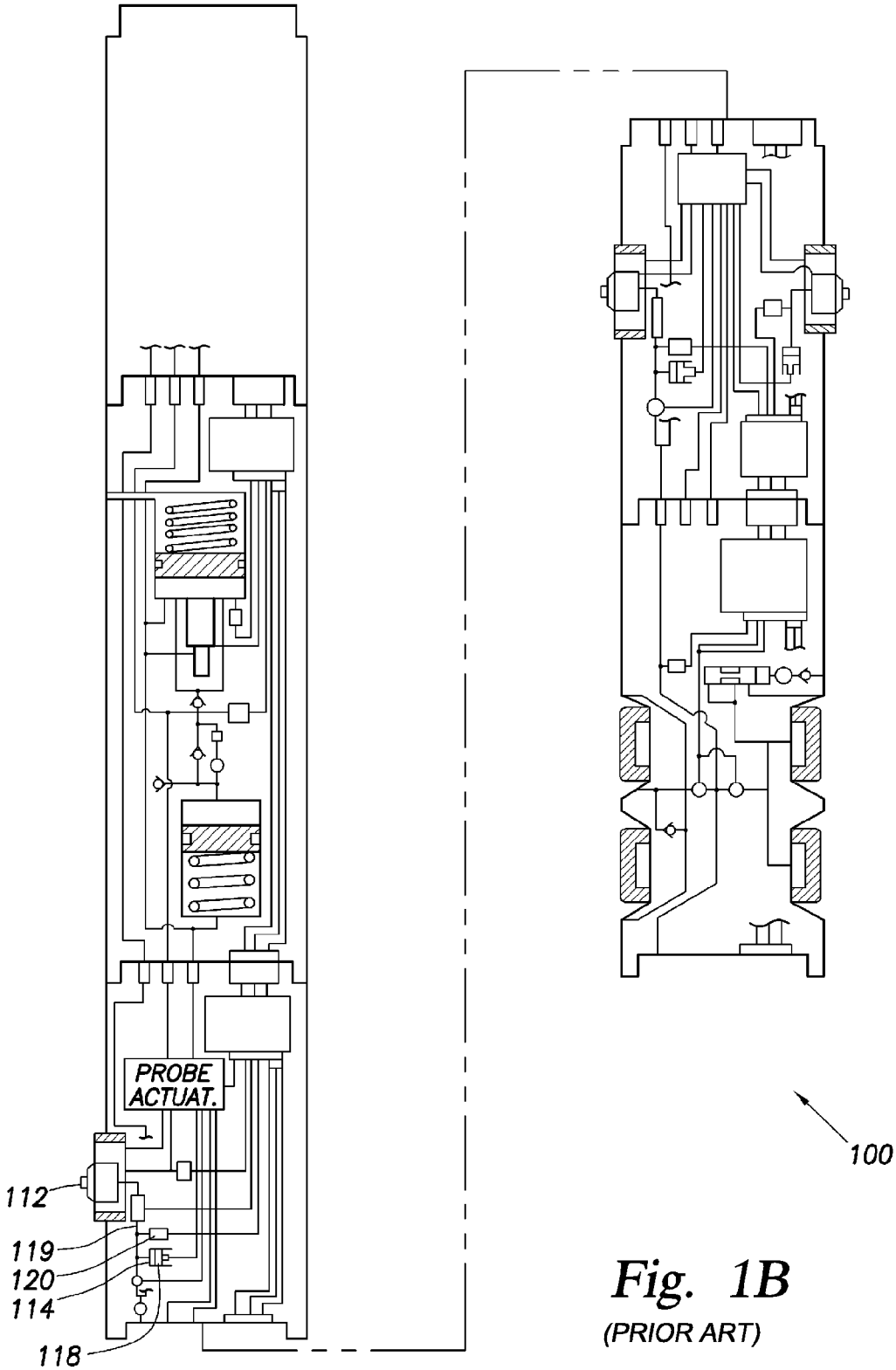
Fig. 1B (PRIOR ART)
FIG. 1B shows a cross sectional view of the modular conventional wireline formation tester of FIG. 1A.

The method may be practiced with any formation tester known in the art, such as the tester described with respect to FIGS. 1A and 1B. Other formation testers may also be used and/or adapted for embodiments of the invention, such as the wireline formation tester of U.S. Pat. Nos. 4,860,581 and 4,936,139 issued to Zimmerman et al., the downhole drilling tool of U.S. Pat. No. 6,230,557 B1 issued to Ciglenec et al. and/or U.S. Patent Application No. 2005/0109538, the entire contents of which are hereby incorporated by reference.

A version of a probe module usable with such formation testers is depicted in FIG. 4. The module 101 includes a probe 112*a*, a packer 110*a* surrounding the probe, and a flow line 119*a* extending from the probe into the module. The flow line 119*a* extends from the probe 112*a* to probe isolation valve 121*a*, and has a pressure gauge 123*a*. A second flow line 103*a* extends from the probe isolation valve 121*a* to sample line isolation valve 124*a* and equalization valve 128*a*, and has pressure gauge 120*a*. A reversible pretest piston 118*a* in a pretest chamber 114*a* also extends from flow line 103*a*. Exit line 126*a* extends from equalization valve 128*a* and out to the wellbore and has a pressure gauge 130*a*. Sample flow line 125*a* extends from sample line isolation valve 124*a* and through the tool. Fluid sampled in flow line 125*a* may be captured, flushed, or used for other purposes.

Probe isolation valve 121*a* isolates fluid in flow line 119*a* from fluid in flow line 103*a*. Sample line isolation valve 124*a*, isolates fluid in flow line 103*a* from fluid in sample line 125*a*. Equalizing valve 128*a* isolates fluid in the wellbore from fluid in the tool. By manipulating the valves to selectively isolate fluid in the flow lines, the pressure gauges 120*a* and 123*a* may be used to determine various pressures. For example, by closing valve 121*a* formation pressure may be read by gauge 123*a* when the probe is in fluid communication with the formation while minimizing the tool volume connected to the formation.

In another example, with equalizing valve 128*a* open mud may be withdrawn from the wellbore into the tool by means of pretest piston 118*a*. On closing equalizing valve 128*a*, probe isolation valve 121*a* and sample line isolation valve 124*a* fluid may be trapped within the tool between these valves and the pretest piston 118*a*. Pressure gauge 130*a* may be used to monitor the wellbore fluid pressure continuously throughout the operation of the tool and together with pressure gauges 120*a* and/or 123*a* may be used to measure directly the pressure drop across the mudcake and to monitor the transmission of wellbore disturbances across the mudcake for later use in correcting the measured sandface pressure for these disturbances.

Among the functions of pretest piston 118*a* is to withdraw fluid from or inject fluid into the formation or to compress or expand fluid trapped between probe isolation valve 121*a*, sample line isolation valve 124*a* and equalizing valve 128*a*.

The pretest piston 118*a* preferably has the capability of being operated at low rates, for example 0.01 $cm^3$/sec, and high rates, for example 10 $cm^3$/sec, and has the capability of being able to withdraw large volumes in a single stroke, for example 100 $cm^3$. In addition, if it is necessary to extract more than 100 $cm^3$ from the formation without retracting the probe, the pretest piston 118*a* may be recycled. The position of the pretest piston 118*a* preferably can be continuously monitored and positively controlled and its position can be "locked" when it is at rest. In some embodiments, the probe 112*a* may further include a filter valve (not shown) and a filter piston (not shown).

Various manipulations of the valves, pretest piston and probe allow operation of the tool according to the described methods. One skilled in the art would appreciate that, while these specifications define a preferred probe module, other specifications may be used without departing from the scope of the invention. While FIG. 4 depicts a probe type module, it will be appreciated that either a probe tool or a packer tool may be used, perhaps with some modifications. The following description assumes a probe tool is used. However, one skilled in the art would appreciate that similar procedures may be used with packer tools.

The techniques disclosed herein are also usable with other devices incorporating a flowline. The term "flowline" as used herein shall refer to a conduit, cavity or other passage for establishing fluid communication between the formation and the pretest piston and/or for allowing fluid flow there between. Other such devices may include, for example, a device in which the probe and the pretest piston are integral. An example of such a device is disclosed in U.S. Pat. No. 6,230,557 B1 and U.S. patent application Ser. No. 10/248,782, assigned to the assignee of the present invention.

As shown in FIG. 5, the investigation phase 13 relates to obtaining initial estimates of formation parameters, such as formation pressure and formation mobility. These initial estimates may then be used to design the measurement phase 14. If desired and allowed, a measurement phase is then performed according to these parameters to generate a refined estimate of the formation parameters. FIG. 5 depicts a corresponding pressure trace illustrating the changes in pressure over time as the method of FIG. 3 is performed. It will be appreciated that, while the pressure trace of FIG. 5 may be performed by the apparatus of FIG. 4, it may also be performed by other downhole tools, such as the tester of FIGS. 1A and 1B.

Figure 2:
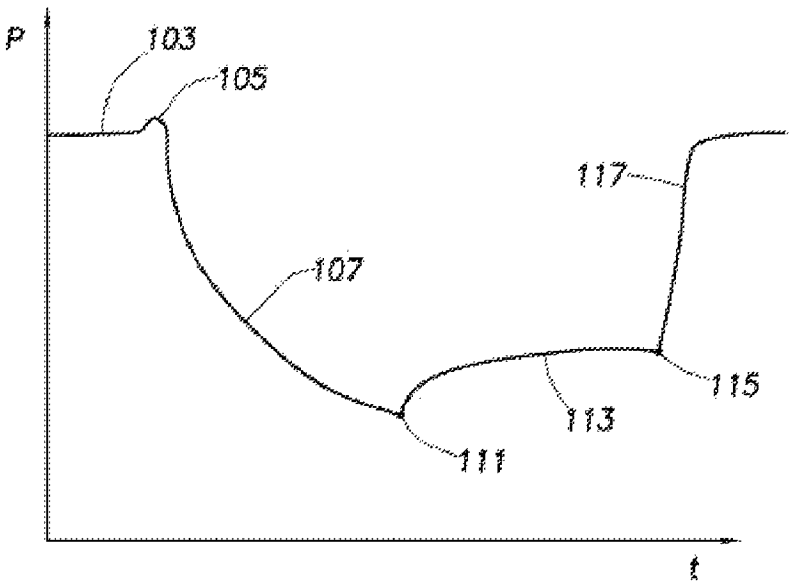
Fig. 2 Prior Art
FIG. 2 shows a graphical representation of pressure measurements versus time plot for a typical prior art pretest sequence performed using a conventional formation tester.
Figure 6:
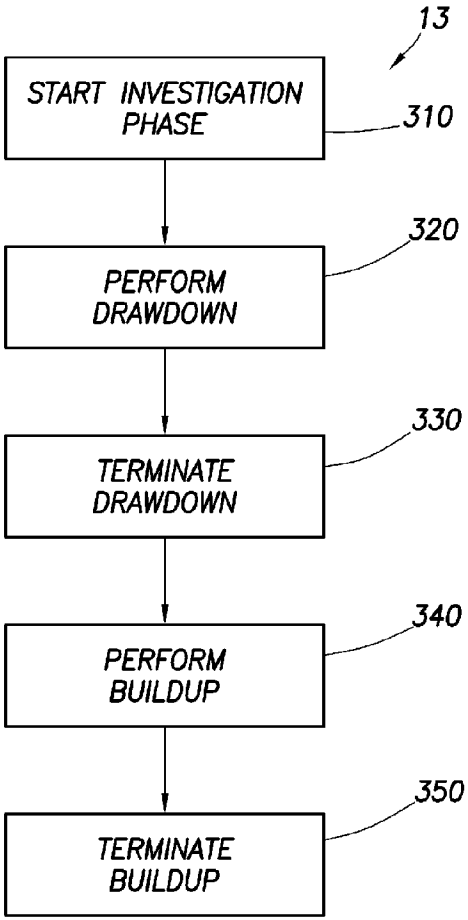
FIG. 6 shows a flow chart detailing the steps involved in performing the investigation phase of the flow chart of FIG. 3.

The investigation phase 13 is shown in greater detail in FIG. 6. The investigation phase comprises initiating the drawdown 310 after the tool is set for duration $T_i$ at time $t_3$, performing the drawdown 320, terminating the drawdown 330, performing the buildup 340 and terminating the buildup 350. To start the investigation phase according to step 310, the probe 112*a* is placed in fluid communication with the formation and anchored into place and the interior of the tool is isolated from the wellbore. The drawdown 320 is performed by advancing the piston 118*a* in pretest chamber 114*a*. To terminate drawdown 330, the piston 118*a* is stopped. The pressure will begin to build up in flow line 119*a* until the buildup 340 is terminated at 350. The investigation phase lasts for a duration of time $T_{1P}$. The investigation phase may also be performed as previously described with respect to FIGS. 1B and 2, the drawdown flow rate and the drawdown termination point being pre-defined before the initiation of the investigation phase.

Figure 7:
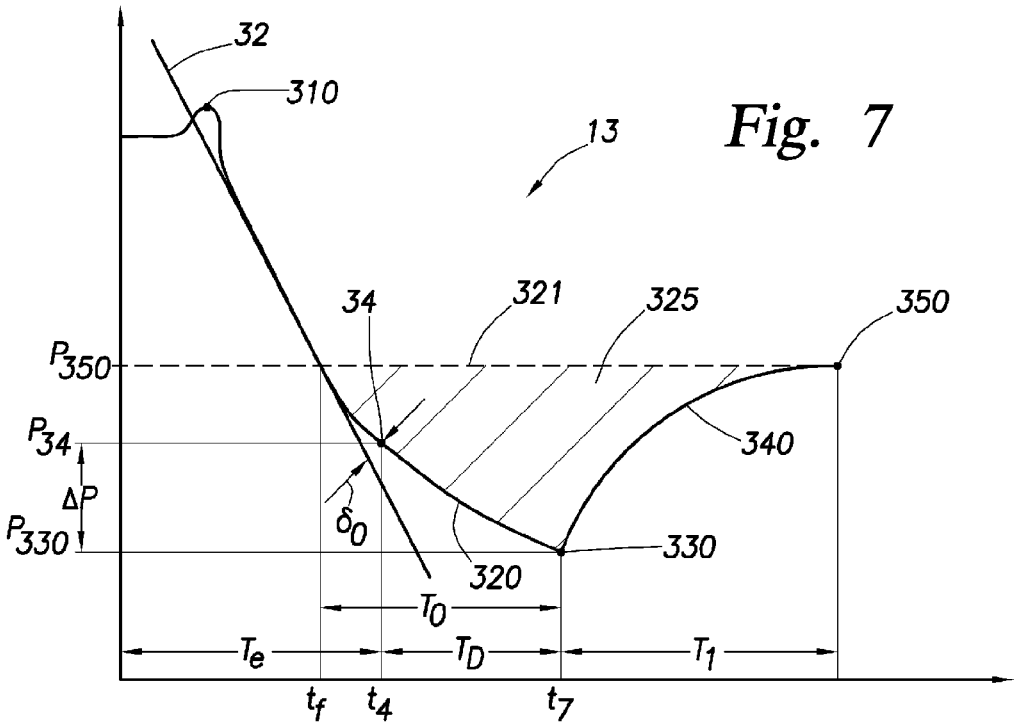
FIG. 7 shows a detailed view of the investigation phase portion of the plot of FIG. 5 depicting the termination of drawdown.

The pressure trace of the investigation phase 13 is shown in greater detail in FIG. 7. Parameters, such as formation pressure and formation mobility, may be determined from an analysis of the data derived from the pressure trace of the investigation phase. For example, termination point 350 represents a provisional estimate of the formation pressure. Alternatively, formation pressures may be estimated more precisely by extrapolating the pressure trend obtained during build up 340 using techniques known by those of skill in the art, the extrapolated pressure corresponding to the pressure that would have been obtained had the buildup been allowed to continue indefinitely. Such procedures may require additional processing to arrive at formation pressure.

Formation mobility $(K/\mu)_1$ may also be determined from the build up phase represented by line 340. Techniques known by those of skill in the art may be used to estimate the formation mobility from the rate of pressure change with time during build up 340. Such procedures may require additional processing to arrive at estimates of the formation mobility.

Alternatively, the work presented in a publication by Goode at al entitled "Multiple Probe Formation Testing and Vertical Reservoir Continuity", SPE 22738, prepared for presentation at the 1991 Society of Petroleum Engineers Annual Technical Conference and Exhibition, held at Dallas, Tex. on Oct. 6 through 9, 1991 implies that the area of the graph depicted by the shaded region and identified by reference numeral 325, denoted herein by A, may be used to predict formation mobility. This area is bounded by a line 321 extending horizontally from termination point 350 (representing the estimated formation pressure $P_{350}$ at termination), the drawdown line 320 and the build up line 340. This area may be determined and related to an estimate of the formation mobility through use of the following equation:

$$\left(\frac{K}{\mu}\right)_1 = \frac{V_1}{4r_p}\frac{\Omega_S}{A} + \varepsilon_K \tag{1}$$

where $(K/\mu)_1$ is the first estimate of the formation mobility (D/cP), where K is the formation permeability (Darcies, denoted by D) and $\mu$ is the formation fluid viscosity (cP) (since the quantity determined by formation testers is the ratio of the formation permeability to the formation fluid viscosity, i.e. the mobility, the explicit value of the viscosity is not needed); $V_1$ ($cm^3$) is the volume extracted from the formation during the investigation pretest, $V_1=V(t_7+T_1)-V(t_7-T_0)=V(t_7)-V(t_7-_0)$ where V is the volume of the pretest chamber; $r_p$ is the probe radius (cm); and $\epsilon_K$ is an error term which is typically small (less than a few percent) for formations having a mobility greater than 1 mD/cP.

The variable $\Omega_S$, which accounts for the effect of a finite-size wellbore on the pressure response of the probe, may be determined by the following equation described in a publication by F. J. Kuchuk entitled "Multiprobe Wireline Formation Tester Pressure Behavior in Crossflow-Layered Reservoirs", In Situ, (1996) 20, 1,1:

$$\Omega_S=0.994-0.003\theta-0.353\theta^2-0.714\theta^3+0.709\theta^4 \tag{2}$$

where $r_p$ and $r_w$ represent the radius of the probe and the radius of the well, respectively; $\rho=r_p/r_w$, $\eta=K_r/K_z$; $\theta=0.58+0.078 \log \eta+0.26 \log \rho+0.8 \rho^2$; and $K_r$ and $K_z$ represent the radial permeability and the vertical permeability, respectively.

In stating the result presented in equation 1 it has been assumed that the formation permeability is isotropic, that is $K_r=K_z=K$, that the flow regime during the test is "spherical", and that the conditions which ensure the validity of Darcy's relation hold.

Referring still to FIG. 7, the drawdown step 320 of the investigation phase may be analyzed to determine the pressure drop over time to determine various characteristics of the pressure trace. A best fit line 32 derived from points along drawdown line 320 is depicted extending from initiation point 310. A deviation point 34 may be determined along curve 320 representing the point at which the curve 320 reaches a minimum deviation $\delta_0$ from the best fit line 32. The deviation point 34 may be used as an estimate of the "onset of flow", the point at which fluid is delivered from the formation into the tool during the investigation phase drawdown.

The deviation point 34 may be determined by known techniques, such as the techniques disclosed in U.S. Pat. Nos. 5,095,745 and 5,233,866 both issued to Desbrandes, the entire contents of which are hereby incorporated by reference. Debrandes teaches a technique for estimating the formation pressure from the point of deviation from a best fit line created using data points from the drawdown phase of the pretest. The deviation point may alternatively be determined by testing the most recently acquired point to see if it remains on the linear trend representing the flowline expansion as successive pressure data are acquired. If not, the drawdown may be terminated and the pressure allowed to stabilize. The deviation point may also be determined by taking the derivative of the pressure recorded during 320 with respect to time. When the derivative changes (presumably becomes less) by 2-5%, the corresponding point is taken to represent the beginning of flow from the formation. If necessary, to confirm that the deviation from the expansion line represents flow from the formation, further small-volume pretests may be performed.

Other techniques may be used to determine deviation point 34. For example, another technique for determining the deviation point 34 is based on mud compressibility and will be discussed further with respect to FIGS. 9-11.

Once the deviation point 34 is determined, the drawdown is continued beyond the point 34 until some prescribed termination criterion is met. Such criteria may be based on pressure, volume and/or time. Once the criterion has been met, the drawdown is terminated and termination point 330 is reached. It is desirable that the termination point 330 occur at a given pressure $P_{330}$ within a given pressure range $\Delta P$ relative to the deviation pressure $P_{34}$ corresponding to deviation point 34 of FIG. 7. Alternatively, it may be desirable to terminate drawdown within a given period of time following the determination of the deviation point 34. For example, if deviation occurs at time $t_4$, termination may be preset to occur by time $t_7$, where the time expended between time $t_4$ and $t_7$ is designated as $T_D$ and is limited to a maximum duration. Another criterion for terminating the pretest is to limit the volume withdrawn from the formation after the point of deviation 34 has been identified. This volume may be determined by the change in volume of the pretest chamber 114*a* (FIG. 4). The maximum change in volume may be specified as a limiting parameter for the pretest.

One or more of the limiting criteria, pressure, time and/or volume, may be used alone or in combination to determine the termination point 330. If, for example, as in the case of highly permeable formations, a desired criterion, such as a predetermined pressure drop, cannot be met, the duration of the pretest may be further limited by one or more of the other criteria.

After deviation point 34 is reached, pressure continues to fall along line 320 until expansion terminates at point 330. At this point, the probe isolation valve 121*a* is closed and/or the pretest piston 118*a* is stopped and the investigation phase build up 340 commences. The build up of pressure in the flowline continues until termination of the buildup occurs at point 350.

The pressure at which the build up becomes sufficiently stable is often taken as an estimate of the formation pressure. The buildup pressure is monitored to provide data for estimating the formation pressure from the progressive stabilization of the buildup pressure. In particular, the information obtained may be used in designing a measurement phase transient such that a direct measurement of the formation pressure is achieved at the end of build up. The question of how long the investigation phase buildup should be allowed to continue to obtain an initial estimate of the formation pressure remains.

It is clear from the previous discussion that the buildup should not be terminated before pressure has recovered to the level at which deviation from the flowline decompression was identified, i.e. the pressure designated by $P_{34}$ on FIG. 7. In one approach, a set time limit may be used for the duration of the buildup $T_1$. $T_1$ may be set at some number, such as 2 to 3 times the time of flow from the formation $T_0$. Other techniques and criteria may be envisioned.

As shown in FIGS. 5 and 7, termination point 350 depicts the end of the buildup, the end of the investigation phase and/or the beginning of the measurement phase. Certain criteria may be used to determine when termination 350 should occur. A possible approach to determination of termination 350 is to allow the measured pressure to stabilize. To establish a point at which a reasonably accurate estimate of formation pressure at termination point 350 may be made relatively quickly, a procedure for determining criteria for establishing when to terminate may be used.

Figure 8:
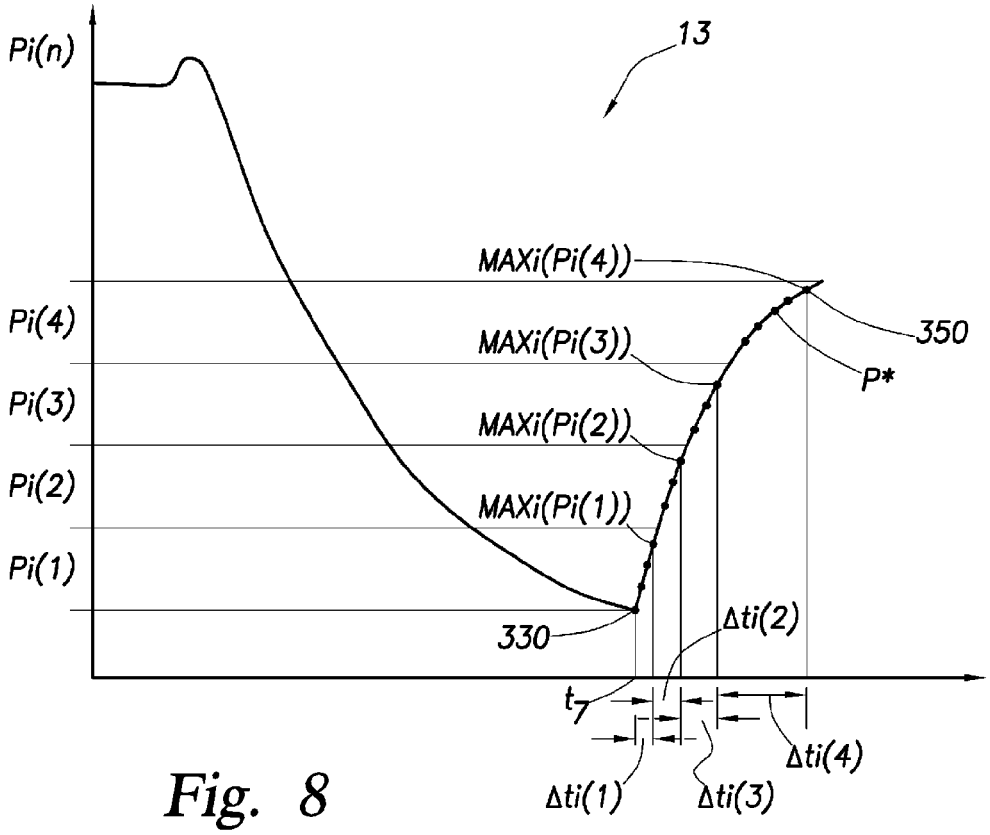
FIG. 8 shows a detailed view of the investigation phase portion of the plot of FIG. 5 depicting the determination of termination of buildup.

As shown in FIG. 8, one such procedure involves establishing a pressure increment beginning at the termination of drawdown point 330. For example, such a pressure increment could be a large multiple of the pressure gauge resolution, or a multiple of the pressure gauge noise. As buildup data are acquired successive pressure points will fall within one such interval. The highest pressure data point within each pressure increment is chosen and differences are constructed between the corresponding times to yield the time increments $\Delta t_{i(n)}$. Buildup is continued until the ratio of two successive time increments is greater than or equal to a predetermined number, such as 2. The last recorded pressure point in the last interval at the time this criterion is met is the calculated termination point 350. This analysis may be mathematically represented by the following:

Starting at $t_7$, the beginning of the buildup of the investigation phase, find a sequence of indices $\{i(n)\} \subset \{i\}$, $i(n)>i(n-1)$, $n=2, 3, \ldots$, such that for $n \geqq 2$, $i(1)=1$, and $$\max_i (p_{i(n)} - p_{i(n-1)}) \leq (n_P \delta_P, \varepsilon_P) \tag{3}$$

where $n_P$ is a number with a value equal to or greater than, for example, 4, typically 10 or greater, $\delta_P$ is the nominal resolution of the pressure measuring instrument; and $\epsilon_P$ is a small multiple, say 2, of the pressure instrument noise—a quantity which may be determined prior to setting the tool, such as during the mud compressibility experiment.

One skilled in the art would appreciate that other values of $n_P$ and $\epsilon_P$ may be selected, depending on the desired results, without departing from the scope of the invention. If no points exist in the interval defined by the right hand side of equation (3) other than the base point, the closest point outside the interval may be used.

Defining $\Delta t_{i(n)} \equiv t_{i(n)} - t_{i(n-1)}$, the buildup might be terminated when the following conditions are met: $p_{i(n)} \geqq p(t_4) = P_{34}$ (FIG. 7) and $$\frac{\Delta t_{i(n)}}{\Delta t_{i(n-1)}} \geq m_P \tag{4}$$

where $m_P$ is a number greater than or equal to, for example, 2.

The first estimate of the formation pressure is then defined as (FIG. 7):

$$p(t_{i(max(n))})=p(t_7+T_1)=P_{350}. \tag{5}$$

In rough terms, the investigation phase pretest according to the current criterion is terminated when the pressure during buildup is greater than the pressure corresponding to the point of deviation 34 and the rate of increase in pressure decreases by a factor of at least 2. An approximation to the formation pressure is taken as the highest pressure measured during buildup.

The equations (3) and (4) together set the accuracy by which the formation pressure is determined during the investigation phase: equation (3) defines a lower bound on the error and $m_P$ roughly defines how close the estimated value is to the true formation pressure. The larger the value of $m_P$, the closer the estimated value of the formation pressure will be to the true value, and the longer the duration of the investigation phase will be.

Yet another criterion for terminating the investigation phase buildup may be based on the flatness of the buildup curve, such as would be determined by comparing the average value of a range of pressure buildup points to a small multiple, for example 2 or 4, of the pressure gauge noise. It will be appreciated that any of the criteria disclosed herein singly, or in combination, may be used to terminate the investigation phase buildup (i.e. 340 on FIG. 5), measurement phase buildup (i.e. 380 on FIG. 5 and described below) or, more generally, any buildup.

As shown in FIG. 7, the termination point 350 depicts the end of the investigation phase 13 following completion of the build up phase 340. However, there may be instances where it is necessary or desirable to terminate the pretest. For example, problems in the process, such as when the probe is plugged, the test is dry or the formation mobility is so low that the test is essentially dry, the mud pressure exactly balances the formation pressure, a false breach is detected, very low permeability formations are tested, a change in the compressibility of the flowline fluid is detected or other issues occur, may justify termination of the pretest prior to completion of the entire cycle.

Once it is desired that the pretest be terminated during the investigation phase, the pretest piston may be halted or probe isolation valve 121 closed (if present) so that the volume in flow line 119 is reduced to a minimum. Once a problem has been detected, the investigation phase may be terminated. If desired, a new investigative phase may be performed.

Referring back to FIG. 5, upon completion of the investigation phase 13, a decision may be made on whether the conditions permit or make desirable performance of the measurement phase 14. This decision may be performed manually. However, it is preferable that the decision be made automatically, and on the basis of set criteria.

One criterion that may be used is simply time. It may be necessary to determine whether there is sufficient time $T_{MP}$ to perform the measurement phase. In FIG. 5, there was sufficient time to perform both an investigation phase and a measurement phase. In other words, the total time $T_t$ to perform both phases was less than the time allotted for the cycle. Typically, when $T_{1P}$ is less than half the total time $T_t$, there is sufficient time to perform the measurement phase.

Another criterion that may be used to determine whether to proceed with the measurement phase is volume V. It may also be necessary or desirable, for example, to determine whether the volume of the measurement phase will be at least as great as the volume extracted from the formation during the investigation phase. If one or more of conditions are not met, the measurement phase may not be executed. Other criteria may also be determinative of whether a measurement phase should be performed. Alternatively, despite the failure to meet any criteria, the investigation phase may be continued through the remainder of the allotted time to the end so that it becomes, by default, both the investigation phase and the measurement phase.

It will be appreciated that while FIG. 5 depicts a single investigation phase 13 in sequence with a single measurement phase 14, various numbers of investigation phases and measurement phases may be performed in accordance with the present invention. Under extreme circumstances, the investigation phase estimates may be the only estimates obtainable because the pressure increase during the investigation phase buildup may be so slow that the entire time allocated for the test is consumed by this investigation phase. This is typically the case for formations with very low permeabilities. In other situations, such as with moderately to highly permeable formations where the buildup to formation pressure will be relatively quick, it may be possible to perform multiple pretests without running up against the allocated time constraint.

Referring still to FIG. 5, once the decision is made to perform the measurement phase 14, then the parameters of the investigation phase 13 are used to design the measurement phase. The parameters derived from the investigation phase, namely the formation pressure and mobility, are used in specifying the operating parameters of the measurement phase pretest. In particular, it is desirable to use the investigation phase parameters to solve for the volume of the measurement phase pretest and its duration and, consequently, the corresponding flow rate. Preferably, the measurement phase operating parameters are determined in such a way to optimize the volume used during the measurement phase pretest resulting in an estimate of the formation pressure within a given range. More particularly, it is desirable to extract just enough volume, preferably a larger volume than the volume extracted from the formation during the investigation phase, so that at the end of the measurement phase, the pressure recovers to within a desired range δ of the true formation pressure $p_f$. The volume extracted during the measurement phase is preferably selected so that the time constraints may also be met.

Let H represent the pressure response of the formation to a unit step in flow rate induced by a probe tool as previously described. The condition that the measured pressure be within δ of the true formation pressure at the end of the measurement phase can be expressed as:

$$H(T'_{tD}) - H((T'_t - T_o)_D) + \frac{q_2}{q_1}\{H((T'_t - T_o - T_1)_D) - H((T'_t - T_o - T_1 - T_2)_D)\} \leq \frac{2\pi r * \sqrt{K_r K_z}}{\mu q_1}\delta \tag{6}$$

where $T'_t$ is the total time allocated for both the investigation and measurement phases minus the time taken for flowline expansion, i.e. $T'_t=T_t-(t_7-t_f)=T_0+T_1+T_2+T_3$ in FIG. 5 (prescribed before the test is performed—seconds); is the approximate duration of formation flow during the investigation phase (determined during acquisition—seconds); $T_1$ is the duration of the buildup during the investigation phase (determined during acquisition—seconds); $T_2$ is the duration of the drawdown during the measurement phase (determined during acquisition—seconds); $T_3$ is the duration of the buildup during the measurement phase (determined during acquisition—seconds); $q_1$ and $q_2$ represent, respectively, the constant flowrates of the investigation and measurement phases respectively (specified before acquisition and determined during acquisition—$cm^3$/sec); $\delta$ is the accuracy to which the formation pressure is to be determined during the measurement phase (prescribed—atmospheres), i.e., $p_f-p(T_t)\leqq\delta$, where $p_f$ is the true formation pressure; $\phi$ is the formation porosity, $C_t$ is the formation total compressibility (prescribed before acquisition from knowledge of the formation type and porosity through standard correlations—1/atmospheres);

$$T_{nD} = \frac{K_r T_n}{\phi\mu C_t r_*^2} \equiv \frac{T_n}{\tau}$$

where n=t, 0, 1, 2 denotes a dimensionless time and $\tau\equiv\phi\mu C_t r^{*2}/K_r$ represents a time constant; and, r* is an effective probe radius defined by $$r^* = \frac{r_p}{K(m;\pi/2)}\frac{1}{\Omega_S} = \frac{2r_p}{\pi(1+(1/2)^2m+(3/8)^2m^2+O(m^3))}\frac{1}{\Omega_S}$$

where K is a complete elliptic integral of the first kind with modulus $m\equiv\sqrt{1-K_z/K_r}$. If the formation is isotopic, then $r^*=2r_p/(\pi\Omega_S)$.

Equivalently, the measurement phase may be restricted by specifying the ratio of the second to the first pretest flow rates and the duration, $T_2$, of the measurement phase pretest, and therefore its volume.

In order to completely specify the measurement phase, it may be desirable to further restrict the measurement phase based on an additional condition. One such condition may be based on specifying the ratio of the duration of the drawdown portion of the measurement phase relative to the total time available for completion of the entire measurement phase since the duration of the measurement phase is known after completion of the investigation phase, namely, $T_2+T_3=T'_t-T_o-T_1$. For example, one may wish to allow twice (or more than twice) as much time for the buildup of the measurement phase as for the drawdown, then $T_3=n_T T_2$, or, $T_2=(T'_t-T_o-T_1)/(n_T+1)$ where $n_T\geqq 2$. Equation (6) may then be solved for the ratio of the measurement to investigation phase pretest flowrates and consequently the volume of the measurement phase $V_2=q_2T_2$.

Yet another condition to complete the specification of the measurement phase pretest parameters would be to limit the pressure drop during the measurement phase drawdown. With the same notation as used in equation (6) and the same governing assumptions this condition can be written as:

$$H((T_o+T_1+T_2)_D) - H((T_1+T_2)_D) + \frac{q_2}{q_1}H((T_2)_D) \leq \tag{7}$$

-continued $$\frac{2\pi r_* \sqrt{K_r K_z}}{\mu q_1}\Delta p_{max}$$

where $\Delta p_{max}$ (in atmospheres) is the maximum allowable drawdown pressure drop during the measurement phase.

The application of equations (6) and (7) to the determination of the measurement phase pretest parameters is best illustrated with a specific, simple but non-trivial case. For the purposes of illustration it is assumed that, as before, both the investigation and measurement phase pretests are conducted at precisely controlled rates. In addition it is assumed that the effects of tool storage on the pressure response may be neglected, that the flow regimes in both drawdown and buildup are spherical, that the formation permeability is isotropic and that the conditions ensuring the validity of Darcy's relation are satisfied.

Under the above assumptions equation (6) takes the following form:

$$\begin{aligned}&\mathrm{erfc}\left(\frac{1}{2}\sqrt{\frac{\phi\mu C_t r_*^2}{KT'_t}}\right) - \\ &\mathrm{erfc}\left(\frac{1}{2}\sqrt{\frac{\phi\mu C_t r_*^2}{K(T'_t-T_o)}}\right) + + \frac{q_2}{q_1}\left\{\mathrm{erfc}\left(\frac{1}{2}\sqrt{\frac{\phi\mu C_t r_*^2}{K(T'_t-T_o-T_1)}}\right) - \right. \\ &\left.\mathrm{erfc}\left(\frac{1}{2}\sqrt{\frac{\phi\mu C_t r_*^2}{K(T'_t-T_o-T_1-T_2)}}\right)\right\} \leq \frac{2\pi K r_*}{\mu q_l}\delta\end{aligned} \tag{8}$$

where erfc is the complementary error function.

Because the arguments of the error function are generally small, there is typically little loss in accuracy in using the usual square root approximation. After some rearrangement of terms equation (8) can be shown to take the form:

$$\begin{aligned}q_2(\sqrt{\lambda/(\lambda-T_2)}-1) &\leq \frac{2\pi^{3/2}Kr_*}{\mu}\delta\sqrt{\frac{\lambda}{\tau}} - \\ &\quad q_1\left(\sqrt{\lambda/(T'_t-T_o)}-\sqrt{\lambda/T'_t}\right) \\ &\equiv \frac{2\pi^{3/2}Kr_*}{\mu}\delta\sqrt{\frac{\lambda}{\tau}} - q_1 u(\lambda)\end{aligned} \tag{9}$$

where $\lambda\equiv T_2+T_3$, the duration of the measurement phase, is a known quantity once the investigation phase pretest has been completed.

The utility of this relation is clear once the expression in the parentheses on the left hand side is approximated further to obtain an expression for the desired volume of the measurement phase pretest.

$$V_2\left\{1+\left(\frac{3}{4}\right)\left(\frac{T_2}{\lambda}\right)+O(T_2^2)\right\} = 4\pi^{3/2}\phi C_t\delta\left(\frac{K}{\mu}\frac{T_2+T_3}{\phi C_t}\right)^{3/2} - \lambda q_1 u(\lambda) \tag{10}$$

With the same assumptions made in arriving at equation (8) from equation (6), equation (7) may be written as, $$\operatorname{erfc}\left(\frac{1}{2}\sqrt{\frac{\phi\mu C_t r_*^2}{K(T_o+T_1+T_2)}}\right)-\operatorname{erfc}\left(\frac{1}{2}\sqrt{\frac{\phi\mu C_t r_*^2}{K(T_1+T_2)}}\right)++\frac{q_2}{q_1}\operatorname{erfc}\left(\frac{1}{2}\sqrt{\frac{\phi\mu C_t r_*^2}{KT_2}}\right)\leq\frac{2\pi K r_*}{\mu q_1}\Delta p_{max} \tag{11}$$

which, after applying the square-root approximation for the complementary error function and rearranging terms, can be expressed as:

$$q_2\left(1-\sqrt{\tau/(\pi T_2)}\right)\leq=\frac{2\pi K r_*}{\mu}\Delta p_{max}-\frac{q_1}{\sqrt{\pi}}\left(\frac{\sqrt{\tau/(T_1+T_2)}-}{\sqrt{\tau/(T_o+T_1+T_2)}}\right)\equiv\frac{2\pi K r_*}{\mu}\Delta p_{max}-q_1 v(T_2) \tag{12}$$

Combining equations (9) and (12) gives rise to:

$$\sqrt{\frac{\lambda}{\lambda-T_2}}=1+\left\{\sqrt{\pi}\frac{\delta}{\Delta p_{max}}\sqrt{\frac{\lambda}{\tau}}-\frac{q_1\mu}{2\pi K r_*}\frac{1}{\Delta p_{max}}t\lambda\right)\right\}\times\times\left\{1+\frac{q_1\mu}{2\pi K r_*}\frac{1}{\Delta p_{max}}v(T_2)\right\}^{-1}\left(1-\sqrt{\tau/(\pi T_2)}\right)^{-1} \tag{13}$$

Because the terms in the last two bracket/parenthesis expressions are each very close to unity, equation (13) may be approximated as:

$$\frac{T_2}{\lambda}\approx 1-\left\{1+\sqrt{\pi}\frac{\delta}{\Delta p_{max}}\sqrt{\frac{\lambda}{\tau}}-\frac{q_1\mu}{2\pi K r_*}\frac{1}{\Delta p_{max}}u(\lambda)\right\}^{-2} \tag{14}$$

which gives an expression for the determination of the duration of the measurement phase drawdown and therefore, in combination with the above result for the measurement phase pretest volume, the value of the measurement phase pretest flowrate. To obtain realistic estimates for $T_2$ from equation (14), the following condition should hold:

$$\delta>\frac{q_1\mu}{2\pi^{3/2}K r_*}\frac{1}{\Delta p_{max}}u(\lambda) \tag{15}$$

Equation (15) expresses the condition that the target neighborhood of the final pressure should be greater than the residual transient left over from the investigation phase pretest.

In general, the estimates delivered by equations (10) and (14) for $V_2$ and $T_2$ may be used as starting values in a more comprehensive parameter estimation scheme utilizing equations (8) and (11). While equations (8) and (11) have been used to illustrate the steps in the procedure to compute the measurement phase parameters, it will be appreciated that other effects, such as tool storage, formation complexities, etc., may be readily incorporated in the estimation process. If the formation model is know, the more general formation model equations (6) and (7) may be used within the parameter estimation process.

The above described approach to determining the measurement phase pretest assumes that certain parameters will be assigned before the optimal pretest volume and duration can be estimated. These parameters include: the accuracy of the formation pressure measurement δ; the maximum drawdown permissible ($\Delta p_{max}$); the formation porosity ϕ—which will usually be available from openhole logs; and, the total compressibility $C_t$—which may be obtained from known correlations which in turn depend on lithology and porosity.

With the measurement phase pretest parameters determined, it should be possible to achieve improved estimates of the formation pressure and formation mobility within the time allocated for the entire test.

At point 350, the investigation phase ends and the measurement phase may begin. The parameters determined from the investigation phase are used to calculate the flow rate, the pretest duration and/or the volume necessary to determine the parameters for performing the measurement phase 14. The measurement phase 14 may now be performed using a refined set of parameters determined from the original formation parameters estimated in the investigation phase.

Figure 9:
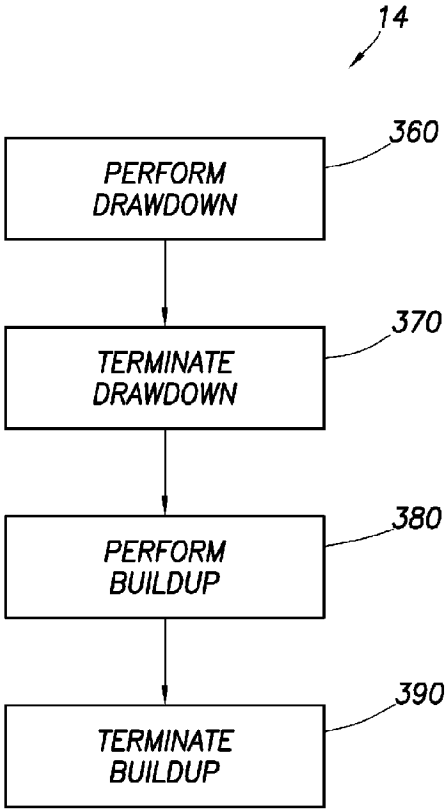
FIG. 9 shows a flow chart detailing the steps involved in performing the measurement phase of the flow chart of FIG. 3.

As shown in FIG. 9, the measurement phase 14 includes the steps of performing a second draw down 360, terminating the draw down 370, performing a second build up 380 and terminating the build up 390. These steps are performed as previously described according to the investigation phase 13 of FIG. 6. The parameters of the measurement phase, such as flow rate, time and/or volume, preferably have been predetermined according to the results of the investigation phase.

Referring back to FIG. 5, the measurement phase 14 preferably begins at the termination of the investigation phase 350 and lasts for duration $T_{MP}$ specified by the measurement phase until termination at point 390. Preferably, the total time to perform the investigation phase and the measurement phase falls within an allotted amount of time. Once the measurement phase is completed, the formation pressure may be estimated and the tool retracted for additional testing, downhole operations or removal from the wellbore.

Figure 10:
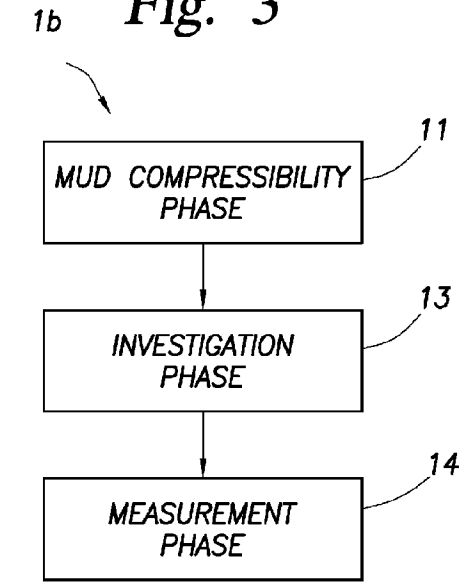
FIG. 10 shows a flow chart of steps involved in a pretest according to an embodiment of the invention incorporating a mud compressibility phase.
Figure 11A:
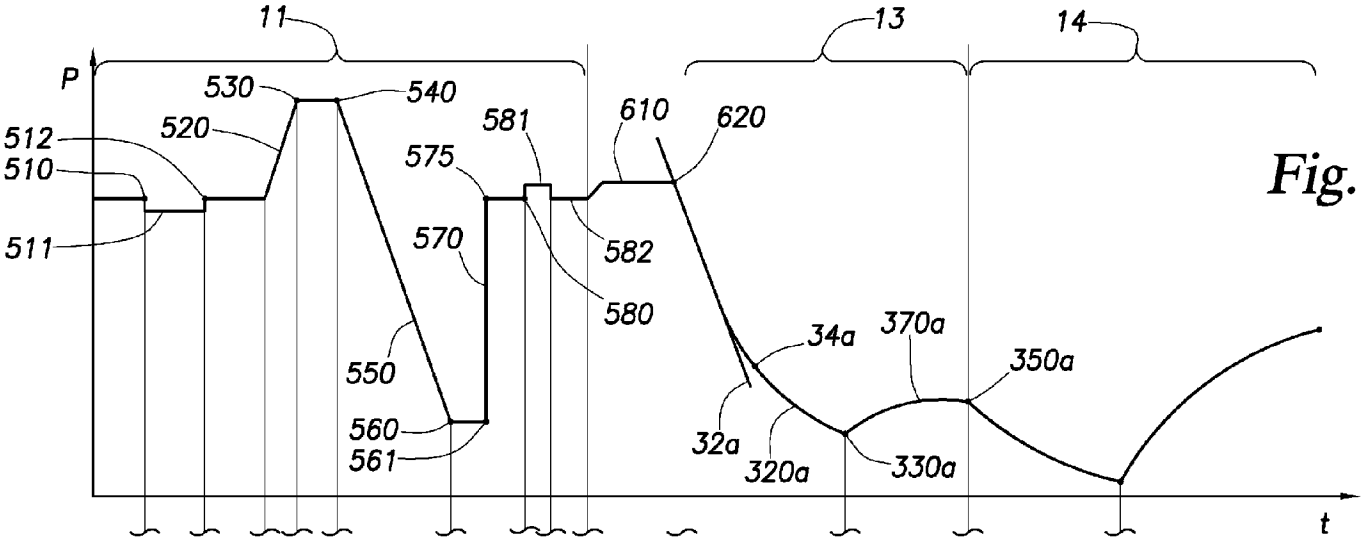
FIG. 11A shows a graphical representation of pressure measurements versus time plot for performing the pretest of FIG. 10.
Figure 11B:
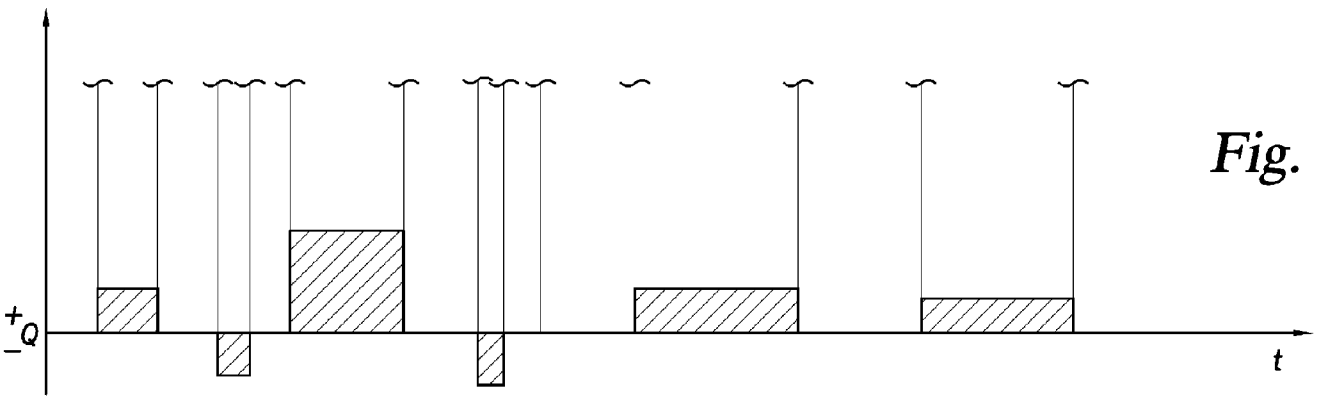
FIG. 11B shows the rate of change of volume corresponding to the graphical representation of FIG. 11A.

Referring now to FIG. 10, an alternate embodiment of the foregoing method for estimating formation properties incorporating a mud compressibility phase 11 is depicted. This embodiment comprises a mud compressibility phase 11, an investigation phase 13 and a measurement phase 14. Estimations of mud compressibility may be used to refine the investigation phase procedure leading to better estimates of parameters from the investigation phase 13 and the measurement phase 14. FIG. 11A depicts a pressure trace corresponding to the method of FIG. 10, and FIG. 11B shows a related graphical representation of the rate of change of the pretest chamber volume.

In this embodiment, the formation tester of FIG. 4 may be used to perform the method of FIG. 10. According to this embodiment, the isolation valves 121*a* and 124*a* may be used, in conjunction with equalizing valve 128*a*, to trap a volume of liquid in flowline 103*a*. In addition, the isolation valve 121*a* may be used to reduce tool storage volume effects so as to facilitate a rapid buildup. The equalizing valve 128*a* additionally allows for easy flushing of the flowline to expel unwanted fluids such as gas and to facilitate the refilling of the flowline sections 119*a* and 103*a* with wellbore fluid.

The mud compressibility measurement may be performed, for example, by first drawing a volume of mud into the tool from the wellbore through the equalizing valve 128*a* by means of the pretest piston 118*a*, isolating a volume of mud in the flowline by closing the equalizing valve 128*a* and the isolation valves 121*a* and 124*a*, compressing and/or expanding the volume of the trapped mud by adjusting the volume of the pretest chamber 114*a* by means of the pretest piston 118*a* and simultaneously recording the pressure and volume of the trapped fluid by means of the pressure gauge 120*a*.

The volume of the pretest chamber may be measured very precisely, for example, by measuring the displacement of the pretest piston by means of a suitable linear potentiometer not shown in FIG. 4 or by other well established techniques. Also not shown in FIG. 4 is the means by which the speed of the pretest piston can be controlled precisely to give the desired control over the pretest piston rate $q_p$. The techniques for achieving these precise rates are well known in the art, for example, by use of pistons attached to lead screws of the correct form, gearboxes and computer controlled motors such rates as are required by the present method can be readily achieved.

Figures 12, 13:
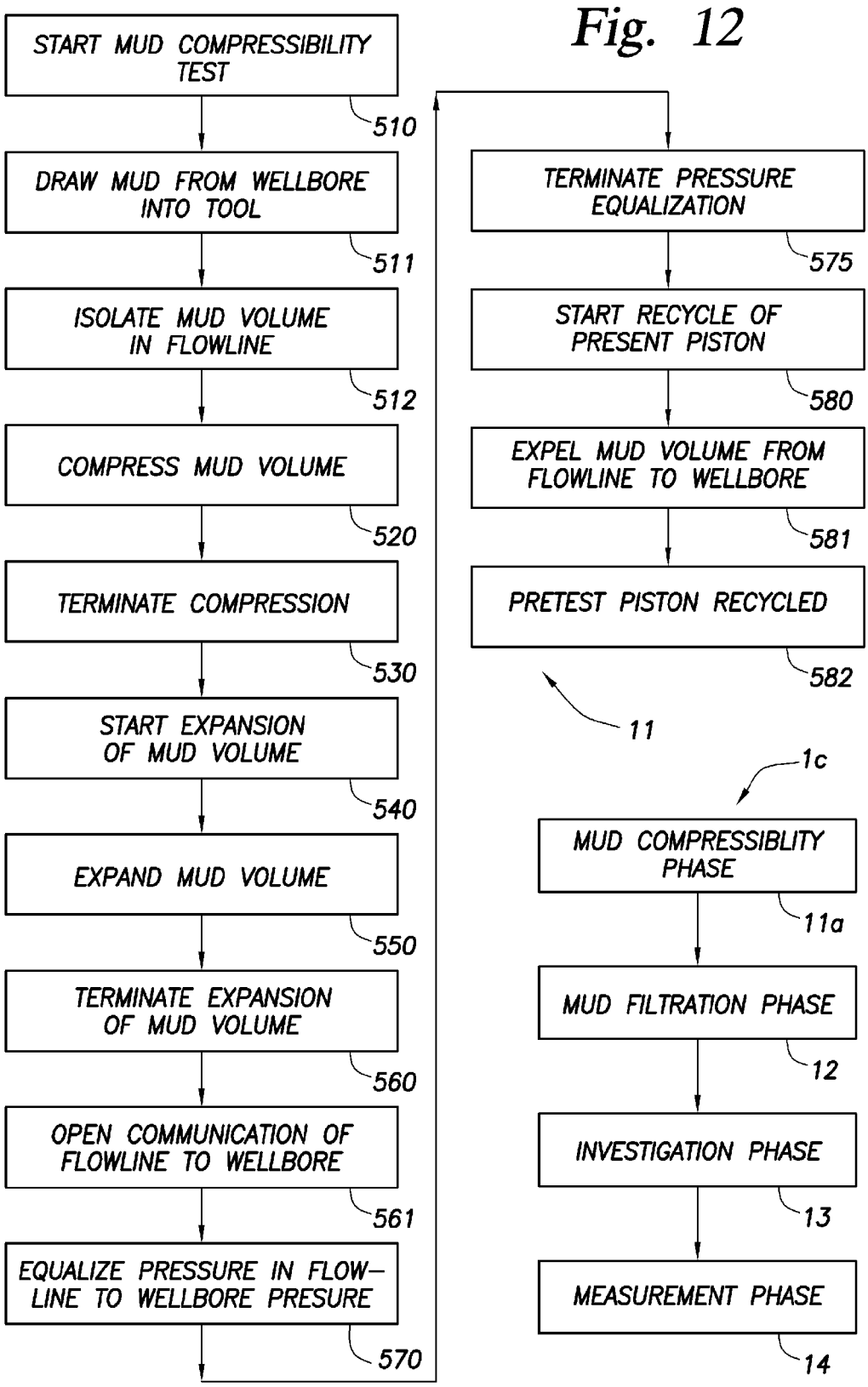
FIG. 12 shows a flow chart detailing the steps involved in performing the mud compressibility phase of the flow chart of FIG. 10.
FIG. 13 shows a flow chart of steps involved in a pretest according to an embodiment of the invention incorporating a mud filtration phase.

FIGS. 11A and 12 depict the mud compressibility phase 11 in greater detail. The mud compressibility phase 11 is performed prior to setting the tool and therefore prior to conducting the investigation and measurement phases. In particular, the tool does not have to be set against the wellbore, nor does it have to be immobile in the wellbore in order to conduct the mud compressibility test thereby reducing the risk of sticking the tool due to an immobilized drill string. It would be preferable, however, to sample the wellbore fluid at a point close to the point of the test.

The steps used to perform the compressibility phase 11 are shown in greater detail in FIG. 12. These steps also correspond to points along the pressure trace of FIG. 11A. As set forth in FIG. 12, the steps of the mud compressibility test include starting the mud compressibility test 510, drawing mud from the wellbore into the tool 511, isolating the mud volume in the flow line 512, compressing the mud volume 520 and terminating the compression 530. Next, the expansion of mud volume is started 540, the mud volume expands 550 for a period of time until terminated 560. Open communication of the flowline to wellbore is begun 561, and pressure is equalized in the flowline to wellbore pressure 570 until terminated 575. The pretest piston recycling may now begin 580. Mud is expelled from the flowline into the wellbore 581 and the pretest piston is recycled 582. When it is desired to perform the investigation phase, the tool may then be set 610 and open communication of the flowline with the wellbore terminated 620.

Mud compressibility relates to the compressibility of the flowline fluid, which typically is whole drilling mud. Knowledge of the mud compressibility may be used to better determine the slope of the line 32 (as previously described with respect to FIG. 7), which in turn leads to an improved determination of the point of deviation 34 signaling flow from the formation. Knowledge of the value of mud compressibility, therefore, results in a more efficient investigation phase 13 and provides an additional avenue to further refine the estimates derived from the investigation phase 13 and ultimately to improve those derived from the measurement phase 14.

Mud compressibility $C_m$ may be determined by analyzing the pressure trace of FIG. 11A and the pressure and volume data correspondingly generated. In particular, mud compressibility may be determined from, the following equation:

$$C_m = -\frac{1}{V}\frac{dV}{dp} \text{ or, equivalently, } q_p = -C_m V \dot{p} \tag{16}$$

where $C_m$ is the mud compressibility (1/psi), V is the total volume of the trapped mud ($cm^3$), p is the measured flowline pressure (psi), $\dot{p}$ is the time rate of change of the measured flowline pressure (psi/sec), and $q_p$ represents the pretest piston rate ($cm^3$/sec).

To obtain an accurate estimate of the mud compressibility, it is desirable that more than several data points be collected to define each leg of the pressure-volume trend during the mud compressibility measurement. In using equation (16) to determine the mud compressibility the usual assumptions have been made, in particular, the compressibility is constant and the incremental pretest volume used in the measurement is small compared to the total volume V of mud trapped in the flowline.

The utility of measuring the mud compressibility in obtaining a more precise deviation point 34*a* is now explained. The method begins by fitting the initial portion of the drawdown data of the investigation phase 13 to a line 32*a* of known slope to the data. The slope of line 32*a* is fixed by the previously determined mud compressibility, flowline volume, and the pretest piston drawdown rate. Because the drawdown is operated at a fixed and precisely controlled rate and the compressibility of the flowline fluid is a known constant that has been determined by the above-described experiment, the equation describing this line with a known slope a is given by:

$$\begin{aligned} p(t) &= p^+ - \frac{q_p}{V(0)C_m}t \\ &= b - at \end{aligned} \tag{17}$$

where V(0) is the flowline volume at the beginning of the expansion, $C_m$ is the mud compressibility, $q_p$ is the piston decompression rate, $p^+$ is the apparent pressure at the initiation of the expansion process. It is assumed that V(0) is very much larger than the increase in volume due to the expansion of the pretest chamber.

Because the slope a is now known the only parameter that needs to be specified to completely define equation (17) is the intercept $p^+$, i.e., b . In general, $p^+$ is unknown, however, when data points belonging to the linear trend of the flowline expansion are fitted to lines with slope a they should all produce similar intercepts. Thus, the value of intercept $p^+$ will emerge when the linear trend of the flowline expansion is identified.

A stretch of data points that fall on a line having the defined slope a, to within a given precision, is identified. This line represents the true mud expansion drawdown pressure trend. One skilled in the art would appreciate that in fitting the data points to a line, it is unnecessary that all points fall precisely on the line. Instead, it is sufficient that the data points fit to a line within a precision limit, which is selected based on the tool characteristics and operation parameters. With this approach, one can avoid the irregular trend associated with early data points, i.e., those points around the start of pretest piston drawdown. Finally, the first point 34*a*, after the points that define the straight line, that deviates significantly (or beyond a precision limit) from the line is the point where deviation from the drawdown pressure trend occurs. The deviation 34*a* typically occurs at a higher pressure than would be predicted by extrapolation of the line. This point indicates the breach of the mudcake.

Various procedures are available for identifying the data points belonging to the flowline expansion line. The details of any procedure depend, of course, on how one wishes to determine the flowline expansion line, how the maximal interval is chosen, and how one chooses the measures of precision, etc.

Two possible approaches are given below to illustrate the details. Before doing so, the following terms are defined:

$$\bar{b}_k \equiv \frac{1}{N(k)}\left(\sum_{n=1}^{N(k)} p_n + a\sum_{n=1}^{N(k)} t_n\right) = \bar{p}_n + a\bar{t}_n \tag{18}$$

$$\hat{b}_k \equiv \underset{N(k)}{median}(p_k + at_k), \text{ and} \tag{19}$$

$$S_{p,k}^2 \equiv \frac{1}{N(k)}\sum_{n=1}^{N(k)}(p_n - p(t_n))^2 = \frac{1}{N(k)}\sum_{n=1}^{N(k)}(p_n - \bar{p}_k + a(t_n - \bar{t}_k))^2 \tag{20}$$

where, in general, N(k)<k represents the number of data points selected from the k data points ($t_k$, $p_k$) acquired. Depending on the context, N(k) may equal k . Equations (18) and (19) represent, respectively, the least-squares line with fixed slope a and the line of least absolute deviation with fixed slope a through N(k) data points, and, equation (20) represents the variance of the data about the fixed slope line.

One technique for defining a line with slope a spanning the longest time interval is to fit the individual data points, as they are acquired, to lines of fixed slope a. This fitting produces a sequence of intercepts $\{b_k\}$, where the individual $b_k$ are computed from: $b_k=p_k+at_k$. If successive values of $b_k$ become progressively closer and ultimately fall within a narrow band, the data points corresponding to these indices are used to fit the final line.

Specifically, the technique may involve the steps of:

(i) determining a median, $\tilde{b}_k$, from the given sequence of intercepts $\{b_k\}$;

(ii) finding indices belonging to the set $I_k=\{i \in [2, \ldots, N(k)] | b_i-\tilde{b}_k| \leqq n_b\epsilon_b\}$ where $n_b$ is a number such as 2 or 3 and where a possible choice for $\epsilon_b$ is defined by the following equation:

$$\varepsilon_b^2 = S_{b,k}^2 = \frac{1}{N(k)}(S_{p,k}^2 + a^2 S_{t,k}^2) = \frac{1}{N(k)}S_{p,k}^2 \tag{21}$$

where the last expression results from the assumption that time measurements are exact. Other, less natural choices for $\epsilon_b$ are possible, for example, $\epsilon_b=S_{p,k}$;

(iii) fitting a line of fixed slope a to the data points with indices belonging to $I_k$; and (iv) finding the first point ($t_k$, $p_k$) that produces $p_k-b^*_k+at_k>n_S S_{p,k}$, where $b^*_k-\hat{b}_k$ or $\bar{b}_k$ depending on the method used for fitting the line, and $n_S$ is a number such as 2 or 3. This point, represented by 34*a* on FIG. 11A, is taken to indicate a breach of the mudcake and the initiation of flow from the formation.

An alternate approach is based on the idea that the sequence of variances of the data about the line of constant slope should eventually become more-or-less constant as the fitted line encounters the true flowline expansion data. Thus, a method according to the invention may be implemented as follows:

(i) a line of fixed slope, a, is first fitted to the data accumulated up to the time $t_k$. For each set of data, a line is determined from $p(t_k)=\bar{b}_k-at_k$, where $\bar{b}_k$ is computed from equation (18);

(ii) the sequence of variances $\{S_{p,k}^2\}$ is constructed using equation (20) with N(k)=k;

(iii) successively indices are found belonging to the set:

$$J_k = \left\{i \in [3, \ldots, k] \middle| S_{p,k-1}^2 - S_{p,k}^2 > \frac{1}{k}S_{p,k-1}^2 - (p_k - (\bar{b}_k - at_k))^2\right\};$$

(iv) a line of fixed slope a is fitted to the data with indices in $J_k$. Let N(k) be the number of indices in the set;

(v) determine the point of departure from the last of the series of fixed-slope lines having indices in the above set as the first point that fulfills $p_k-\bar{b}_k+at_k>n_S S_{p,k}$, where $n_S$ is a number such as 2 or 3;

$$\text{define } S_{min}^2 = \min_{N(k)}\{S_{p,k}^2\};$$

(vii) find the subset of points of $J_k$ such that $N=\{i \in J_k | |p_i-(\bar{b}_i-at_i)|<S_{min}\}$;

(viii) fit a line with slope a through the points with indices in N; and (ix) define the breach of the mudcake as the first point ($t_k$, $p_k$) where $p_k-\bar{b}_k+at_k>n_S S_{p,k}$. As in the previous option this point, represented again by 34*a* on FIG. 11A, is taken to indicate a breach of the mudcake and the initiation of flow from the formation.

Once the best fit line 32*a* and the deviation point 34*a* are determined, the termination point 330*a*, the build up 370*a* and the termination of buildup 350*a* may be determined as discussed previously with respect to FIG. 7. The measurement phase 14 may then be determined by the refined parameters generated in the investigation phase 13 of FIG. 11A.

Figure 14A:
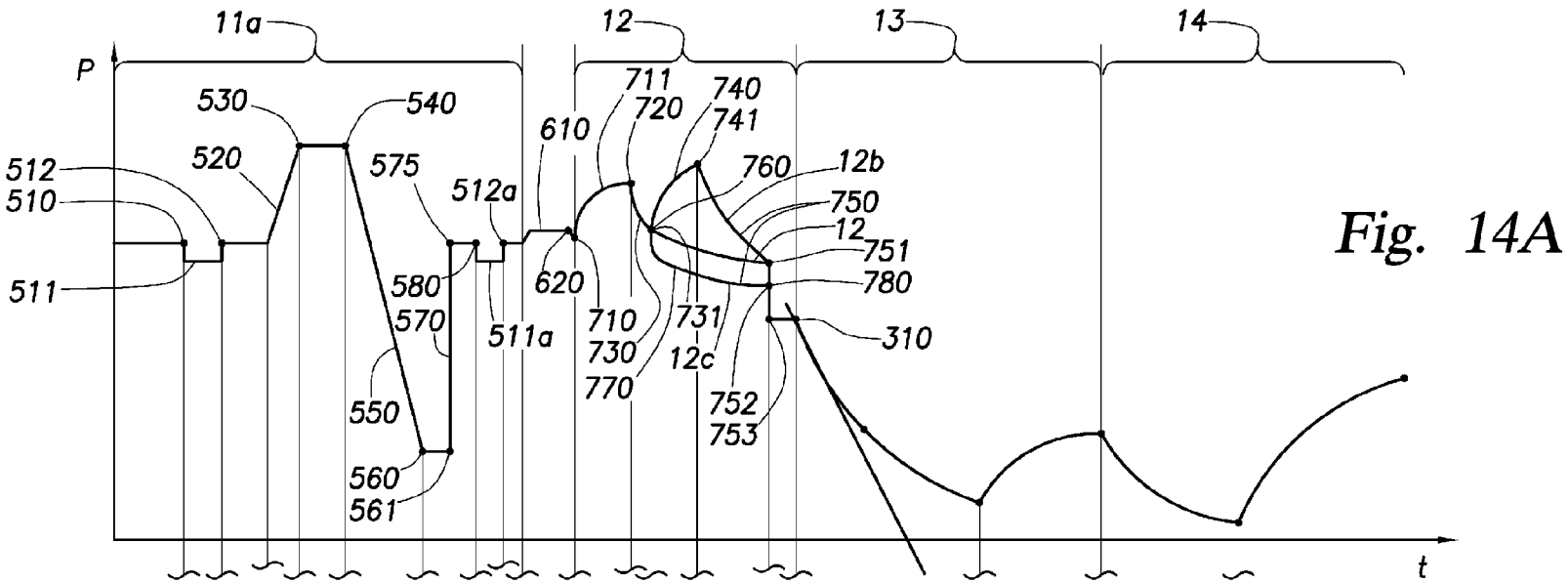
FIG. 14A shows a graphical representation of a pressure measurement versus time plot for performing the pretest of FIG. 13.
Figure 14B:
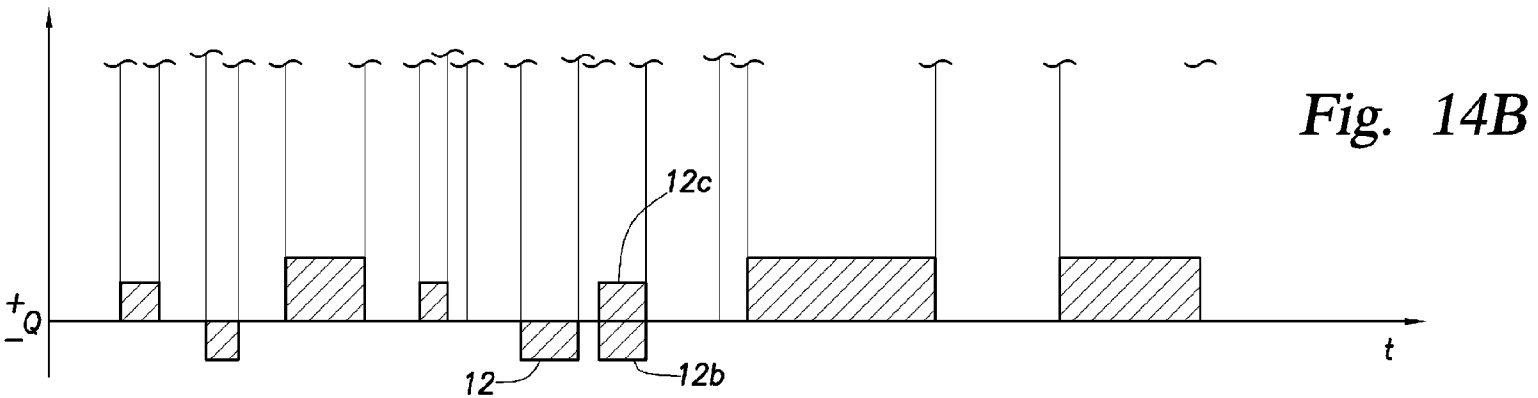
FIG. 14B shows the rate of change of volume corresponding to the graphical representation of FIG. 14A.

Referring now to FIG. 13, an alternate embodiment of the method for estimating formation properties incorporating a mud filtration phase 12 is depicted. In this embodiment the method comprises a mud compressibility phase 11*a*, a mud filtration phase 12, an investigation phase 13 and a measurement phase 14. The corresponding pressure trace is depicted in FIG. 14A, and a corresponding graphical depiction of the rate of change of pretest volume is shown in FIG. 14B. The same tool described with respect to the method of FIG. 10 may also be used in connection with the method of FIG. 13.

FIGS. 14A and 14B depict the mud filtration phase 12 in greater detail. The mud filtration phase 12 is performed after the tool is set and before the investigation phase 13 and the measurement phase 14 are performed. A modified mud compressibility phase 11*a* is performed prior to the mud filtration phase 12.

Figure 15:
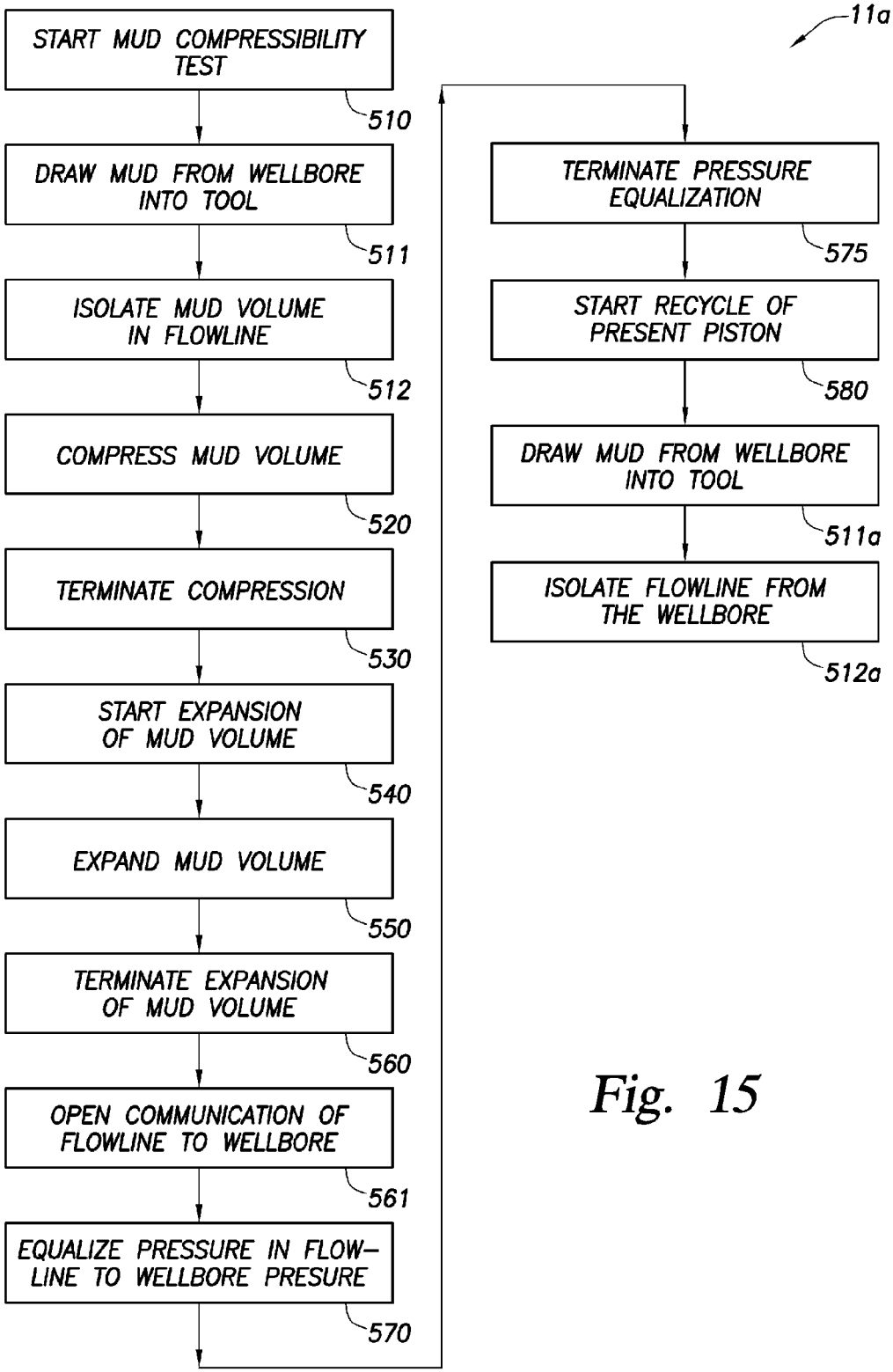
FIG. 15 shows the modified mud compressibility phase of FIG. 12 modified for use with the mud filtration phase.

The modified compressibility test 11*a* is depicted in greater detail in FIG. 15. The modified compressibility test 11*a* includes the same steps 510-580 of the compressibility test 11 of FIG. 12. After step 580, steps 511 and 512 of the mud compressibility test are repeated, namely mud is drawn from the wellbore into the tool 511*a* and the flowline is isolated from the wellbore 512*a*. The tool may now be set 610 and at the termination of the set cycle the flowline may be isolated 620 in preparation for the mud filtration, investigative and measurement phases.

Figure 16A:
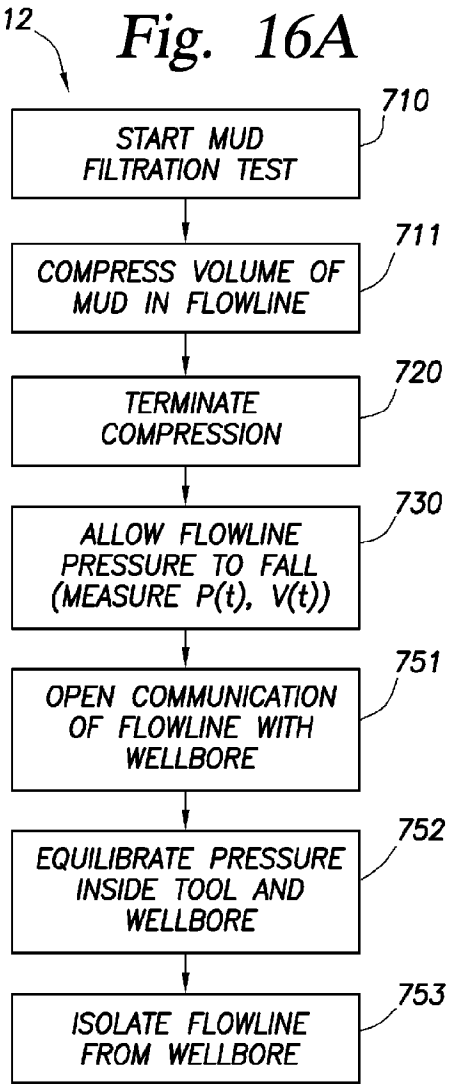

The mud filtration phase 12 is shown in greater detail in FIG. 16A. The mud filtration phase is started at 710, the volume of mud in the flowline is compressed 711 until termination at point 720, and the flowline pressure falls 730. Following the initial compression, communication of the flowline within the wellbore is opened 751, pressures inside the tool and wellbore are equilibrated 752, and the flowline is isolated from the wellbore 753.

Figure 16B:
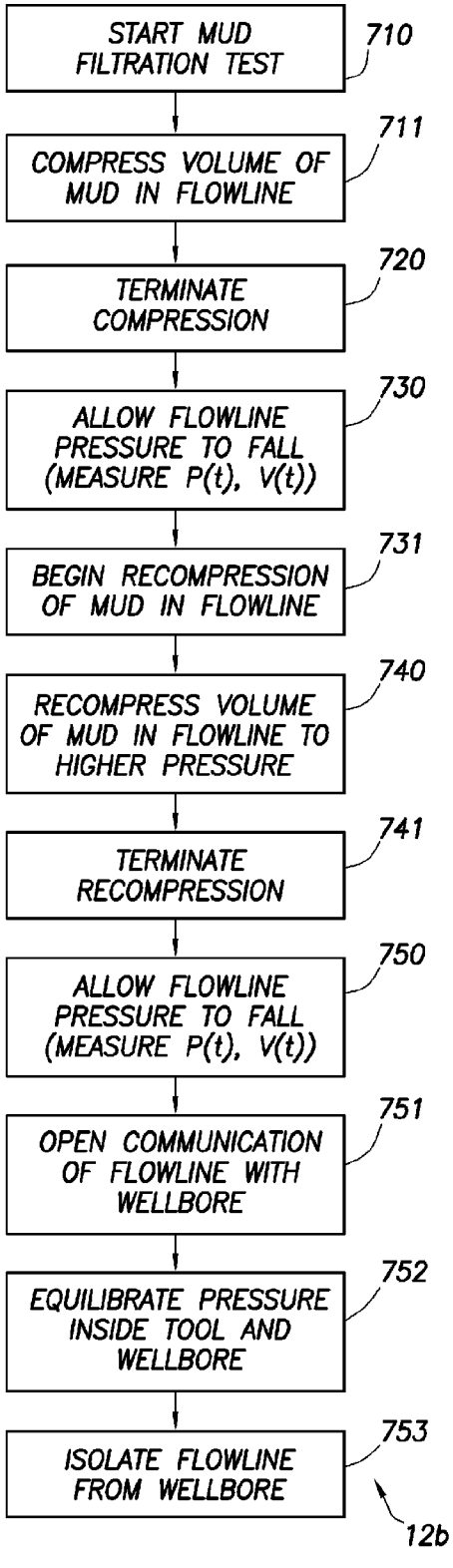

Optionally, as shown in FIG. 16B, a modified mud filtration phase 12*b* may be performed. In the modified mud filtration phase 12*b*, a second compression is performed prior to opening communication of the flowline 751, including the steps of beginning recompression of mud in flowline 731, compressing volume of mud in flowline to higher pressure 740, terminating recompression 741. Flowline pressure is then permitted to fall 750. Steps 751-753 may then be performed as described with respect to FIG. 16A. The pressure trace of FIG. 14A shows the mud filtration phase 12*b* of FIG. 16B.

In another option 12*c*, shown in FIG. 16C, a decompression cycle may be performed following flowline pressure fall 730 of the first compression 711, including the steps of beginning the decompression of mud in the flowline 760, decompressing to a pressure suitably below the wellbore pressure 770, and terminating the decompression 780. Flowline pressure is then permitted to fall 750. Steps 751-753 may then be repeated as previously described with respect to FIG. 16A. The pressure trace of FIG. 14A shows the mud filtration phase 12*c* of FIG. 16C.

Figure 16C:
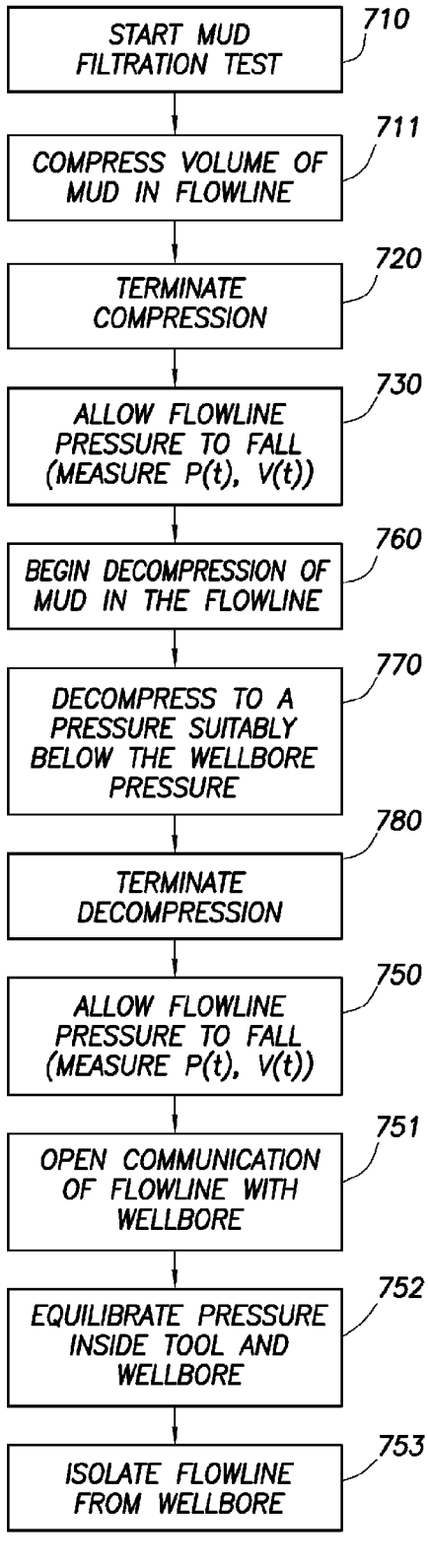

As shown in the pressure trace of FIG. 14A, the mud filtration method 12 of FIG. 16A may be performed with either the mud filtration phase 12*b* of FIG. 16B or the mud filtration phase 12*c* of FIG. 16C. Optionally, one or more of the techniques depicted in FIGS. 16A-C may be performed during the mud filtration phase.

Mud filtration relates to the filtration of the base fluid of the mud through a mudcake deposited on the wellbore wall and the determination of the volumetric rate of the filtration under the existing wellbore conditions. Assuming the mudcake properties remain unchanged during the test, the filtration rate through the mudcake is given by the simple expression:

$$q_f = C_m V_t \dot{p} \tag{22}$$

where $V_t$ is the total volume of the trapped mud ($cm^3$), and $q_f$ represents the mud filtration rate ($cm^3$/sec); $C_m$ represents the mud compressibility (1/psi) (where $C_m$ is determined during the modified mud compressibility test 11*a* or input); $\dot{p}$ represents the rate of pressure decline (psi/sec) as measured during 730 and 750 in FIG. 14. The volume $V_t$ in equation (22) is a representation of the volume of the flowline contained between valves 121*a*, 124*a* and 128*a* as shown in FIG. 4.

For mud cakes which are inefficient in sealing the wellbore wall the rate of mud infiltration can be a significant fraction of the pretest piston rate during flowline decompression of the investigation phase and if not taken into account can lead to error in the point detected as the point of initiation of flow from the formation, 34 FIG. 7. The slope, a, of the fixed slope line used during the flowline decompression phase to detect the point of initiation of flow from the formation, i.e. the point of deviation, 34 FIG. 7, under these circumstances is determined using the following equation:

$$\begin{aligned} p(t) &= p^+ - \frac{q_p - q_f}{V(0)C_m} t \\ &= b - at \end{aligned} \tag{23}$$

where V(0) is the flowline volume at the beginning of the expansion, $C_m$ is the mud compressibility, $q_p$ is the piston decompression rate, $q_f$ is the rate of filtration from the flow line through the mudcake into the formation, and $p^+$ is the apparent pressure at the initiation of the expansion process which, as previously explained, is determined during the process of determining the deviation point 34.

Once the mudcake filtration rate $q_f$ and the mud compressibility $C_m$ have been determined, it is possible to proceed to estimate the formation pressure from the investigation phase 13 under circumstances where filtration through the mudcake is significant.

Preferably embodiments of the invention may be implemented in an automatic manner. In addition, they are applicable to both downhole drilling tools and to a wireline formation tester conveyed downhole by any type of work string, such as drill string, wireline cable, jointed tubing, or coiled tubing. Advantageously, methods of the invention permit downhole drilling tools to perform time-constrained formation testing in a most time efficient manner such that potential problems associated with a stopped drilling tool can be minimized or avoided.

Another embodiment of performing investigation phase measurements will be described with reference to FIGS. 17A, 17B, and 18. Prior to setting the formation tester 805, the mud compressibility is preferably determined as described above (not shown). Subsequent to the determination of the mud compressibility and prior to setting the formation tester, the pressure measured by the tool is the wellbore fluid, or mud hydrostatic, pressure 801. After the tool is set 805, the pretest piston 118*a*, as shown in FIG. 4, is activated 810 to withdraw fluid at a precise and fixed rate to achieve a specified pressure drop 814 in a desired time $t_{pi}$ 815. It is preferred that the desired pressure drop (Δp) be of the same order but less than the expected overbalance at that depth, if the overbalance is approximately known. Overbalance is the difference in pressure between the mud hydrostatic pressure and the formation pressure. Alternatively, the desired pressure drop (Δp) may be some number (e.g., 300 psi) that is larger than the maximum expected value of the "flow initiation pressure" (e.g., 200 psi). Whether the actual formation pressure is within this range is immaterial to the embodiments of the invention. Therefore, the following description assumes that the formation pressure is not within the range.

In accordance with embodiments of the invention, the piston drawdown rate to achieve this limited pressure drop (Δp) may be estimated from $$q_{pi} = -\frac{1}{t_{pi}} C_m V_t \Delta p \tag{24}$$

where $C_m$ is the compressibility of the flowline fluid, which is assumed to be the same as the wellbore fluid; $V_t$ is the volume of the trapped fluid within the flowline 103*a* between the valves 121*a*, 124*a* and 128*a* shown in FIG. 4; Δp is the desired pressure drop and $t_{pi}$ is the duration of the pretest drawdown.

Figure 17A:
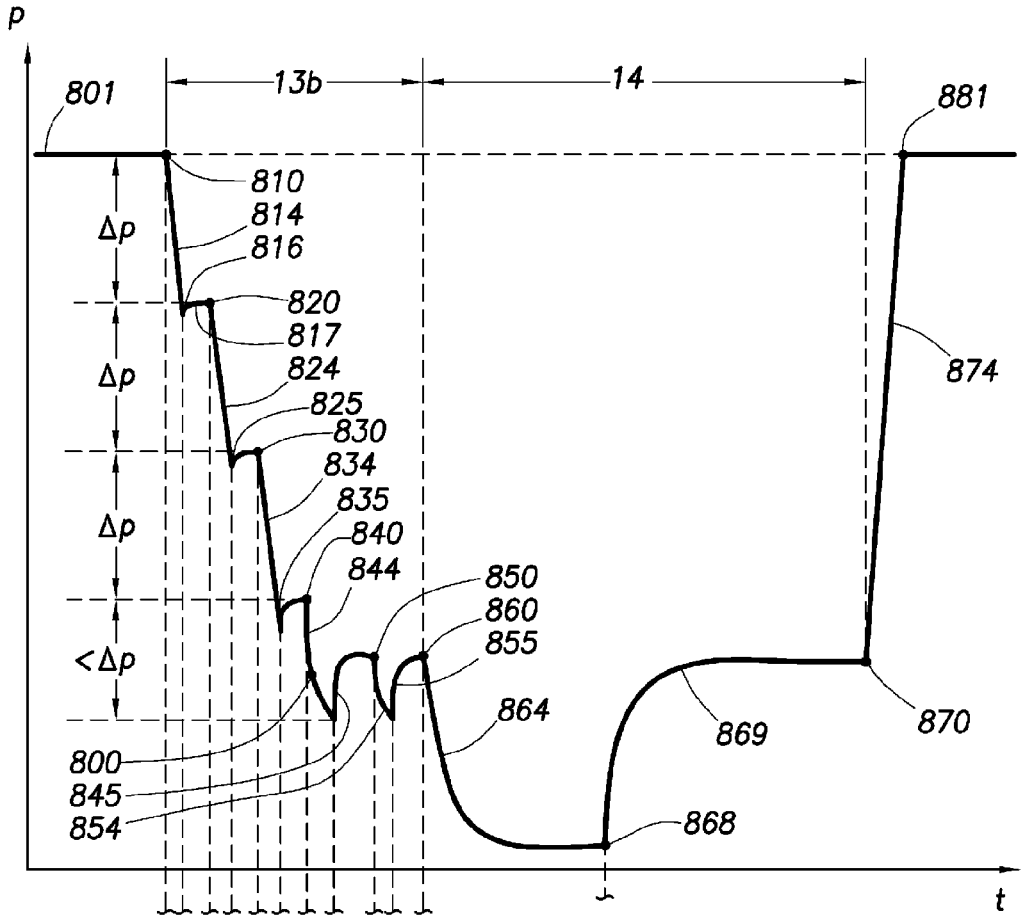
FIG. 17A shows a graphical representation of a pressure measurement versus time plot for performing a pretest including a modified investigation phase in accordance with one embodiment of the invention.
Figure 17B:
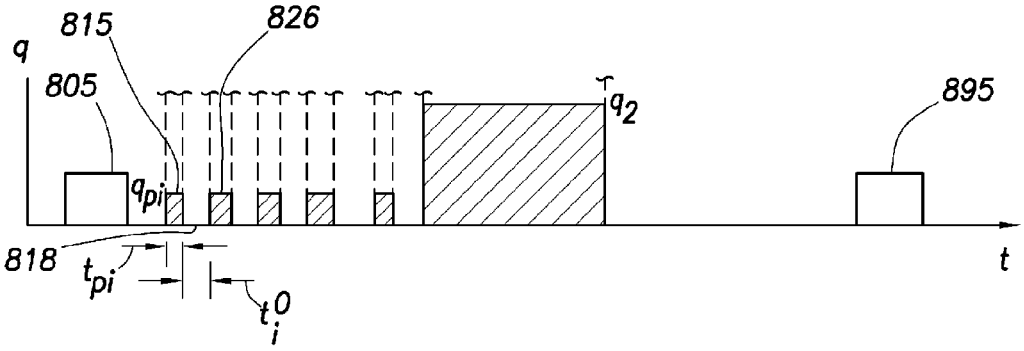
FIG. 17B shows the rate of change of volume corresponding to the graphical representation of FIG. 17A.
Figure 18:
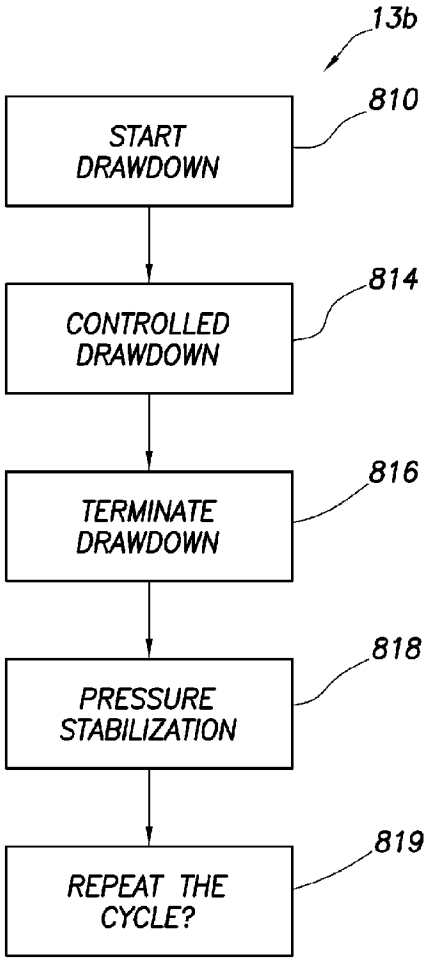
FIG. 18 shows a flow chart detailing the steps involved in performing the modified investigation phase of FIG. 17A.

Referring to FIGS. 17A, 17B, and 18, a method of performing an investigation phase 13*b* in accordance with embodiments of the invention comprises the step of starting the drawdown 810 and performing a controlled drawdown 814. It is preferred that the piston drawdown rate be precisely controlled so that the pressure drop and the rate of pressure change be well controlled. However, it is not necessary to conduct the pretest (piston drawdown) at low rates. When the prescribed incremental pressure drop (Δp) has been reached, the pretest piston is stopped and the drawdown terminated 816. The pressure is then allowed to equilibrate 817 for a period $t_i^o$, 818 which may be longer than the drawdown period $t_{pi}$ 817, for example, $t_i^o = 2\ t_{pi}$. After the pressure has equilibrated, the stabilized pressure at point 820 is compared with the pressure at the start of the drawdown at point 810. At this point, a decision is made as to whether to repeat the cycle, shown as 819 in FIG. 18. The criterion for the decision is whether the equalized pressure (e.g., at point 820) differs from the pressure at the start of the drawdown (e.g., at point 810) by an amount that is substantially consistent with the expected pressure drop (Δp). If so, then this flowline expansion cycle is repeated.

To repeat the flowline expansion cycle, for example, the pretest piston is re-activated and the drawdown cycle is repeated as described, namely, initiation of the pretest 820, drawdown 824 by exactly the same amount (Δp) at substantially the same rate and duration 826 as for the previous cycle, termination of the drawdown 825, and stabilization 830. Again, the pressures at 820 and 830 are compared to decide whether to repeat the cycle. As shown in FIG. 17A, these pressures are significantly different and are substantially consistent with the expected pressure drop (Δp) arising from expansion of the fluid in the flowline. Therefore, the cycle is repeated, 830-834-835-840. The "flowline expansion" cycle is repeated until the difference in consecutive stabilized pressures is substantially smaller than the imposed/prescribed pressure drop (Δp), shown for example in FIG. 17A as 840 and 850.

After the difference in consecutive stabilized pressures is substantially smaller than the imposed/prescribed pressure drop (Δp), the "flowline expansion" cycle may be repeated one more time, shown as 850-854-855-860 in FIG. 17A. If the stabilized pressures at 850 and 860 are in substantial agreement, for example within a small multiple of the gauge repeatability, the larger of the two values is taken as the first estimate of the formation pressure. One of ordinary skill in the art would appreciate that the processes as shown in FIGS. 17A, 17B, and 18 are for illustration only. Embodiments of the invention are not limited by how many flowline expansion cycles are performed. Furthermore, after the difference in consecutive stabilized pressures is substantially smaller than the imposed/prescribed pressure drop (Δp), it is optional to repeat the cycle one or more times.

The point at which the transition from flowline fluid expansion to flow from the formation takes place is identified as 800 in FIG. 17A. If the pressures at 850 and 860 agree at the end of the allotted stabilization time, it may be advantageous to allow the pressure 860 to continue to build and use the procedures described in previous sections (see the description for FIG. 8) to terminate the build up in order to obtain a better first estimate of the formation pressure. The process by which the decision is made to either continue the investigation phase or to perform the measurement phase, 864-868-869, to obtain a final estimate of the formation pressure 870 is described in previous sections. After the measurement phase is completed 870, the probe is disengaged from the wellbore wall and the pressure returns to the wellbore pressure 874 within a time period 895 and reaches stabilization at 881.

Once a first estimate of the formation pressure and the formation mobility are obtained in the investigation phase 13*b* shown in FIGS. 17A and 18, the parameters thus obtained may be used to establish the measurement phase 14 pretest parameters that will produce more accurate formation parameters within the allotted time for the test. The procedures for using the parameters obtained in the investigation phase 13*b* to design the measurement phase 14 pretest parameters have been described in previous sections.

Figure 20:
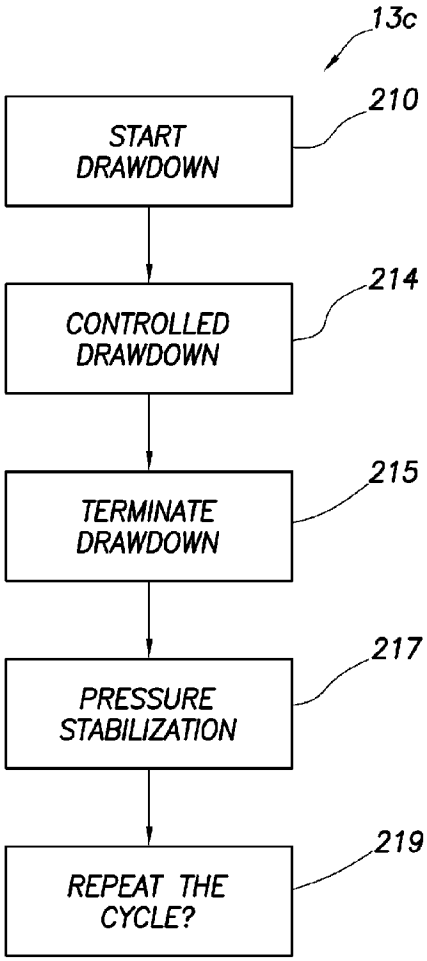
FIG. 20 shows a flow chart detailing the steps involved in performing the modified investigation phase of FIG. 19A.

In the embodiments shown in FIGS. 17A, 17B, and 18, the magnitude of the pressure drop (Δp) during the flowline expansion phase is prescribed. In an alternative embodiment, as shown in FIGS. 19 and 20, the magnitude of the volume increase (ΔV) during the flowline expansion phase is prescribed. In this embodiment, a fixed and precisely regulated volume of fluid (ΔV) is extracted at each step at a controlled rate to produce a pressure drop that may be estimated from:

$$\Delta p = -\frac{1}{C_m V_t}\Delta V = -\frac{1}{C_m V_t} q_i t_{qi} \tag{25}$$

The procedures used in this embodiment are similar to those described for embodiments shown in FIGS. 17A, 17B, and 18. Prior to setting the formation tester, the mud compressibility is preferably determined (not shown). Subsequent to the determination of the mud compressibility and prior to setting the formation tester, the pressure measured by the tool is the wellbore or mud hydrostatic pressure 201.

Figure 19A:
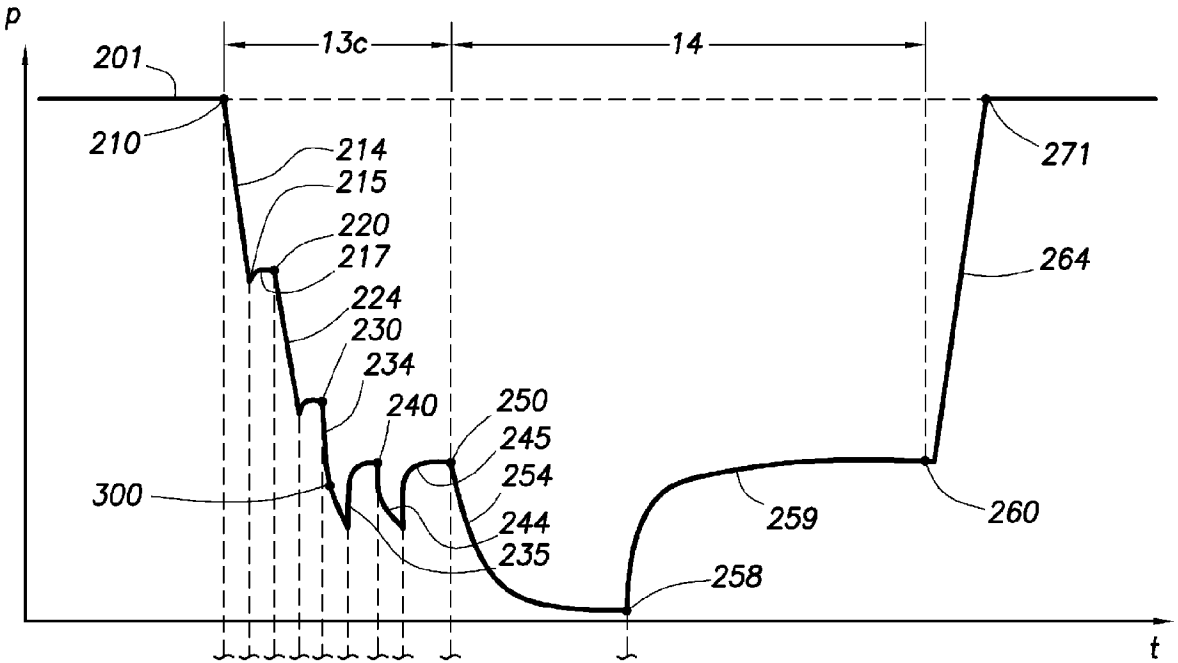
FIG. 19A shows a graphical representation of pressure measurements versus time plot for performing a pretest including a modified investigation phase in accordance with one embodiment of the invention.
Figure 19B:
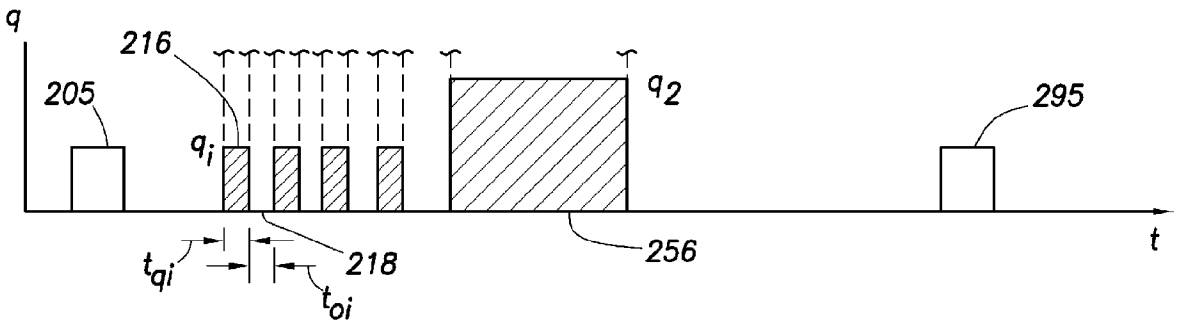
FIG. 19B shows the rate of change of volume corresponding to the graphical representation of FIG. 19A.

Referring to FIGS. 19A, 19B, and 20, after the tool is set 205, the pretest piston 118*a* shown in FIG. 4 is activated. In accordance with one embodiment of the invention, a method for performing an investigation phase 13*c* comprises the steps of starting the drawdown 210, withdrawing fluid at a precise and fixed rate 214 until the volume of the pretest chamber 114*a* is increased by the prescribed amount ΔV. The incremental change in volume of the pretest chamber may be on the order of 0.2 to 1 cubic centimeter, for example. One of ordinary skill in the art would appreciate that the amount of the prescribed volume increase (ΔV), is not limited to these exemplary volumes and should be chosen according to the total volume of the trapped fluid. The resulting expansion of the flowline fluid induces a pressure drop in the flowline.

When the prescribed increment in pretest chamber volume has been achieved, the pretest piston 118*a* is stopped and the drawdown is terminated 215. The pressure in the flowline is then allowed to equilibrate 217 for a period $t_{oi}$ 218 that is longer than the drawdown period $t_{qi}$ 216, for example, $t_{oi}=2\ t_{qi}$. After the pressure has stabilized (shown at point 220 in FIG. 19A), a decision is made as to whether to repeat the "flowline expansion" cycle 219 (shown in FIG. 20). The criterion for making the decision is similar to that described for the embodiments shown in FIGS. 17A and 18. That is, if the pressure after stabilization or equalization (e.g., at point 220) is significantly different from that at the start of the drawdown (e.g., at point 210) and the pressure difference is substantially consistent with the expected pressure drop arising from the expansion of the fluid in the flowline, then the "flowline expansion" cycle is repeated.

To repeat the "flowline expansion" cycle, for example, the pretest piston is re-activated 220, the flowline is expanded by precisely the same volume ΔV 224, and the pressure is allowed to stabilize 230. Again, if the pressures at 220 and 230 are significantly different and are substantially consistent with the expected pressure drop arising from the expansion of the fluid in the flowline, the cycle is repeated, for example 230-234-235-240. The "flowline expansion" cycle is repeated until the difference in consecutive stabilized pressures, e.g., pressures at 230 and 240 as shown in FIG. 19A, is substantially smaller than the expected pressure drop due to the expansion of fluid in the flowline.

After the difference in consecutive stabilized pressures is substantially smaller than the expected pressure drop, the "flowline expansion" cycle may be repeated one more time, shown as 240-244-245-250 in FIG. 19A. If the stabilized pressures at 240 and 250 substantially agree, the larger of the two values is taken to represent the first estimate of the formation pressure. One of ordinary skill in the art would appreciate that the processes as shown in FIGS. 19A, 19B, and 20 are for illustration only. Embodiments of the invention are not limited by how many "flowline expansion" cycles are performed. Furthermore, after the difference in consecutive stabilized pressures is substantially smaller than the expected pressure drop, it is optional to repeat the cycle one or more times.

The point at which the transition from flowline fluid expansion to flow from the formation takes place is identified as 300 in FIG. 19A. If the pressures at 240 and 250 agree to within a selected limit (e.g., a small multiple of the gauge repeatability) at the end of the allotted stabilization time, it may be advantageous to allow the pressure at 250 to continue to build and use the procedure disclosed in the previous section (see FIG. 8) to terminate the build up in order to obtain a better first estimate of the formation pressure. The process by which the decision to continue the investigation phase or whether to execute the measurement phase, 250-258-259-260, to obtain a final estimate of the formation pressure 260 is as described in previous sections. After the measurement phase is completed 260, the probe is disengaged from the wellbore wall and the pressure returns to the wellbore pressure 264 within a time period 295 and reaches stabilization at 271.

Once a first estimate of the formation pressure and the formation mobility are obtained in the investigation phase 13*c*, shown in FIGS. 19A and 20, the parameters thus obtained may be used to establish the measurement phase 14 pretest parameters that will produce more accurate formation parameters within the allotted time for the test. The procedures for using the parameters obtained in the investigation phase 13*c* to design the measurement phase 14 pretest parameters have been described in previous sections.

In a previous section, methods for determining mud compressibility are outlined. The mud compressibility is dependent on its composition and on the temperature and the pressure of the fluid. As a result, the mud compressibility often changes with depth. Therefore, it is desirable to measure the mud compressibility in situ at a location near where the testing is to be performed. If the tool configuration does not allow the mud compressibility to be determined as described above, the in-situ mud compressibility may be estimated by alternate methods as described in the following.

In a method according to embodiments of the invention, the formation tester may be set in casing, for example near the casing shoe, to establish a fluid seal with the casing. A compression and decompression of the well fluid trapped in the tester flowline is performed by means of the pretest piston 118*a* shown in FIG. 4. Procedures for performing the mud compressibility test are described above with reference to FIGS. 11A and 11B. Once the pretest piston rate $q_p$, the rate of pressure change $\dot{p}$ and the trapped volume V are known, the mud compressibility may be estimated from $C_m = -q_p (V\dot{p})$.

In this particular embodiment, the true vertical depth (hence, the temperature and pressure) at which the compressibility measurement is performed may be significantly different from the depth where the formation pressure is to be measured. Because the compressibility of drilling fluids is affected by temperature and pressure, it would be necessary to apply a correction to the compressibility thus measured in order to estimate the compressibility of the drilling mud at the depth where the testing is to be performed.

Figure 21:
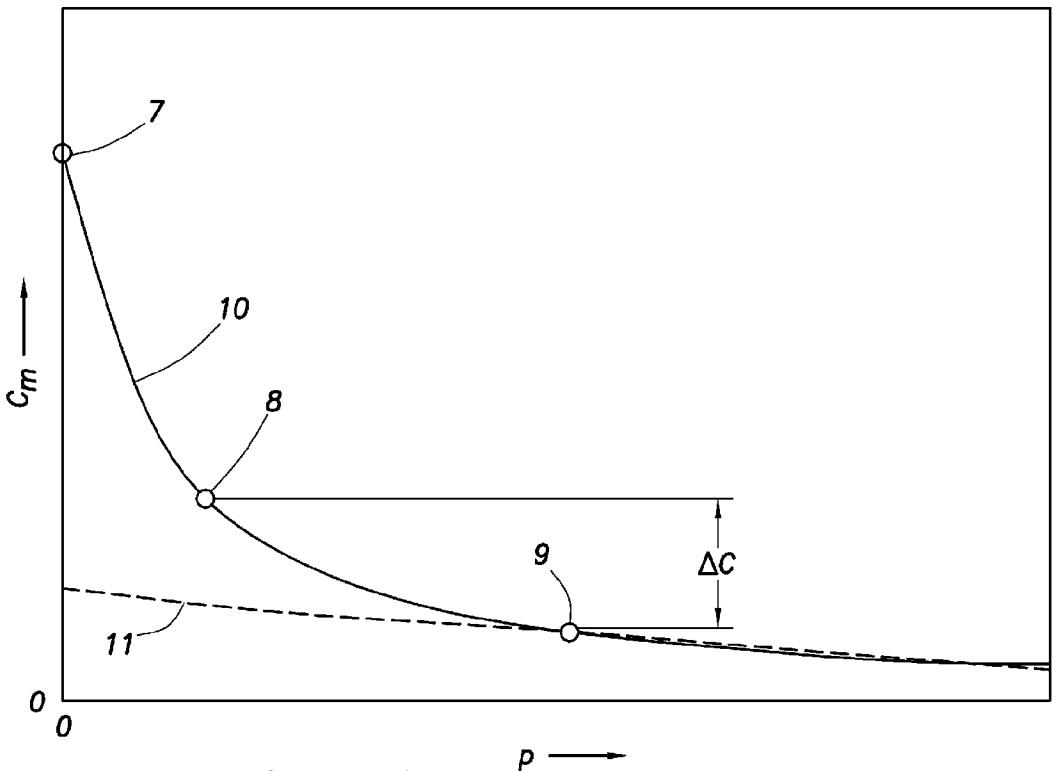
FIG. 21 shows a fluid compressibility correction chart which may be used to provide corrected mud compressibility when the original mud compressibility is performed at a different temperature and/or pressure.

In a method in accordance with the present invention, the wellbore pressure and temperature information are acquired before the measurement begins, e.g., at point 801 as shown in FIG. 17A, using conventional pressure and temperature sensors. Based on known drilling mud properties and in-situ temperature and pressure measurements, charts as shown in FIG. 21 may be constructed for the purpose of conducting temperature and pressure corrections. Alternatively, analytical methods known in the art may be used to compute correction factors which when applied to the original compressibility measurement will provide the in-situ flowline fluid compressibility at the depth at which the formation pressure is to be measured. See e.g., E. Kartstad and B. S. Aadnoy, "*Density Behavior of Drilling Fluids During High Pressure High Temperature Drilling Operations,*" IADC/SPE paper 47806, 1998.

In another method according to embodiments of the invention, the compressibility of a surface-derived (e.g., mud-pit) sample over the range of expected downhole temperature and pressure conditions are measured. An estimate of the in-situ mud compressibility under the downhole conditions may then be estimated from known relationships between the mud density and mud pressure and mud temperature according to methods known in the art. See, e.g., FIG. 21 and E. Kartstad and B. S. Aadnoy, "*Density Behavior of Drilling Fluids During High Pressure High Temperature Drilling Operations,*" IADC/SPE paper 47806, 1998.

FIG. 21 depicts a typical relationship between fluid compressibility ($C_m$) and fluid pressure (p) for oil based and water based muds. Solid line 10 depicts the variation in mud compressibility with wellbore pressure for a typical oil based mud. Dashed line 11 depicts the corresponding variation in mud compressibility for a typical water based mud. The compressibility of the oil based mud at the surface is represented by reference number 7. The compressibility of the oil based mud at the casing shoe is represented by reference number 8. The compressibility of the oil based mud at a given measurement depth below the casing shoe is represented by reference number 9. The compressibility correction ΔC represents the difference between the compressibility of the oil based mud at the casing shoe 8 and that at the measurement depth 9. The compressibility measurement made at the casing shoe 8 may be adjusted by the compressibility correction ΔC to determine the compressibility at the measurement depth 9. As indicated by the dashed line 11, the change in compressibility and corresponding compressibility correction for water based muds may be less significant than the correction depicted by the solid line 10 for oil based muds.

As noted above, mud compressibility under the downhole conditions, either measured directly in situ or extrapolated from other measurements, may be used in embodiments of the invention to improve the accuracy of the estimates of formation properties from the investigation phase and/or measurement phase as shown, for example, in FIG. 11A.

Figure 22:
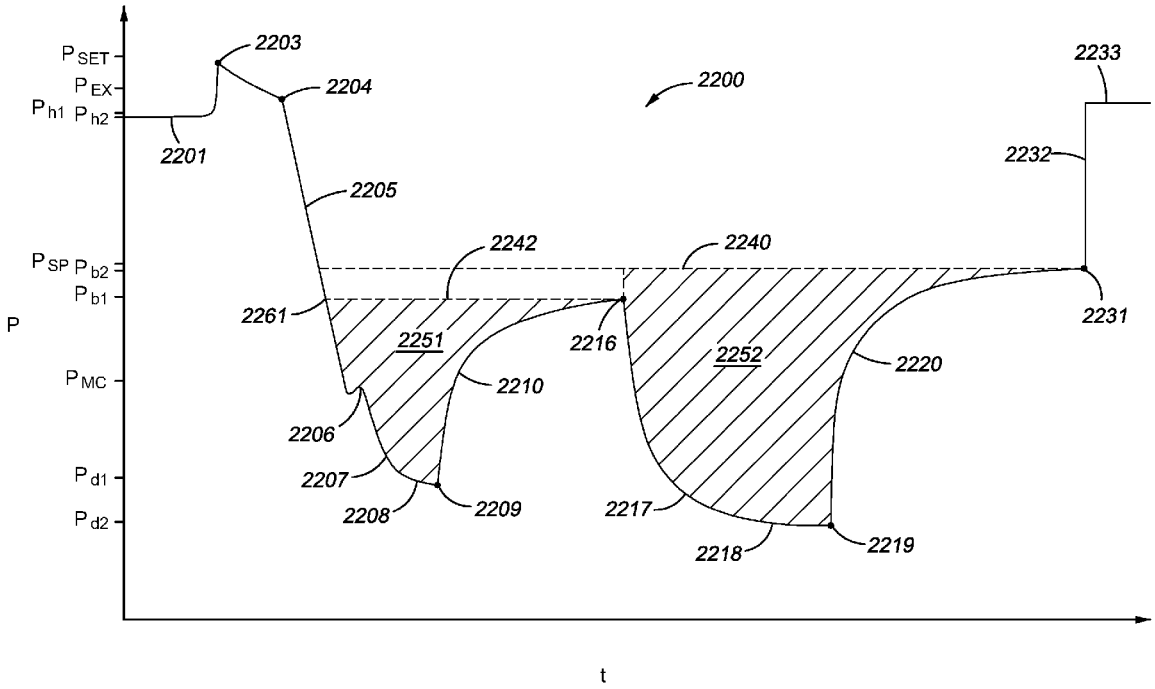
FIG. 22 shows a graphical representation of pressure measurements versus time plot generated by a formation tester.

FIG. 22 depicts a pressure (P) versus time (t) plot 2200 of the pressure taken during a pretest operation. This pressure trace is similar to the pretest depicted in FIG. 5 above, but with greater detail. A general procedure for a pretest will be described with reference to FIG. 22, although it is noted that this description is exemplary, and other procedures may be used without departing from the scope of the invention.

Before the pretest begins, a fluid communication device, such as the probe (112*a* in FIG. 4) is in a retracted position so that the interior of the tool is exposed to the wellbore or hydrostatic pressure ($P_{h1}$), shown at 2201. To perform a pretest, the fluid communication device is pressed against the borehole wall to form a seal and establish fluid communication with the formation. As the probe engages the borehole wall, the fluid communication device is 'set' and pressure in the flowline increases. This pressure increase is caused by the compression of the fluid in the flowline when the probe presses into the mudcake on the borehole wall. This 'setting' action has a set pressure ($P_{set}$) and is shown in FIG. 22 at 2203. As depicted, the set pressure ($P_{set}$) may be higher than the wellbore pressure ($P_{h1}$), at 2201, although this may not always be the case. The relative position of the set pressure ($P_{set}$) with respect to the hydrostatic pressure ($P_{h1}$) is immaterial to the applicability of the description below.

In FIG. 22, point 2204 marks the beginning of the drawdown phase 2205 of the investigation phase. This is called the expansion pressure ($P_{ex}$), because it is the pressure measured just before the expansion phase begins. The point 2204 may be above the wellbore pressure ($P_{h1}$), or it may fall back down to, or even below, the wellbore pressure ($P_{h1}$) after the tool is set.

In the drawdown phase, a pretest piston (e.g., 118*a* in FIG. 4) located inside the tool and connected to the flowline (e.g., 119*a* in FIG. 4) is displaced so that the volume of the flowline is increased. In this case, the increase occurs at a steady and known rate, but may be varied if desired. As the volume is increased and the drawdown in performed, the pressure in the flowline drops. This 'drawdown phase' 2205 extends from 2204 to the termination of drawdown at drawdown pressure 2209.

At some point during the first drawdown, it is expected that the mudcake (4 in FIG. 1) on the borehole wall isolated within the probe of the tool will break, which will enable fluid from the formation to flow into the probe flowline. When the mudcake breaks, and if the formation has sufficient mobility, the pressure in the flowline may experience a slight rise, shown at 2206. Typically, this occurs at a pressure that is lower than the stabilized sandface pressure ($P_{sf}$) 2240, which is usually unknown to the operator at the time the mudcake breaks. Thus, the pressure ($P_{MC}$) 2206 at which the mudcake breaks provides an initial indication of the range in which the stabilized sandface pressure ($P_{sf}$) 2240, and ultimately the formation pressure ($P_f$ or P*), lies.

Once the mudcake breaks 2206, the drawdown continues 2207 until the pressure in the flowline reaches a drawdown pressure ($P_{d1}$) at 2209. It is noted that most of the drawdown phase (i.e., 2205, 2207), with the exception of the mudcake breach 2206, is very close to a linear drop in pressure as described with respect to FIG. 7 above. Near the end of the drawdown phase 2208, the pressure trend becomes non-linear. This is because fluid is flowing into the tool from the formation, and the flowrate of fluid from the formation begins to match the volume rate of change imposed by the motion of the piston.

The lowest pressure during the drawdown, referred to as the 'drawdown phase' 2205, is called the "drawdown pressure" ($P_{d1}$) 2209. There are several methods for determining when the drawdown will be stopped. Some examples of techniques for determining termination of the drawdown are described with respect to FIG. 7 above.

One technique that may be used to select the drawdown pressure ($P_{d1}$) 2209 is based on the pressure at which the mudcake breaks ($P_{MC}$) 2206, if that is detected. For example, if the mudcake break is detected, the drawdown pressure ($P_{d1}$) 2209 may be set at a given or 'pre-selected' value below the mudcake pressure ($P_{MC}$) 2206.

In other cases, the drawdown pressure ($P_{d1}$) 2209 is not specifically selected at all. Instead, the drawdown phase is terminated, for example, based on the change in the effective volume of the probe flowline after the mudcake breaks 2206. For example, the drawdown phase may be defined by moving a piston to displace a selected volume after the mudcake breaks 2206. In those cases where the mudcake break 2206 is not detected, the drawdown phase may be terminated based on the total volume of fluid that is displaced by moving the piston. Thus, a fixed rate and a total volume may be specified. The drawdown phase will continue with the piston moving at the fixed rate until the specified total volume is reached. At that point, the piston is stopped, and the drawdown pressure ($P_{d1}$) 2209 will depend on the ability of the formation to deliver fluid and the operational parameter selected for the pretest.

Once the drawdown pressure ($P_{d1}$) is reached 2209, the piston in the tool stops moving, and pressure sensors in the tool monitor the pressure buildup that results from the formation fluid flowing into the tool. This pressure buildup, or buildup phase 2210, extends from the drawdown pressure 2209 until a final buildup 2216 is reached. During the buildup phase 2210, the pressure builds asymptotically towards the stabilized sandface pressure ($P_{sf}$) at dashed line 2240. It is noted that the final buildup pressure ($P_{b1}$) 2216 at the end of the first buildup phase 2210 is depicted as being less than the stabilized sandface pressure ($P_{sf}$) 2240, but it could be greater. The buildup phase 2210 may be terminated before the pressure completely stabilizes, for example when only a short duration is allotted for the pretest.

As shown in FIG. 22, two sequential pretests are performed. The first pretest, referred to as the 'investigation phase,' as just described, spans the pressure curve in FIG. 22 from 2204 to 2216. The investigation phase may be similar to the pretest as described, for example, with respect to FIG. 2 above. A second pretest or "measurement phase" may be performed after the first pretest or investigation phase as described above. Additional pretests may be performed as desired.

The second pretest or 'measurement phase' extends from 2216 to 2231 in FIG. 22. As described above, the duration of the phases may be limited and the termination points of these phases may be set based on criteria. Typically, the investigation phase is shorter in duration compared to the measurement phase(s) and is often used to provide estimates of the formation parameters and/or to design criteria for conducting the measurement phase. The measurement phase may be specifically tailored to achieve pretest objectives based on the results derived from the investigation phase. It is typically longer in duration than the investigation phase and may provide more accurate results.

As discussed above with respect to FIG. 7, the pretests may be used to generate an estimate of the formation pressure ($P_f$) and an estimate of the "mobility" of the fluid in the formation. Mobility describes how easily the formation fluid will flow in the formation. This may be useful in evaluating the economic viability of producing hydrocarbons from the well. The mobility is defined as the permeability of the formation divided by the viscosity of the fluid in the formation. Thus, mobility M, is defined as $M=K/\mu$, where K is the formation permeability and $\mu$ is the viscosity of the formation fluid.

As described previously with respect to FIG. 7, an estimate of the mobility of a formation can be determined from the area below a line running horizontally through the final buildup pressure and above the drawdown and buildup curves (as depicted by reference number 325 in FIG. 7). For example, in FIG. 22, the area 2251 below the horizontal line 2242 through the first buildup pressure ($P_{b1}$) 2216, and above at least a portion of the drawdown 2205 and buildup 2210 curves is an indicator of the mobility. For example, the mobility $(K/\mu)_1$ may be estimated using equation (1) above and where $V_1$ is the variation of the pretest chamber volume between the point of intersection of the line 2242 and the line 2205 (e.g., 2261 in FIG. 22) and the end of the buildup phase (e.g., 2216 in FIG. 22) and A is the area under the curve (e.g., area 2251 in FIG. 22).

FIG. 22 also shows the pressure curve for a measurement phase, between points 2216 and 2231. The measurement phase shown in FIG. 22 is similar to the investigation phase (2204-2216), except that the measurement phase may, but not necessarily, have a larger pressure drop and usually has a longer time for the buildup phase. The criteria for performing the measurement phase may be designed based on the results of the investigation phase as described previously herein.

The second drawdown starts at point 2216 in FIG. 22 and continues until the pressure reaches the second drawdown pressure ($P_{d2}$) 2219. Similarly to the late part 2208 of the first drawdown, the late part 2218 of the second drawdown 2217 exhibits non-linearity. As with the first drawdown phase 2205, the second drawdown 2217 may be terminated by any method known in the art. For example, the second drawdown phase 2217 may be stopped after a preselected volume of expansion. Also, the second drawdown 2217 may be terminated once a preselected pressure, the second drawdown pressure ($P_{d2}$), has been reached. The second drawdown pressure ($P_{d2}$) 2219 may be selected based on information already known about the well and formation, from information derived from a previous pretest, or from tests performed in a pilot well, or using any criteria described above.

Alternatively, the second drawdown 2217 may be terminated based on information gained during the investigation phase as described above. For example, the volumetric rate and the total volume selected for the second drawdown 2217 may be selected based on the pressure data obtained during the investigation phase 2204-2216. In another example, the second drawdown pressure 2219 may be specifically selected based on the analysis of the pressure data obtained in the investigation phase 2204-2216. The method for terminating the first and second drawdown phases are not intended to limit the invention.

The second drawdown 2217 may be caused by moving a piston to expand the volume in the flowline in the tool. Preferably, the piston used for the measurement phase is the same piston that is used for the investigation phase, although another piston may be used. Additionally, other methods for lowering the pressure may be used, as are known in the art. The method for performing a drawdown is not intended to limit the invention.

Following termination of the drawdown phase 2217 at point 2219, the piston may be stopped, and the pressure in the flowline allowed to increase. This is the second buildup phase 2220. Preferably, the second buildup phase 2220 is longer in duration than the first buildup phase 2210, when multiple pretests are performed. The pressure in the second buildup phase 2220 builds up to the second buildup pressure ($P_{b2}$) 2231. This second buildup pressure may be used as a second indicator of the stabilized sandface pressure ($P_{sf}$) 2240.

As with the investigation phase, the area 2252 on the graph of the measurement phase that lies under the second buildup pressure ($P_{b2}$) 2231 and above the second drawdown phase 2217 and the second buildup phase 2220 may be used as an indicator of the mobility of the fluid in the formation. The value of the area 2252 together with the variation of the pretest chamber volume between the point 2216 and the point 2231 may be used to estimate the mobility. For example, Equation (1), above, may be used to estimate the mobility of the fluid in the formation. Alternatively, any other method known in the art may be used to determine the mobility.

Following the measurement phase (i.e., after termination of the second buildup phase 2220 at 2231), the pretest piston is typically partially extended, the equalization valve opened and the fluid communication device is retracted from the borehole wall. The flowline is then again exposed to the wellbore pressure. The pressure in the flowline rises (at 2232) to the wellbore pressure ($P_{h2}$) 2233.

In most cases, the wellbore pressure measured at the beginning of the pretest ($P_{h1}$ at 2201) is similar to or the same as the wellbore pressure ($P_{h2}$ at 2233) measured at the end of the pretest. It is noted that there may be differences depending on a number of circumstances. For example, changes in the temperature may affect the pressure measurement. Additionally, if the pretest is performed while drilling, the hydrodynamic pressure in the borehole may fluctuate if the pretest is performed while the mud pumps are running. Other factors may affect the wellbore pressure measurements ($P_{h1}$, $P_{h2}$).

It is noted that when performing a pretest during drilling operations, it may be desirable to do so with the mud pumps running, even though the mud flow may cause noise and fluctuations in the wellbore pressure. The mud pumps provide a flow of mud through the drill string, which allows the use of mud-pulse telemetry. Thus, by leaving the mud pumps on while performing a pretest, at least some level of communication with the surface may be accomplished.

In operation according to aspects of the present invention, data compression techniques are utilized to fill a predetermined communication channel capacity, such as the bandwidth available for data transmission in the aforementioned mud-pulse telemetry channel, with data to be communicated, such as the aforementioned pretest data, etc. Using such data compression techniques, robust uphole communication of test data, such as pressure verses time data derived from a formation pressure while drilling test, may be provided in real-time or near real-time, even where the data communication channel is severely bandwidth limited such as due to a low data rate and/or the bandwidth is consumed by transmission of other/additional data. For example, using data compression techniques of the present invention, data of the pretest described above with respect to FIG. 22 sufficient to accurately represent the plot illustrated in the figure may be communicated to the surface in real-time or near real-time.

The communication of robust data may be utilized to facilitate analysis and/or control of the drilling operation without requiring removal of the formation testing tool, and thus the drill string, and/or to allow drilling operations to be continued and/or modified rapidly in light of the information derived from the results of a pretest, etc. Of course, the present invention is not limited to communication only of the aforementioned pretest pressure data or even just pretest data. For example, the present method may be used to communicate, among others, pretest pressure derivative data, pretest motor speeds and volumes, volumes of fluid pumped during a sampling operation, optical densities from a fluid spectrometer, fluid densities and/or viscosities of a sampled stream, and information concerning the operation of the tool such as the retract and setline pressures or the information concerning the internal state of the tool, if desired. Where the formation testing tool is not adapted to autonomously utilize the investigation phase data to configure a measurement phase test, data compression techniques of the present invention may be utilized to communicate data of the investigation phase, sufficient to accurately represent the plot illustrated in FIG. 22, to the surface in real-time or near real-time. This data may be analyzed at the surface for configuring the measurement phase of the pretest within a limited time allotted for drilling operation stoppage for conducting the pretest. In those cases where the pressure test is conducted with mud circulation pumps off, in which case there is no communication between the tool and surface during the performance of the test, the methods described herein may be used to great advantage. By utilizing these methods, an accurate representation of the data acquired by the tool during such pumps off tests may be efficiently transmitted to surface after the fact allowing timely decisions to be made regarding the operation of the tool and the state of the well. Although the foregoing examples referenced uphole transmission of data, it should be appreciated that the concepts of the present invention may be applied with respect to downhole or other data communications.

Figure 23:
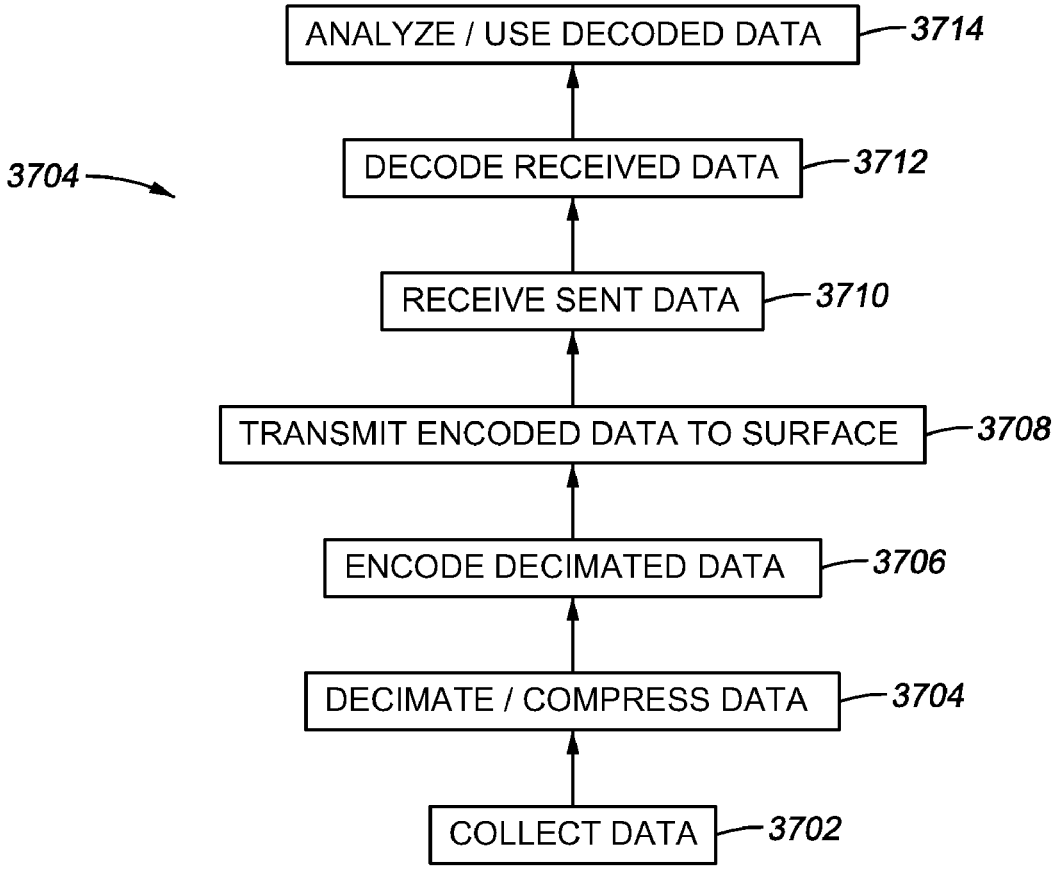
FIG. 23 is a high level flow diagram of operation providing data compression and communication in accordance with the concepts of the present invention.

Directing attention to FIG. 23, a high level flow diagram of operations providing data compression and communication in accordance with the concepts of the present invention is shown. As shown in the flow diagram of FIG. 23, at step 3702 data is collected, such as may be comprised of the aforementioned pretest data. For example, a formation testing tool may perform one or more measurements, as described above, to provide desired data.

Thereafter, at step 3704, all or a selected portion of the collected data, e.g., the data representing a portion of interest with respect to a test procedure, is decimated/compressed, preferably using techniques described more fully below. It should be appreciated that "decimation" is used herein in its broadest meaning to include reducing the number of samples in signal discrete series or data streams, and is not intended to be limited to tenths ("deci") of the whole.

In providing data decimation/compression at step 3704, event data points are preferably identified within test data for communication via the data communication channel. A data decimator preferably utilizes these event data points to identify additional data points within the collected data, such as particular data points disposed on a curve between event data points, for communication via the data communication channel. Preferably, the additional data points are selected to cause the event data points, the additional data points, and any overhead data utilized with respect to communication of the collected data to fill as nearly as possible all available bandwidth in the communication channel. The bandwidth in the communication channel filled according to aspects of the invention may be the entire bandwidth of the communication channel or some portion of the channel bandwidth which is not otherwise utilized, reserved, or unavailable for the foregoing data communication.

At step 3706 the decimated/compressed data is encoded for transmission within the communication channel. Encoding the data may comprise packetizing or quantizing and assigning bits to the data, processing the data to provide error detection and/or correction, encapsulating the data within an appropriate transport container, etc. Moreover, encoding the data as provided at step 3706 may include appending the decimated/compressed data to, or interleaving the decimated/compressed data with, other data which is to be communicated via the communication channel.

The encoded data is transmitted using the communication channel at step 3708. Transmission at step 3708 may include modulation of a carrier wave or other well known techniques for placing data on a medium for transmission. In a preferred configuration, the encoded data is modulated as pulses for transmission via a mud pulse telemetry communication channel.

At step 3710 the encoded data is received by a system in communication with the communication channel. For example, where a formation testing tool has performed a test from which the data has been collected, a surface system, such as an up-hole receiver coupled to the communication channel, may receive the data. Reception at step 3710 may include demodulation of a carrier channel or other well known techniques for extracting data from a transmission medium. In a preferred configuration, the received data is demodulated from pulses of a mud pulse telemetry communication channel.

The received data is decoded at step 3712. Decoding the data may comprise depacketizing or dequantization and reconstruction of the data, processing the data to detect and/or correct errors, unwrapping or decapsulating the data from within a transport container, etc. Moreover, decoding the data as provided at step 3712 may include separating desired data from other data which has been communicated via the communication channel. Decoding the data at step 3712 may additionally or alternatively include applying one or more inverse functions to data compressed using a particular function, such as discussed with respect to FIG. 30 below. In addition, decoding the data may comprise applying the inverse of a "growth" function applied by a data decimator as described below. Application of such an inverse function may utilize information regarding the function applied to the data which is communicated through the communication channel or may be independently determined, such as through employing the same algorithms used to determine a function to be applied by system transmitting the data.

At step 3714 the decoded or reconstructed data is analyzed and/or used. The decoded data is usually added to a well log. A well log may take the form of a display on a screen located on the rig, for example the rig 2 in FIG. 1A. A well log may also take the form of a printed document or of an electronic record, stored in any known storage means known in the art. For example, where a formation testing tool has performed a test from which the data has been collected, a surface system, such as a computer or terminal, may process the data to provide information to a well engineer or other operator with respect to continued drilling operations, performing additional tests, completing tests, etc. Alternatively or additionally the information may be stored and used later, for example, to determine a reservoir model, asses the profitability of the reservoir, select exploitation equipment or for other applications known in the art.

Figure 24:
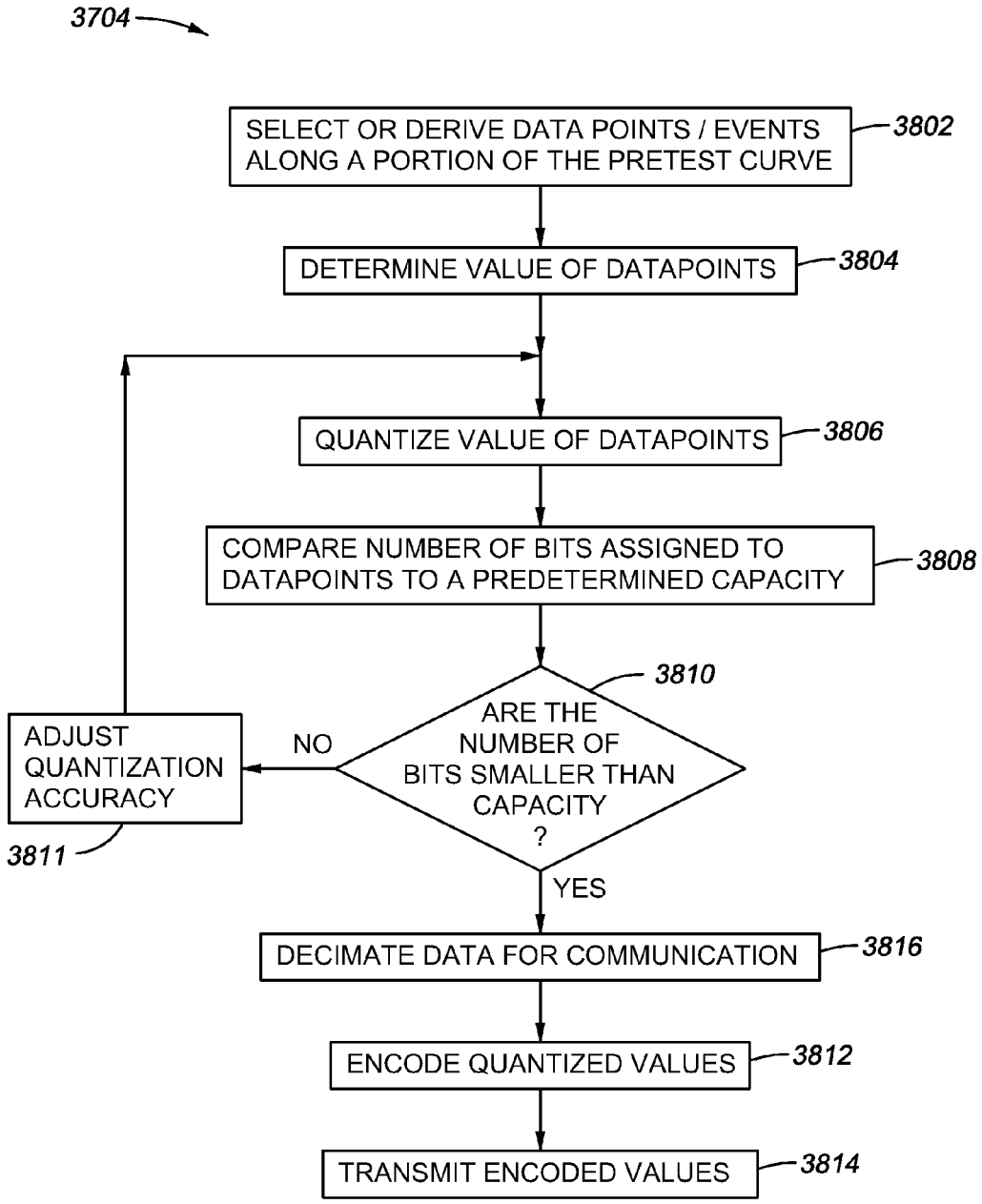
FIG. 24 provides detail with respect to a configuration of the decimate/compress data step of FIG. 23.
Figure 25:
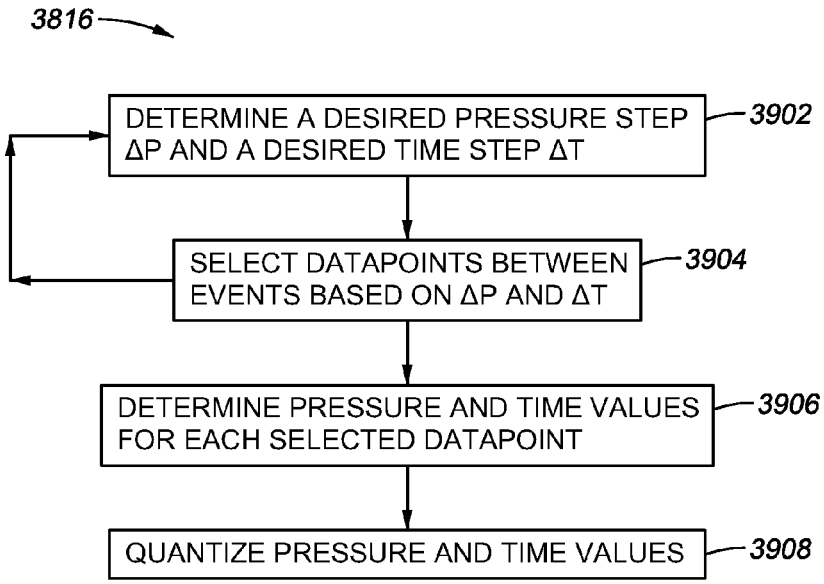
FIG. 25 is a flow diagram of operation providing data decimation for compression of data to be communicated according to one configuration of a method employing concepts of the present invention.
Figure 26:
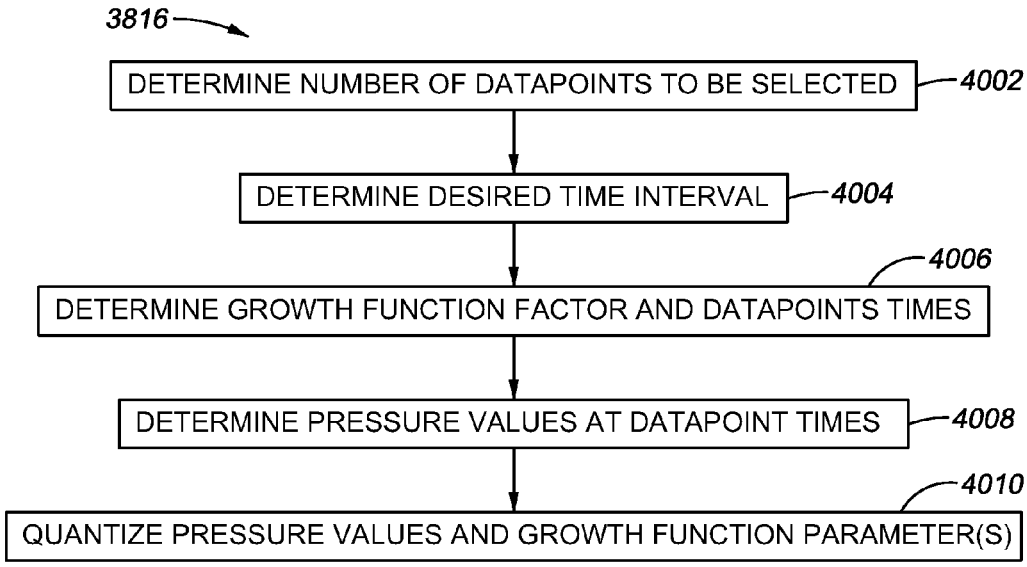
FIG. 26 is a flow diagram of operation providing data decimation for compression of data to be communicated according to another configuration of a method employing concepts of the present invention.

Having described generally operations providing data compression and communication in accordance with the concepts of the present invention as illustrated in FIG. 23, attention is directed to FIGS. 24-26 wherein further detail with respect to preferred data compression techniques is provided. Specifically, the flow diagram of FIG. 24 provides detail with respect to a preferred configuration of the decimate/compress data step 3704 of FIG. 23. Similarly, the flow diagrams of FIGS. 25 and 26 provide details with respect to various configurations of the decimate data for communication step 3816 of FIG. 24.

To better aid the reader in understanding the concepts of the present invention, operation of the invention as represented by the flow diagrams of FIGS. 24-26 will be described herein with reference to formation pretest data to thereby provide a more tangible exemplary configuration. It should be appreciated, however, that the present invention is not limited to use with the exemplary data referenced herein.

Referring now to FIG. 24, the flow diagram therein begins at step 3802 wherein event data points are selected or derived for communication. Referring to the pretest data shown in FIG. 22, it can be seen that particular events are represented therein. For example, the data of the measurement phase of the pretest includes data points associated with particular events experienced during or in association with the pretest. In particular data point 2216 represents a drawdown start event, data point 2219 represents a drawdown pressure reached event, and data point 2231 represents a buildup pressure approximated event. Other events which may be of interest with respect to a well pretest include, identification of the wellbore pressure before the test 2201, tool set event 2203, beginning of a pretest investigation phase/beginning of flowline expansion 2204, mudcake breach detection 2206, termination of the investigation drawdown 2209, investigation buildup pressure approximated/ending of a pretest investigation phase/beginning of a pretest measurement phase 2216, termination of the measurement phase drawdown 2219, measurement phase buildup pressure approximated/ending of a pretest measurement phase/a final formation pressure is reached 2231, and the wellbore pressure after the test is conducted 2233. These events may not be present in all tests, for example a lost seal or a dry test etc. These and other events may be readily detectable (e.g., a particular testing operation is commenced or terminated, such as the pretest piston is engaged, a motor is activated, a particular motor speed is attained, a tool is engaged, a tool is disengaged, etc.) or relatively easily identified within the data stream (e.g., reversal or fast change of a trend, a peak or valley in one or more measured parameters, a steady state in one or more measured parameters reached, a timeout is reached, etc.).

Various event data points may be considered as being of particular interest with respect to the pretest performed, or otherwise may represent data of particular interest within the data stream. For example, the aforementioned event data points may define intervals of values or portions of data for compression, and/or real-time communication. Accordingly, step 3802 of FIG. 24 preferably operates to select or derive one or more of these events, event points or data points for inclusion in the compressed communication used to represent the full data stream (e.g., the entire pretest or the pretest measurement phase portion of the curve shown in FIG. 22).

At step 3804 the value or values associated with the aforementioned event points are determined. For example, where the event data points represent a pressure at a particular time, the pressure and time values for each selected event data point may be determined for transmission. In another example, acquired data are extrapolated between or beyond sampled times to precisely determine values at a change of trend or asymptotic values. In yet another example, values at the selected data points are determined by "smoothing" the collected data or trends in the collected data, for example as further detailed below with respect to FIGS. 31-33B.

In operation as illustrated in FIG. 24, the values for each selected event data point are quantized for communication via the communication channel at step 3806. For example, the values of each event data point may be quantized for encoding prior to transmission. Non-uniform quantization of data may be provided, if desired. For example, it may be advantageous to use one quantization accuracy to quantize values of data points located in an interval and another quantization accuracy to quantize values of data points located in another interval or intervals. A compander may be utilized to change the quantization accuracy used to quantize the values of each event data points depending on a desired accuracy level. Details concerning a compander configuration which may be utilized according to the concepts of the present invention are discussed below.

The number of bits allocated for the decimated data point values resulting from quantizing the data may be based upon the desired accuracy. For example, where the data points represent pressure and time information, the number of bits provided by the aforementioned quantizing may be calculated according to the following rule:

$$n\text{bits}_{time}=\lceil \log_2(t_{max}/t_{acc})\rceil \tag{43}$$

$$n\text{bits}_{press}=\lceil \log_2(P_{max}/P_{acc})\rceil \tag{45}$$

where $\lceil x \rceil$ denotes the smallest integer larger than x, $t_{acc}$ and $P_{acc}$ are, respectively, the desired time and pressure accuracies, $\text{nbits}_{time}$ and $\text{nbits}_{press}$ are, respectively, the number of bits allocated for decimated time and pressure, and $t_{max}$ and $P_{max}$ are, respectively, the maximum pressure value and the maximum time value.

At step 3808 the data identified for communication, e.g., the event point data and any overhead data associated with the transmission thereof, is analyzed with respect to a predetermined channel capacity, e.g., the bandwidth available in the communication channel for communication of the pretest data, to determine if additional pretest data may be communicated within the communication channel. For example, a mud pulse telemetry communication channel may provide from approximately 0.5 bits per second to approximately 12 bits per second, depending upon various factors. The maximum bit rate achievable with respect to any particular well using mud pulse telemetry is determinable, such as through empirical evaluation. The period in which data communication is to be accomplished is similarly determinable. For example, drilling operations may be interrupted for a maximum period, such as 15 minutes, and a pretest operation from which the data to be communicated is captured may require 10 minutes, leaving approximately 5 minutes for data communication (ignoring for this example that data communication may be accomplished during the pretest operations) if it is desired to complete the pretest operations and all associated communications prior to drilling operations resuming. Alternatively, the transmission of data can take place simultaneously with the resumption of drilling, if necessary. Assuming in this example that the mud pulse telemetry communication channel supports 1 bit per second and that no other data is being communicated through the channel at this time, a bandwidth capacity of 300 bits is available for communication of the pretest data (assuming a 5 minute transmission time). Operation at step 3808 preferably compares the number of bits from the quantized values of the selected event data points, and any overhead bits associated therewith (e.g., packet headers, error detection/correction bits, etc.), to the available bandwidth capacity to determine if capacity remains for communication of additional data.

A determination is preferably made at step 3810 with respect to whether the amount of data associated with communication of the selected event data points, and any other data currently selected for communication, is less than the capacity available in the communication channel for such communications. If there is additional capacity available in the communication channel (or if there is additional capacity beyond a minimum threshold amount sufficient to allow additional data to be communicated), processing proceeds according to the illustrated flow diagram to step 3816 wherein additional pretest data is preferably selected for communication. Detail with respect to various data decimation techniques which may be utilized for selecting such additional data is provided in the discussions of FIGS. 39 and 40 below.

If, however, additional capacity is not available in the communication channel (or if there is insufficient capacity to allow additional data to be communicated), processing may proceed according to the illustrated flow diagram to steps 3811, wherein the quantization accuracy is adjusted. For example, the resolution of the values may be altered to obtain a smaller number of bits assigned to the data points and/or the number data points may be reduced until sufficient bandwidth is achieved.

At step 3812 of the illustrated configuration the data selected for communication, e.g., the selected event data points and selected additional data points, is encoded. Operation with respect to step 3812 preferably corresponds to step 3706 discussed above with respect to FIG. 23. At step 3814 of the illustrated configuration the encoded data is transmitted.

Operation with respect to step 3814 preferably corresponds to step 3708 discussed above with respect to FIG. 23.

Referring now to FIG. 25, a flow diagram of operations providing data decimation for compression of data to be communicated according to one configuration of a method employing concepts of the present invention is shown. It should be appreciated that the steps of the flow diagram set forth in FIG. 25 may be performed as part of the decimate data for communication step 3816 shown in FIG. 24.

The data decimator utilized in implementing the flow diagram shown in FIG. 25 operates to optimize the particular data selected for communication and/or the amount of data communicated through the use of one or more variables for selecting data for communication. The variables for selecting data for communication shown in FIG. 25 are change in pressure ($\Delta P$) and change in time ($\Delta T$), consistent with the example wherein the pretest data points are pressure verses time. Of course, other variables may be utilized in selecting data for communication as a compressed data set according to the concepts of the present invention.

At step 3902, values of $\Delta P$ and $\Delta T$ are selected. The values of these variables may be selected by any of a number of techniques. For example, step values associated with a highest resolution of the data (e.g., corresponding to a sampling rate used in acquiring test data) may be selected for these variables initially because such a selection would provide maximum information. Alternatively, step values considered likely to result in selection of data points sufficient to fill the capacity of the communication channel may be selected initially for these variables. Step values considered likely to result in selection of data points less than that needed to fill the capacity of the communication channel may be selected initially for these variables such that an iterative process may be used to increase the number of selected data points to substantially fill the capacity of the communication channel. In other words, the iterative process may include selecting, identifying, and determining data points to converge on a selection of candidate data points. Such step values may be selected using historical information, modeling, statistical analysis, etc. A particularly advantageous initial choice for the pressure step value is to choose an integer multiple, such as four or greater, of the pressure channel noise, the pressure noise being determined directly from the pressure trace being compressed by methods well known in signal processing.

In an optimization of $\Delta P$ and/or $\Delta T$, the pressure and/or time steps may be determined by a discrete optimization algorithm which automatically adjusts the pressure and/or time step sizes to achieve the specified target of number of bits representing the pretest pressure-time trace to be communicated.

Data points within the data stream to be compressed according to the present invention are selected at step 3904. In the configuration of FIG. 25, data points which are analyzed for selection are data points lying on a curve a step value (here $\Delta P$ or $\Delta T$) from a reference point (here an event data point). Preferably, data points which are analyzed for selection are data points on the curve between two selected event data points, such as event data points selected at step 3802 of FIG. 24. Accordingly, a segment of the data set curve bounded by the two selected event data points may readily be represented in a compressed data stream according to this operation. Multiple curve segments may be compressed according to the foregoing to thereby provide piece-wise compression of the pretest data. The foregoing concepts are more readily appreciated through reference to FIG. 27.

Figure 27:
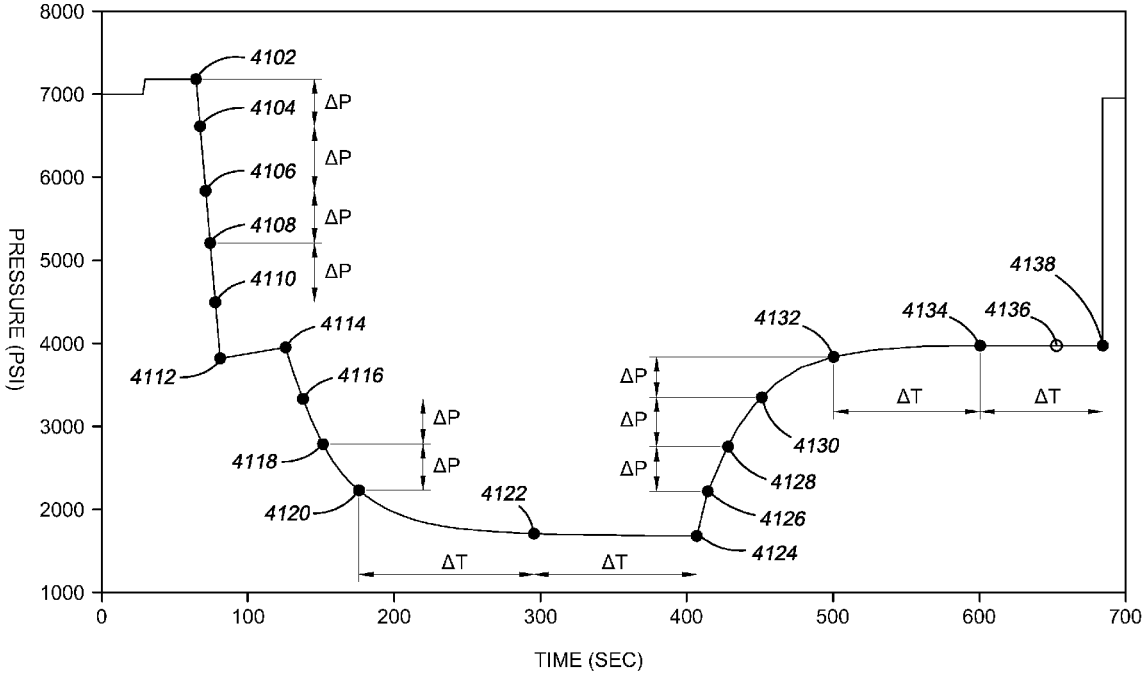
FIG. 27 is a curve associated with a data set for communication according to the present invention substantially corresponding to the pretest of FIG. 22.

FIG. 27 shows a curve associated with a data set for communication according to the present invention substantially corresponding to the pretest of FIG. 22. Data points 4102-4138 are shown as initially being selected as the compressed data set for communication. That is, if the number of bits associated with communicating each of these data points via the communication channel is less than or equal to the available capacity of the communication channel, such as may be determined at step 3810 of FIG. 24, data points 4102-4138 will be selected for communication. Data points 4102-4138 include event data points 4102, 4112, 4114, 4124, and 4136, such as may have been selected at step 3802 of FIG. 24. Where a portion of the curve is to be compressed for communication, an event data point bounding that portion of the curve is identified and data points along that curve in steps associated with the aforementioned variables are selected for communication.

Accordingly, where the portion of the curve bounded by event data points 4114 and 4124 is to be compressed, event data point 4114 may be identified and the data stream analyzed to select a next data point having a value which is either $\Delta P$ or $\Delta T$ greater or less than a corresponding value of the event data point 4114. In the example shown, the pressure value of data point 4116 is $\Delta P$ from that of event data point 4114 (while the change in time remains less than $\Delta T$). This is again repeated using selected data point 4116 as the reference, thus selecting data point 4118 having a pressure value $\Delta P$ from that of data point 4116 (again while the change in time remains less than $\Delta T$). Data point 4122 shows an example of selection of a data point having a time value $\Delta T$ from that of a preceding selected data point (although the change in pressure remains less than $\Delta P$). It should be appreciated that the entire data set, or portions thereof, may readily be decimated according to the foregoing.

Once the data points have been selected, the value or values (e.g., pressure slopes, and/or time values) associated with the aforementioned selected data points are determined at step 3906 and the values quantized for communication via the communication channel at step 3908. Quantization of the values may be accomplished using the same technique as utilized with respect to the selected event data points (step 3806) or by utilizing another technique.

Because operation of the foregoing configuration of the present invention maximizes the amount of data communicated within the bandwidth available in the communication channel, selection of additional data points using the foregoing variables is preferably an iterative process. Accordingly, the illustrated example returns to step 3810 of FIG. 24 after selection of additional data points using the foregoing decimation technique for a determination with respect to whether the amount of data associated with communication of the selected event data points, and the selected additional data points is less than the capacity available in the communication channel for such communications. If communication of the selected data points would not fill the communication channel available capacity, the decimation step is preferably repeated with an adjustment to one or more of the foregoing variables (e.g., decrease the step size $\Delta P$ and/or $\Delta T$) to increase the number of additional selected data points. Similarly, if communication of the selected data points would exceed the communication channel available capacity, the decimation step is preferably repeated with an adjustment to one or more of the foregoing variables (e.g., increase the step size $\Delta P$ and/or $\Delta T$) to decrease the number of additional selected data points.

Selection of a particular one of the foregoing variables for adjustment and the amount of adjustment provided may be based upon any of a number of considerations. For example, in the example described herein, wherein pressure and time steps are used to select additional data points, it may be desirable to adjust the pressure related variable where the time related variable has been selected as a function of a maximum or minimum "time-out" for sampling data. Of course, any or all such variables may be adjusted in any amount according to the concepts of the present invention. Moreover, different variables may be selected for adjustment at different times, such as successive iterations, and/or by different amounts according to the concepts of the present invention.

Referring now to FIG. 26, a flow diagram of operations providing data decimation for compression of data to be communicated according to another aspect of a method employing concepts of the present invention is shown. It should be appreciated that the steps of the flow diagram set forth in FIG. 26 may be performed as part of the decimate data for communication step 3816 shown in FIG. 24. It should further be appreciated that the data compression techniques described with reference to FIG. 26 may be used as an alternative to or in combination with the data compression techniques described above with reference to FIG. 25. For example, the data compression techniques of FIG. 25 may be utilized for one segment of a curve while the compression techniques of FIG. 26 may be utilized for another segment of a curve. A compression technique best suited for the particular data characteristics may thus be used.

The data decimator utilized in implementing the flow diagram shown in FIG. 26 operates to optimize the particular data selected for communication and/or the amount of data communicated through the use of a suitable "growth" function to select the particular data points for communication and/or the amount of data points communicated. Functions implemented by such data decimators may utilize, for example, a linear, a logarithmic, an exponential, a spherical, or a geometric progression, or any other appropriate time-like function, for example time or produced volume. For example, where a curve represented by the data points exhibits rapidly changing values at the beginning of the curve and the rate of change of the values decreases later in the curve, it may be desirable to implement a data point selection technique to spread the data points selected out along the curve to avoid capturing a disproportionately large percentage of data points late in the curve and a lower percentage of data points early in the curve where most of the change is taking place. Application of a growth function by the data decimator may be utilized to optimize selection of the particular data for communication by selecting data points more evenly spread over the arc of the curve. The foregoing concepts are more readily appreciated through reference to FIG. 28.

Figure 28:
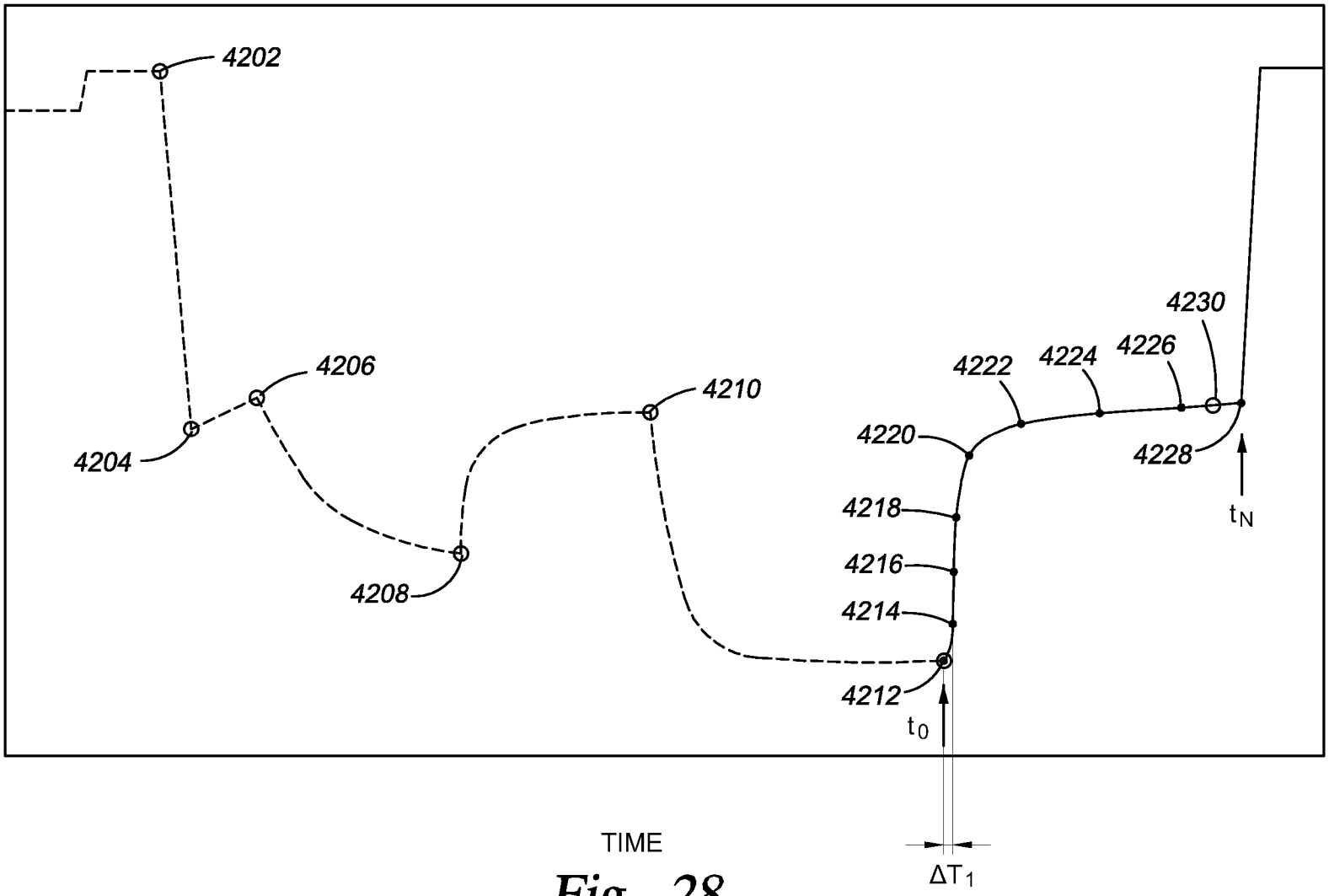
FIG. 28 is a curve associated with a data set for communication according to the present invention substantially corresponding to the pretest measurement phase of FIG. 22.

FIG. 28 shows a curve associated with a data set for communication according to the present invention substantially corresponding to the pretest measurement phase of FIG. 22. Although data points 4202-4230 are shown in FIG. 28, this example illustrates selection of data points with respect to a portion of the curve. Accordingly, data points 4212-4228 are shown as initially being selected as the compressed data set for communication. That is, if the number of bits associated with communicating each of these data points via the communication channel is less than or equal to the available capacity of the communication channel (or that available for communication of this portion of the curve), such as may be determined at step 3810 of FIG. 24, data points 4212-4228 will be selected for communication. Data points 4212-4228 include event data points 4212 and 4228 which may be selected for communication at step 3802 of FIG. 24 and, therefore, may not be duplicatively communicated, and additional data points 4214-4226 selected using a decimator of the described configuration. Accordingly, where the portion of the curve bounded by event data points 4212 and 4228 is to be compressed, a growth function to provide relatively even distribution of selected data points along the curve portion between these bounding event data points is preferably implemented.

In providing data decimation according to the example illustrated in FIG. 26, a number of additional data points to be selected is determined at step 4002. For example, where a particular portion of a curve is to be decimated, a number of additional data points between event data points bounding the portion of the curve may be determined at step 4002. The number of additional data points to be selected may be determined by subtracting the selected event data points and associated communication overhead, as well as any overhead associated with the communication of the additional data points, from the communication channel available bandwidth.

At step 4004 a desired interval between two events is determined. Alternatively, and as discussed herein, the desired interval may be bound by two times, such as $t_0$ and $t_n$, shown in FIG. 28. This interval may span from one event to the other event, or may span any portion between the two events. For example, in the foregoing example where the data points comprise pressure and time information a time interval may be selected which, when a selected growth function is applied, will facilitate the selection of the number of additional data points determined in step 4002. A beginning of the interval may be determined using a time step $\Delta t_1$ as shown in FIG. 28. For example, the beginning of the interval may be determined using a pre-selected time delay, such as 1 second, for example. An end of the interval may be determined using a percentage of $t_n$-$t_0$. Similarly, a beginning of the interval may be determined in a similar fashion.

It should be appreciated that operation of the present invention is not limited with respect to any particular parameter or interval for use with respect to selecting additional data points using a growth function. However, decimation utilizing a growth function is preferably implemented with respect to a portion of the data stream wherein the data point values are increasing or decreasing monotonically in order to provide a more uniform spread of the selected additional data points.

The growth function factor which will result in the selection of the number of data points, determined in step 4002, is determined at step 4006. Having determined the growth function factor, step 4006 of the illustrated example further provides the time progression, thereby identifying the times associated with the additional data points to be selected.

At step 4008, the pressure values for the data points corresponding to the time progression provided in step 4006 are determined. It should be appreciated that, through application of such a growth function, that data compression in addition to the decimation of data may be realized by communicating partial data sets. In the foregoing example, where the data points represent pressure verses time, the aforementioned geometric progression may be utilized to reproduce the relevant time aspect of the data point, thereby allowing only the pressure component of the data point to be communicated.

Accordingly, at step 4010 of the illustrated example, pressure values associated with the selected additional data points and the growth function factor utilized in determining the time progression are quantized for transmission. Additional or alternative information may be quantized at step 4010, as desired. For example, where various different growth functions may be implemented with respect to data decimation, information indicating the particular growth function implemented may be quantized. Similarly, where the desired interval between selected data points, the particular data point parameter used with respect to the growth function, etc. are not known to the receiving end of the communication, information with respect to these parameters may be quantized for communication. Quantization of the values may be accomplished using the same technique as utilized with respect to the selected event data points (step 3806) or utilizing another technique.

Because operation of the foregoing configuration of the present invention maximizes the amount of data communicated within the bandwidth available in the communication channel, selection of additional data points using the foregoing growth function may be an iterative process. For example, a plurality of portions of the curve may be decimated according to the steps set forth in FIGS. 24 and 26. Accordingly, the illustrated example returns to step 3810 of FIG. 24 after selection of additional data points using the foregoing decimation technique for a determination with respect to whether the amount of data associated with communication of the selected event data points, and the selected additional data points is less than the capacity available in the communication channel for such communications. If communication of the selected data points would not fill the communication channel available capacity, the decimation step is preferably repeated with respect to this portion of the curve or another portion of the curve to increase the number of additional selected data points. Similarly, if communication of the selected data points would exceed the communication channel available capacity, the decimation step is preferably repeated with respect to this portion of the curve or another portion of the curve to decrease the number of additional selected data points.

Figure 29:
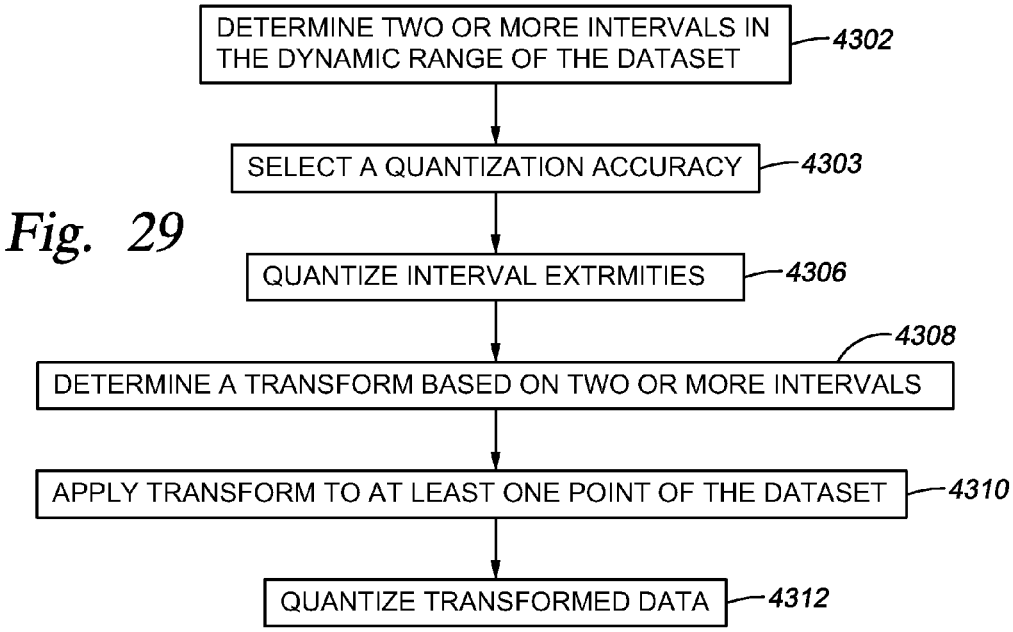
FIG. 29 is a flow diagram providing detail with respect to quantization techniques as may be implemented according to the concepts of the present invention.

Having described operation providing data compression and communication in accordance with the concepts of the present invention as illustrated in FIGS. 24-26, attention is directed to FIG. 29 wherein further detail with respect to quantization techniques, as may be implemented using a data compander according to the concepts of the present invention, is illustrated. The steps of the flow diagram of FIG. 29 may be utilized to provide quantization of data, such as within any of steps 3806 (FIG. 24), 3908 (FIG. 25), and 4010 (FIG. 26).

Quantizing data according to the flow diagram of FIG. 29 begins at step 4302 wherein two or more intervals in the dynamic range of the data set are determined. At step 4304 a desired quantization accuracy is selected, such as discussed above with respect to equation 45. The interval extremities are quantized at step 4306. A transform based on two or more intervals is determined at step 4308 and the transform is applied to at least one point of the data set at step 4310. The result of the transformed data set is quantized at step 4312.

Continuing with the example of formation pretest data having pressure and time values, such as set forth in FIG. 22, let it be assumed that a compander is used to quantize an exemplary data set consisting of the wellbore pressure values $P_{h1}$, and $P_{h2}$, the probe set pressure value $P_{set}$, the expansion pressure value $P_{ex}$, the buildup pressures $P_{b1}$, $P_{b2}$, the drawdown pressures $P_{d1}$ and $P_{d2}$, and the pressure value at which the mudcake breaks $P_{MC}$. As used hereafter, the term "wellbore pressure" may refer to any of hydrostatic and/or hydrodynamic pressure. The values in this dataset range from a minimum value $P_{min}$ equal to $P_{d2}$ and a maximum value $P_{max}$ equal to $P_{set}$.

Figure 30:
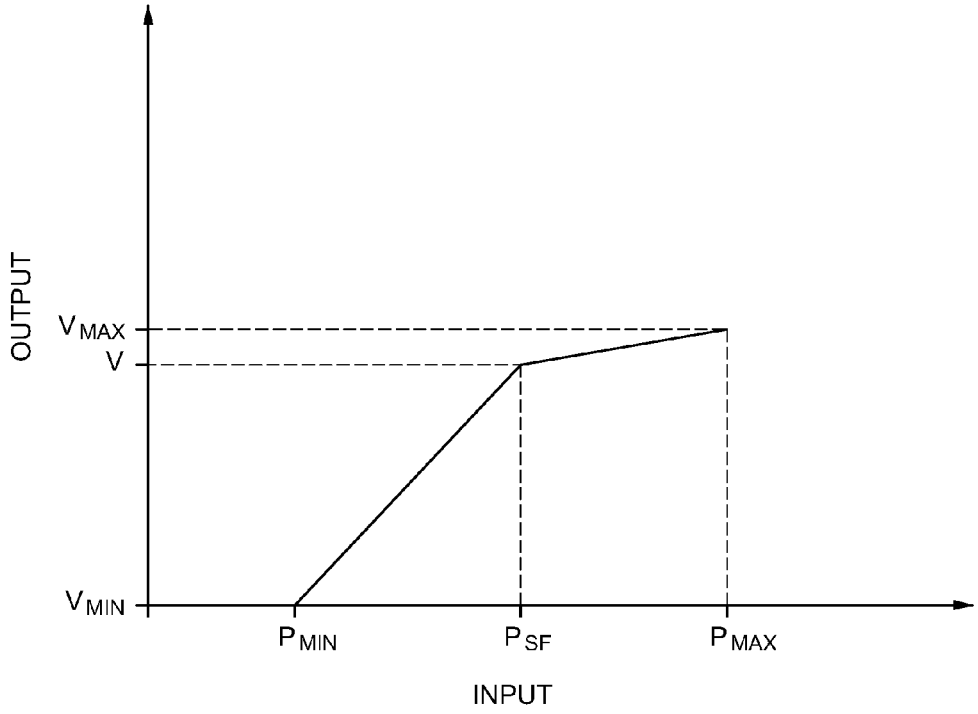
FIG. 30 is a graphical representation of operation of a data compander providing non-uniform quantization.
Figure 43:
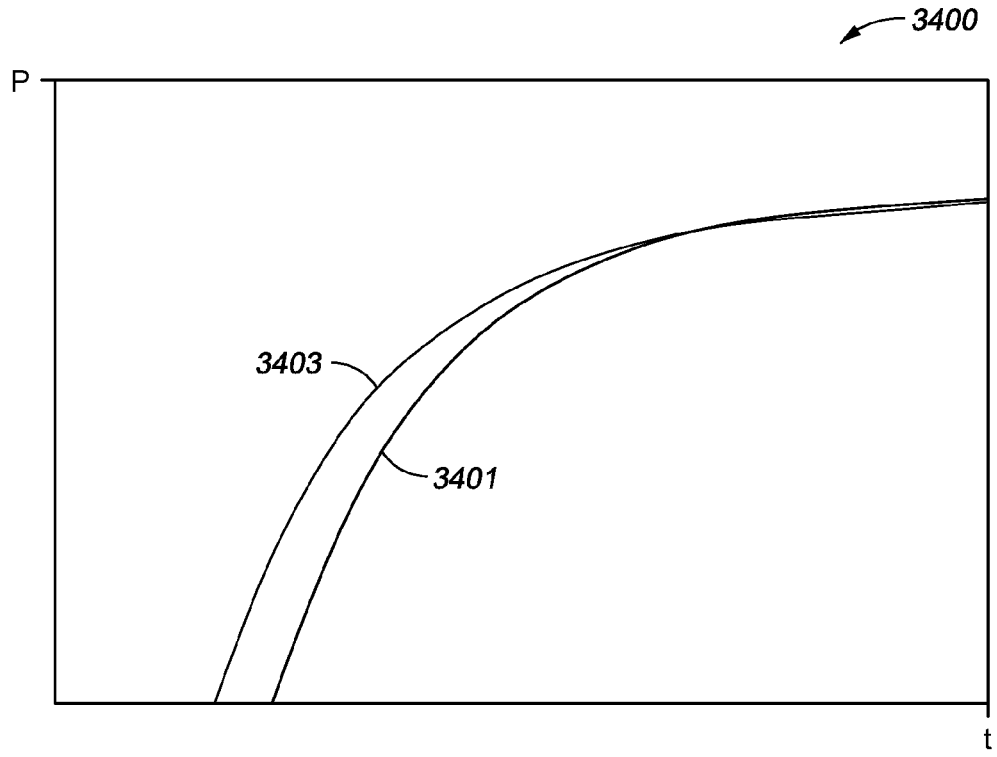
FIG. 43 is a graphical representation of a pressure measurements versus time plot generated by a formation tester depicting a late-time fit of a parameterized function to the data.

An important result provided by a pretest is an approximation of the sandface stabilized pressure $P_{sf}$. A quantization accuracy $P_{acc}$ of this pressure is preferably selected for quantizing this pressure value, or at least an event identified as a final formation pressure being reached (for example data point 4136 in FIG. 27 or data point 4230 in FIG. 28). More specifically, the quantization accuracy may be set at 1 psi for generating a log of the estimated the sandface stabilized pressure with 1 psi resolution.

Where the distribution of values in the data set is sparse in an interval or intervals, a data compander operating according to the flow diagram of FIG. 43 is preferably utilized to allocate a small portion of the bits to the values of the data set lying in the above mentioned sparse interval or intervals. Continuing with the example where formation pretest data having pressure and time values associated therewith, such as set forth in FIG. 22, it can be appreciated that except for the initial flowline expansion in the drawdown portion of the investigation phase, the pressure profile essentially varies between $P_{min}$ (the minimum pressure value) and $P_{sf}$ (approximated for example by the final buildup pressure $P_{b2}$). It may be advantageous to shrink the interval $[P_{sf}\ P_{max}]$ where the distribution of pressures is sparse, such as to efficiently represent the pressures in the interval $[P_{min}\ P_{sf}]$. The foregoing concepts are more readily appreciated through reference to FIG. 30. As shown in FIG. 30, the pressure may be mapped through a multi-linear transform which compresses the interval $[P_{sf}\ P_{max}]$ with a linear function with the slope less than 1. Thus, the interval $[P_{min}\ P_{sf}]$ after mapping occupies a greater fraction of the total interval than the interval $[P_{sf}\ P_{max}]$. After quantization using a uniform quantizer, the overall effect is the same as a non-uniform quantizer which allocates a large portion of bits to the values falling in $[P_{min}\ P_{sf}]$.

More specifically, the exemplary transform is based on the two intervals $[P_{min}\ P_{sf}]$ and $[P_{sf}\ P_{max}]$ that cover the dynamic range of the exemplary data set. The extremities of these intervals are $P_{min}$ ($P_{d2}$), $P_{sf}$ ($P_{b2}$), and $P_{max}$ ($P_{set}$), that are preferably quantized with accuracy $P_{acc}$, utilizing a number of bits discussed above with respect to equation 45. The other values of the exemplary data set are first mapped through the transform of FIG. 30. This transform maps interval $[P_{min}\ P_{sf}]$ into the interval $[V_{min}\ V]$, and the interval $[P_{sf}\ P_{max}]$ into the interval $[V\ V_{max}]$, where $V_{min}$ is equal for example to 0, V is equal for example to $P_{sf}-P_{min}$ and $V_{max}$ is a determined value, typically smaller than $P_{max}-P_{min}$.

This transform is applied to the elements of the exemplary data set other than $P_{d2}$, $P_{b2}$ and $P_{set}$ that have been previously quantized. The result of the transform is preferably quantized with accuracy $P_{acc}$. Note that the number of bits utilized for these transformed values is given by:

$$n\text{bits}_{trans}=\lceil \log_2(V_{max}/P_{acc})\rceil \tag{44}$$

Those skilled in the art will appreciate that the number of intervals may be greater than two, if desired. Also, it should be appreciated that transforms other than multi-linear transforms can be alternatively used. For example, a single monotonic function with a variable slope may be used in place of or in addition to a multi-linear function. This monotonic function may also be parameterized by series of data point values. In particular, if the variable to be transmitted has values covering many orders of magnitude, for example permeability, the quantization can be applied to a representation of the variable rather than the values of the variable itself. In the case of permeability once one has decided on the range one wishes to cover the quantization may be applied to the exponent of a logarithmic representation of the value. In this instance it is the precision of the quantization of the exponent that matters.

Figure 31:
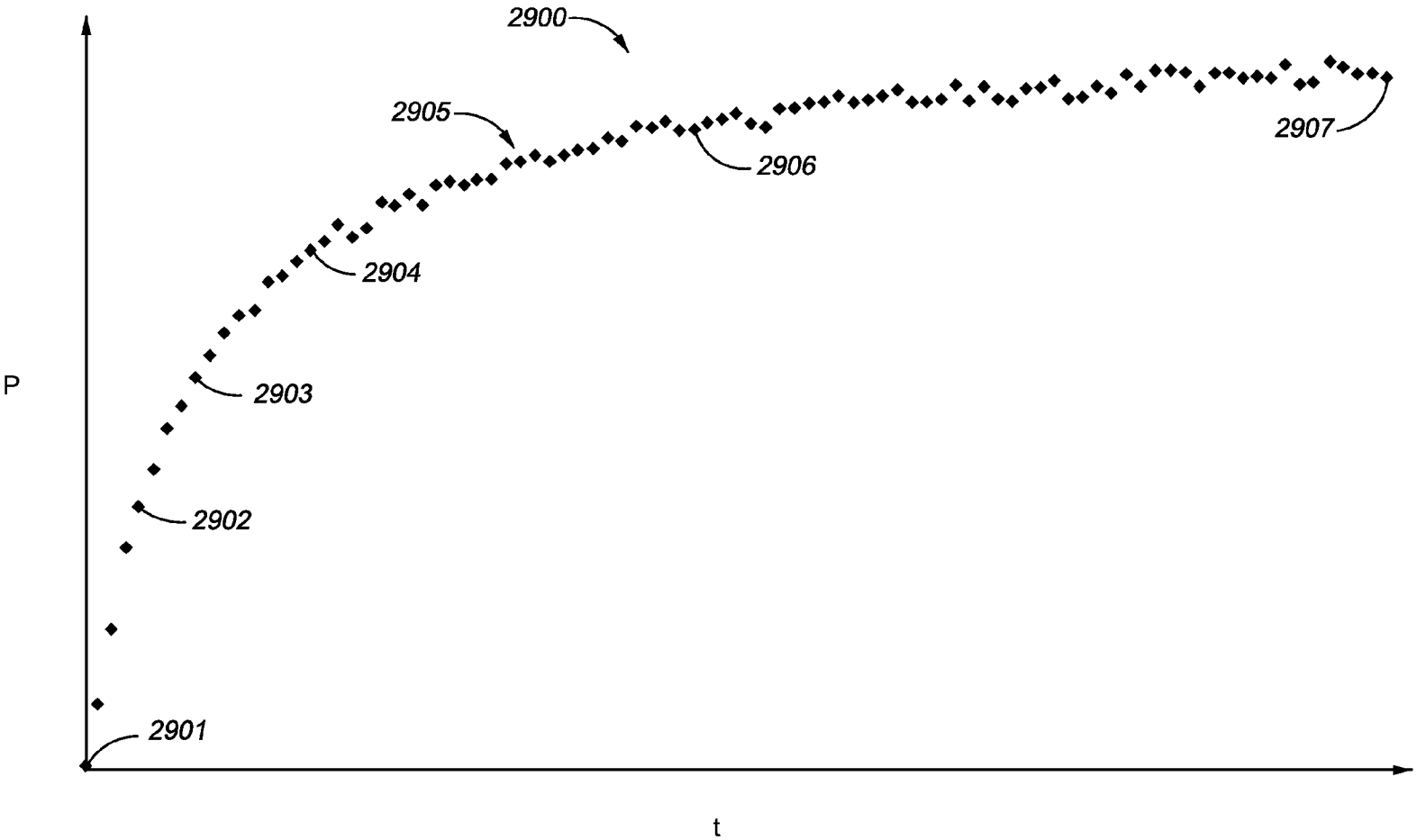
FIG. 31 shows a graphical representation of pressure measurements versus time plot generated by a formation tester depicting data points along a pressure buildup.
Figure 32:
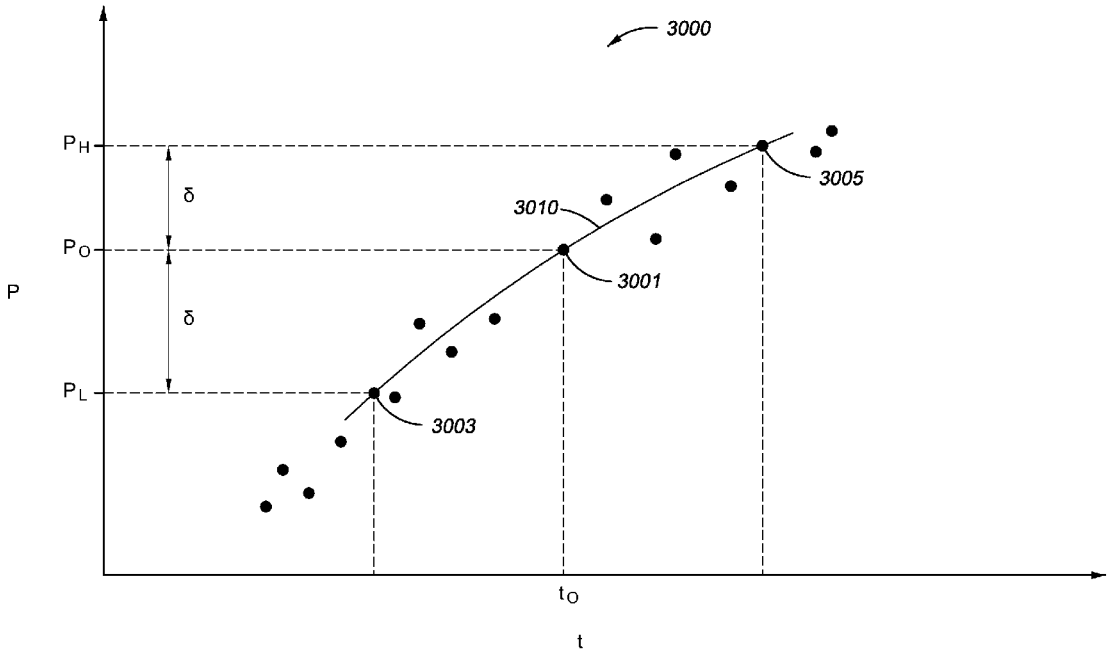
FIG. 32 shows a graphical representation of pressure measurements versus time plot generated by a formation tester depicting a pressure interval of the pressure buildup.

Having described quantization techniques, as may be implemented using a data compander according to the concepts of the present invention as illustrated in FIGS. 29-30, attention is directed to FIGS. 31 and 32 wherein further detail with respect to value determination techniques, as may be implemented according to the concepts of the present invention, are illustrated. Techniques discussed with respect to FIGS. 31-32, or other smoothing techniques discussed below, may be utilized to provide values at selected data points, such as within any of steps 3804 (FIG. 24), 3906 (FIG. 25), and 4008 (FIG. 26).

FIG. 31 shows one example of a buildup curve 2900 of a pressure (P) versus time (t) plot of a pretest. This buildup curve 2900 may be the same as the buildup 2210 or 2220 of FIG. 22 in greater detail. The buildup curve represents all of the pressure data points that are recorded by the downhole tool over time in a hypothetical pretest. Due to variations in the operation of the pressure sensors, the downhole temperature, and the way that fluid flows out of the formation, the data show variations about the general trend. When viewed in the aggregate, however, the data appears to form a somewhat smooth buildup curve.

In some cases, it is advantageous to compute a smoothed pressure value and the pressure derivative, or slope, of the pressure buildup curve at selected points along its evolution. Any method for selecting specific points may be used. In FIG. 31, the first data point in the buildup phase, at time zero, is selected as the first selected data point 2901. The remainder of the data points are selected based on various criteria, such as pressure step values, time step values, time growth function, etc. In this example, points 2902-2907 are selected using geometric time progression. Alternatively, all collected data points may be used for the analysis.

Once data points are selected, the smoothed value and the derivative of the pressure (i.e., the slope of the buildup curve) may be determined about the selected points. It may be useful to select a range about a selected data point and fit a curve to all of the data points in that range. The smoothed value and the derivative of the curve at the selected data point may be estimated using the fitted curve.

FIG. 32 shows a portion 3000 of a buildup curve 2900. Data point 3001, about which a smoothed value and a slope value are to be estimated, is selected. Data point 3001 has a time $t_0$ and a pressure $P_0$. A range about data point 3001 is selected for a pressure interval (δ). The selection of an interval (δ) may be accomplished arbitrarily, or through a number of different methods. Preferably, the interval (δ) is selected as a multiple of the noise of the signal. In other cases, the interval (δ) may be selected as a multiple of the pressure sensor resolution. By selecting the interval (δ) in either of these manners, it can be assured that the pressure differences between points on the interval represent actual pressure changes and not statistical variations in the data.

The upper and lower bounds of the pressure range correspond to pressures $P_L$ and $P_H$, respectively, where $P_L=P_0-\delta$ and $P_H=P_0+\delta$. In FIG. 32, the pressures $P_L$ and $P_H$ correspond approximately to buildup point 3003 and buildup point 3005, respectively.

Once the pressure range is defined, a curve is fit through the interval. In one example, a smoothing function is fit to the data in the range. A "smoothing function" is any function that is fit to the data to create a smooth curve that approximates the data in the range. Any function may be used that approximates the data. In one example, the mathematical expression of the smoothing function is a quadratic function of time, such as the one shown in Equation 31:

$$p(t)=a(t-t_0)^2+b(t-t_0)+c \tag{31}$$

where $t_0$ is the time of the selected data point, and a, b, and c are constants to be fitted. One method to fit a quadratic is a robust least squares method, as is known in the art. The method of fitting the equation, as well as the particular form of the equation, are not intended to limit the invention. The line 3010 in FIG. 32 represents a curve for a quadratic equation that has been fit to the data in the range.

At the point where $t=t_0$, the pressure in Equation 31 will be the constant c. In addition, taking the analytical derivative of Equation 31, it can be seen that the derivative of Equation 31 at the point $t_0$ is the constant b. Thus, by fitting a quadratic equation, such as Equation 31, to the data in the range, a "smoothed" value of the pressure and of the slope of the pressure buildup curve at $t_0$ may be estimated, respectively, as the constants c and b. Thus, the pressure at $t_0$ may be estimated as the third constant (i.e., c in Equation 31), and the pressure derivative at $t_0$ may be estimated as the second constant (i.e., b in Equation 31). This method, as shown for the selected point 3001 in FIG. 32, may be performed for each of the selected data points in a set of data for a pressure buildup. For example, this method may be used to determine the "most representative" pressure value and the slope of the buildup curve in FIG. 30 at points 2902-2906. This method is also not limited to data points selected along a buildup curve and may be applied to other data points selected elsewhere on a pretest curve.

It may be valuable to know the "most representative" pressure value and/or the slope of the pretest curve at end data points in a pretest phase. In some cases, the selected data point may be the last recorded data point of the curve (i.e. 2907 in FIG. 30). In other cases, the selected data points may be close to an event where the pressure trend changes rapidly (i.e. 2901 in FIG. 30).

It should be appreciated that the values transmitted to a surface operator for being incorporated in a well log are not restricted to a smoothed value and a slope. For example, other data may be determined by curve fitting, such as a curvature, and may be transmitted. Also, only one of a smoothed value or a slope may be transmitted. Additionally or alternatively, values determined by filtering techniques applied to an interval selected around a data point, as further discussed below.

Referring again to FIG. 32, it may be advantageous to determine the smoothed value and the slope of the buildup curve about the selected points using filtering techniques. Once a pressure range or curve portion is defined about the selected data point, a filter may be selected based on the number of data points present in the range. Thus, the number of data points $N_L$ between data point 3003 (associated with the lower bound $P_L$ of the selected interval) and selected data point 3001 is determined. The number of data points $N_H$ between selected data point 3001 and data point 3005 (associated with the higher bound $P_H$ of the selected interval) is also determined. The filter length L may be selected based on $N_L$, $N_H$, or both $N_L$ and $N_H$. For example, a zero phase, Finite Impulse Response (FIR) filter length may be selected based on the minimum $N_{min}$ of $N_L$ and $N_H$, such as given by $L=2N_{min}+1$.

Figure 33A:
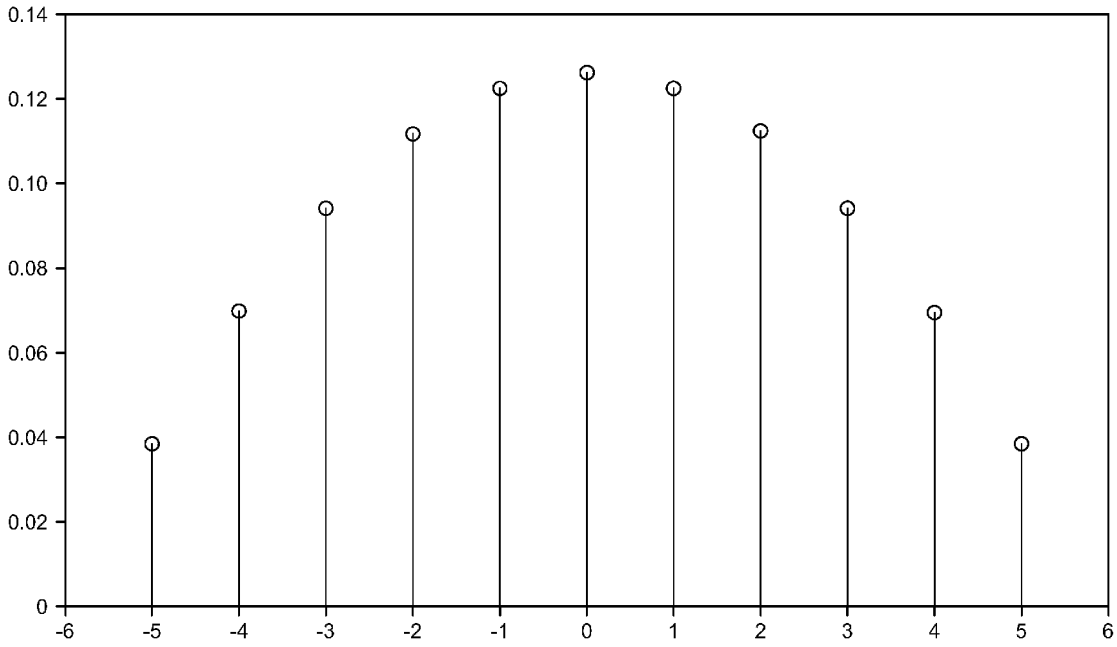
FIG. 33A is a graph illustrating an example of a filter for determining a smoothed value of a curve at a selected point.

The filter coefficients usually depend on the selected filter length L. Some filters may be more effective to filter data on short intervals and others on long intervals and are selected accordingly. The "most representative" pressure value for the pressure at selected data point 3001 may be obtained by convolution with a low pass, zero phase, FIR filter, such as a normalized tapering window or kernel weighting filter. More specifically a Welch window, an Epanechenikov kernel or a Savitsky Golay filter may be used. An illustrative example of a filter usable for obtaining a smoothed value of pressure at a selected point is shown in FIG. 33A. Note that filters may comprise positive and negative (not shown) values.

Once the filter is selected, the recorded curve is filtered about the selected data point using filtering method (i.e. a convolution) as well know in the art. The value of the filtered curve at the time $t_0$ may then be transmitted.

Alternatively or additionally, a pressure derivative or curve slope at selected data point 3001 may be obtained by filtering techniques. For example, a derivative filter of selected length L may be used. Derivative filters have typically a frequency response $H(\omega)$ essentially proportional to the pulsation $j\omega$ in a frequency band of interest of the signal. For example, a derivative filter may be derived by differentiating a low pass filter. An illustrative example of a FIR anti-symmetrical derivative filter is shown in FIG. 33B.

Figure 33B:
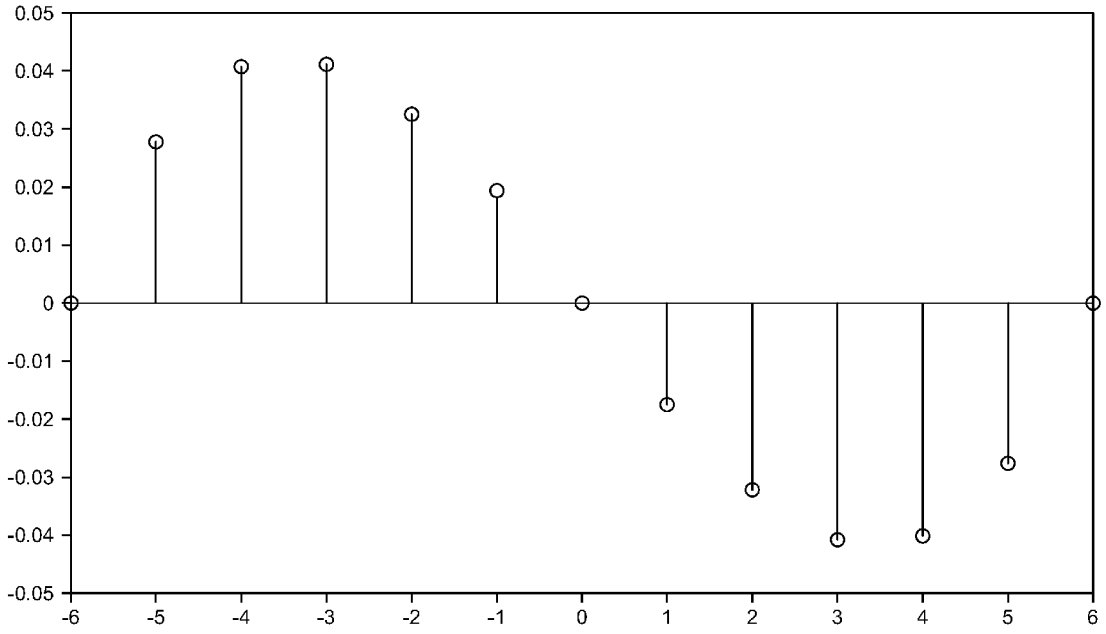
FIG. 33B is a graph illustrating an example of a filter for determining a smoothed value of a curve slope at a selected point.

Although only FIR filters are illustrated in FIG. 33A-B, those skilled in the art will appreciate that other types of filter may be used. For example an Infinite Impulse Response (IIR) filter may be used for determining curve smoothed values, curve slope values or other characteristics of a curve. Also, forward and reverse filtering may be used. Filtering may additionally be used to interpolate data between two acquired times. Other noise removing techniques may be used in additions to filtering, such as outlier detection and removal.

FIGS. 34-45 illustrate additional examples of techniques for analyzing pressure traces which may be encountered during formation testing. Certain portions of the tests may exhibit an indication of anomalous behavior, defects, errors or events that may have occurred during testing. One or more confidence tokens may be identified during or after the execution of a test. One or more of these confidence tokens may be analyzed to determine whether such anomalous behavior, defects, errors or events have occurred during the test. These confidence tokens may then be used to determine a level of confidence in the results derived from the tests performed and/or their underlying data and interpretation.

Typically, confidence tokens are used to identify the resemblance between the pressure response measured during an actual pretest and the corresponding expected response in ideal conditions, or prototypical pretest. As used herein, a confidence token may be used for example to detect the degree of such resemblance. Additional information may also be obtained concerning testing conditions or other downhole characteristics.

Figure 34:
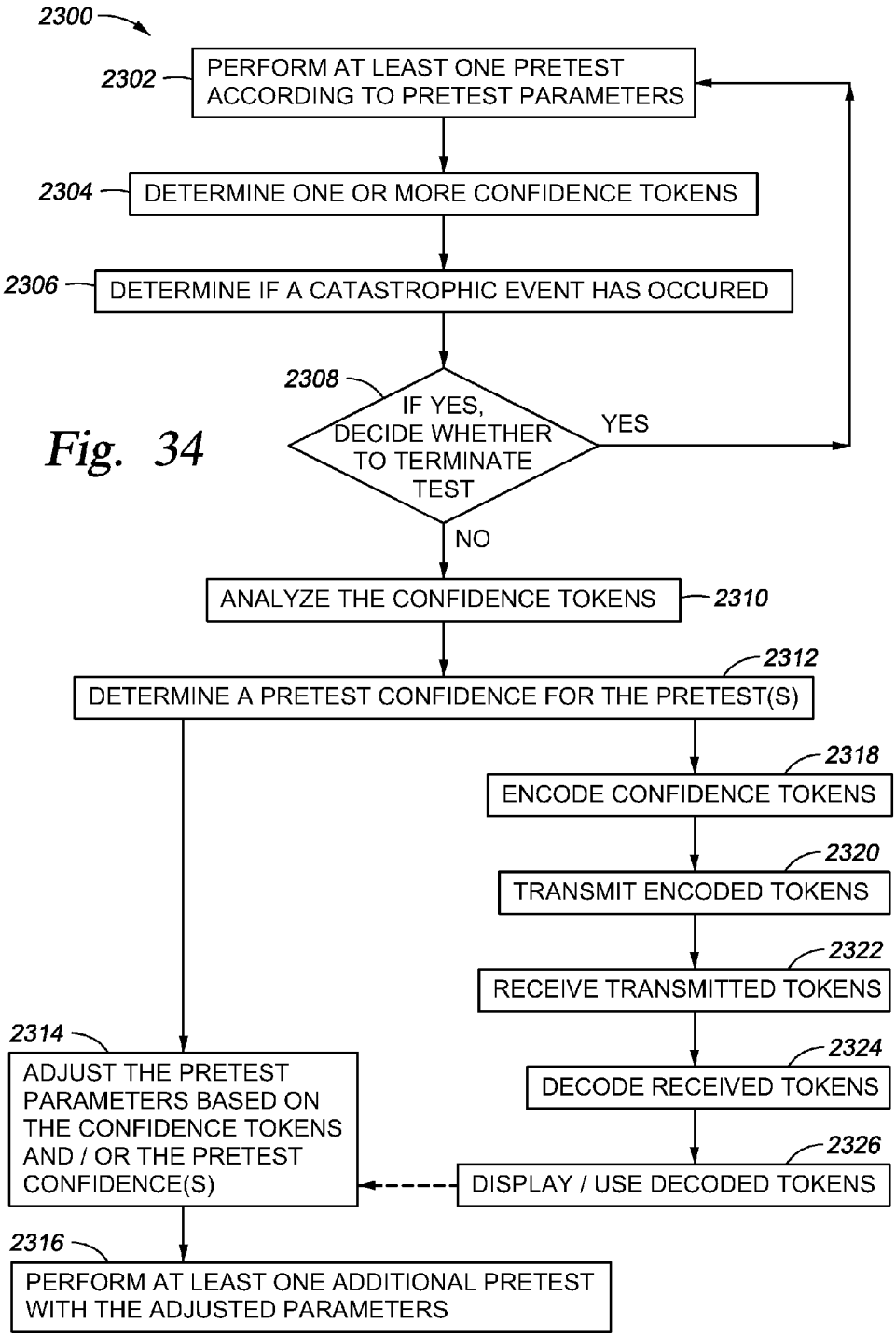
FIG. 34 is a flow chart depicting a method of determining a confidence in a pretest.

FIG. 34 is a flow chart depicting a method 2300 for determining the level of confidence to be attributed to a formation test. This method involves performing at least one pretest 2302 as described above. The evaluation may be carried out with or without observing the full pretest. In some cases, one or more pretests may be performed. In other cases, the test may be terminated without performing additional pretests in order that overall test objectives, in particular test duration, may be achieved.

During the pretest, one or more confidence tokens may be determined 2304. As will be described more fully below, there are several different types of confidence tokens and techniques for determining confidence tokens. Depending on the confidence token that is determined, it may be discovered that a catastrophic event from which there is typically no possibility of recovery has occurred 2306. For example, a token may show that the tool has malfunctioned or, less dramatically, the hydraulic seal between the tool and the wellbore wall has been lost. If so, a decision may be made to terminate the test 2308 as soon after receiving the information as possible. The test may be terminated and no other test may subsequently be performed, it may be terminated and restarted, or it may be permitted to continue.

One or more confidence tokens may be identified during one or more pretests. The tokens may then be analyzed 2310. Multiple tokens obtained during a single pretest may be analyzed. Alternatively, one or more tokens across one or more pretests may be analyzed. The analysis may be used to determine an overall test level of confidence for one or more pretests 2312.

If desired, the pretest and/or the wellbore operations may be adjusted during or after the pretests 2314. For example, it may be desirable to adjust the operation of the tool or reconfigure the tool downhole in order to take better measurements and continue the testing process. In another example, the results of a first pretest confidence evaluation may be used to alter the parameters of the second test. In some cases, it may be desirable to optimize the testing process based on information obtained from one or more confidence tokens and/or pretest confidences. Additional pretests may be performed with the adjusted parameters 2316.

If desired, one or more confidence tokens may be alternatively encoded at step 2318 for transmission within a communication channel between the formation tester and the surface. The encoded tokens are transmitted using the communication channel at step 2320. Encoding the tokens may comprise appending to or interleaving with other data, such as the compressed data discussed with respect to FIGS. 23-26. In a preferred configuration, the encoded tokens are transmitted via a mud pulse telemetry communication channel. At step 2322 the encoded tokens are received by a system in communication with the communication channel. For example, an up-hole receiver coupled to the communication channel, may receive the transmission signals. The received tokens are decoded at step 2324. Decoding the data as provided at step 2324 may include separating desired tokens from other data which have been communicated via the communication channel. At step 2326 the decoded tokens are displayed and/or used. For example, where a formation testing tool has performed a test from which the data has been collected, a surface system, such as a computer or terminal, may display the data to provide information to a well engineer or other operator with respect to performing additional tests, completing tests, etc. The decoded tokens are usually added to a well log. A surface operator or other operator may use the tokens to adjust testing operations, as explained above with respect to step 2314, that can therefore be completed downhole by the formation tester or uphole by an operator or an automated surface system, or other ways known in the art.

FIGS. 35-46 describe various techniques for determining one or more confidence tokens as set forth in step 2304 of method 2300 above. Each confidence token provides information concerning one aspect of the pretest. These confidence tokens may be determined using a variety of techniques.

Figure 35:
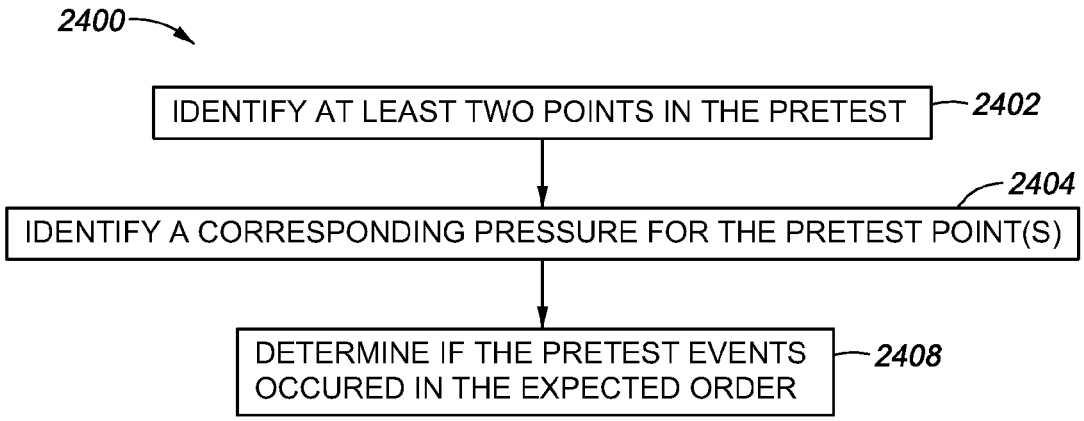
FIG. 35 is a flow chart depicting a method of determining a confidence using a pressure comparison technique.
Figure 36A:
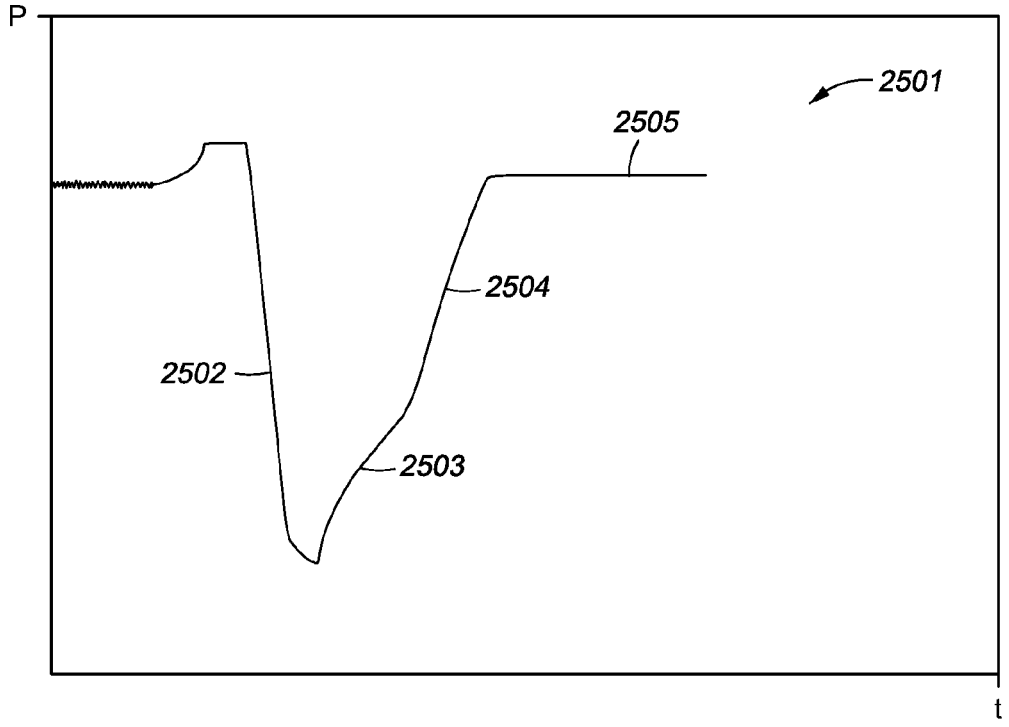
FIG. 36A is a graphical representation of a pressure measurements versus time plot generated by a formation tester depicting a lost seal.
Figure 36B:
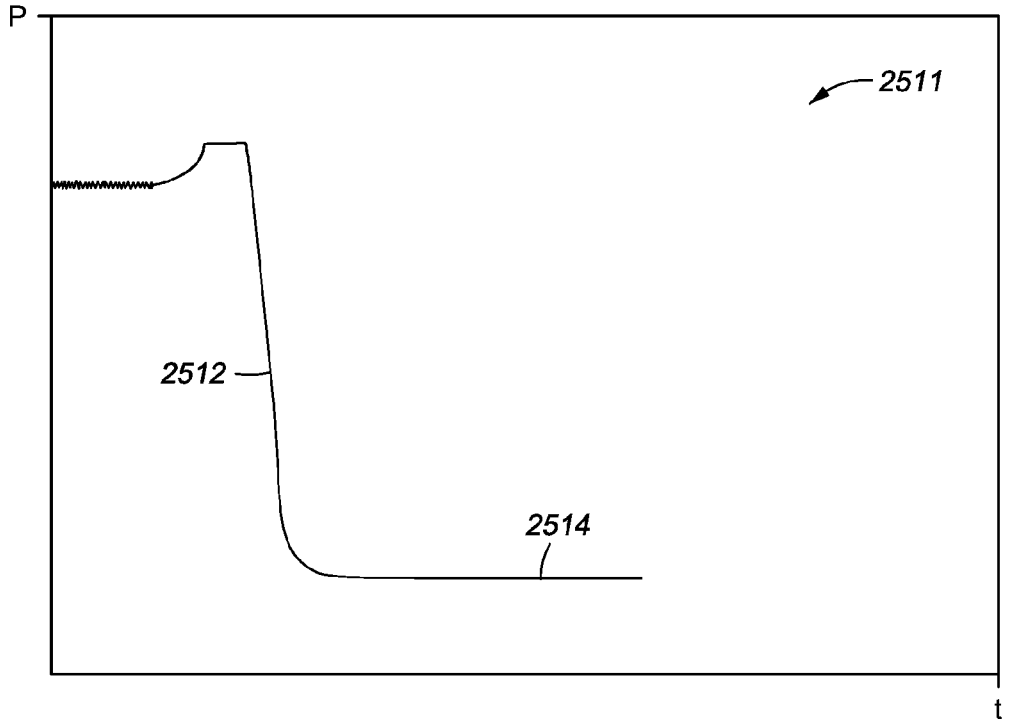
FIG. 36B is a graphical representation of a pressure measurements versus time plot generated by a formation tester depicting a blocked flow.

FIGS. 35 and 36A-B describes methods 2400 for determining a confidence token based on a pressure comparison technique. In this example, a relative comparison and/or order of the pressures measured at different times during a pretest can be used to verify that the pretest is performing as desired.

FIG. 35 shows a method 2400 for determining a confidence token based on a pressure comparison technique. A confidence token may be used to verify that, when ranked from the highest to the lowest, the pressures at each identified event in the pretest sequence should have a particular order. At least two points in at least one pretest are identified 2402. A corresponding pressure for each point may then be determined 2404. The points may be determined to be specific events in the pretest, such as the events discussed with respect to FIG. 22.

For example, in FIG. 22, the set pressure ($P_{set}$) 2203 is typically the highest of the pressures. Thus, it is expected that the pressure in the flowline just after the probe has compressed the mudcake layer and before the drawdown cycle will be the highest pressure measured during the pretest. The known properties of the pretest may be used to identify the identified events, such as the drawdown pressure (2209) and others.

Based on this information, an ordering of the pressures measured at each significant event in the pretest sequence may be established. The prototypical pretest is expressed mathematically below:

$$P_{set}>P_{ex}>(P_{h1}\approx P_{h2})>(P_{b1}\approx P_{b2})>P_{MC}>\max(P_{d1}, P_{d2}) \quad (26)$$

where $P_{set}$ is the set pressure (such as pressure level measured at event 2203 in FIG. 22), $P_{ex}$ is the expansion pressure (such as pressure level measured at event 2204 in FIG. 22), $P_{h1}$, and $P_{h2}$ are wellbore pressures before and after a test (such as pressure levels measured respectively at events 2201 and 2233 in FIG. 22), $P_{MC}$ is the flowline pressure at which the mudcake detaches from the wellbore wall (such as pressure level measured at event 2206 in FIG. 22), $P_{b1}$ and $P_{b2}$ are the final sandface buildup pressures (such as pressure levels measured at events 2216 and 2231 in FIG. 22), and $P_{d1}$ and $P_{d2}$ are pressures at the end of a drawdown (such as pressure levels at events 2209 and 2219 in FIG. 22).

The identified pressures are then compared to determine if they occurred in the expected order at step 2408. Depending on how well the acquired pretest data points correspond to the expected ordering of the standard pretest, a confidence token may be assigned a given value. For example, the confidence token may be set based on the validness or violation of the ordering as laid-down in Equation 26. Alternatively, the confidence token may be set based on measured pressure values of the identified points in the pretest, as further developed below.

Some of these relationships may be further refined. For example, an indicator for whether a seal has been established on setting the tool may be formulated as $P_{set}-P_{h1}>D_1$, where $D_1$ is a pressure characteristic of a particular tool, formation, and type of mud, and may have a value at a predetermined level. A refined confidence token may be set based on this refined pressure comparison technique.

Another example of refinement of the pressure comparison of Equation 26 may be based on the relationship $P_{ex}-P_{h1}<(P_{set}-P_{h1})/m$ , where m is a predetermined number, typically greater than or equal to 2. If this relationship is satisfied, a "leaky" mudcake might be suspected and another confidence token may be set accordingly. In that case, the buildup pressures may be further examined with a supercharging technique as defined below.

In yet another example of refinement of the pressure comparison of Equation 26, a comparison of the values of the wellbore or hydrostatic pressures ($P_{h1}$, or $P_{h2}$) and the buildup pressures ($P_{b1}$, or $P_{b2}$), may yield an indication of whether the well is drilled over balance or not. Yet another confidence token based on the violation or validness of this comparison may be based on $(P_{h1}, P_{h2})>(P_{b1}, P_{b2})$. The inequality in Equation 26 provides a guideline that may be used for determining if a particular pretest is valid.

Under some circumstances, the order expressed in Equation 26 may be violated and the pretest will still be valid. For example, in an under-balanced well, where the wellbore or hydrostatic pressures ($P_{h1}$, $P_{h2}$) of the drilling fluid in the borehole are typically lower than the formation pressure ($P_f$), those values of the wellbore or hydrostatic pressures ($P_{h1}$, $P_{h2}$) and the buildup pressures ($P_{b1}$, $P_{b2}$) would be reversed. Also, drilling operations may result in the buildup pressures (e.g., $P_{b1}$, $P_{b2}$) being higher than the borehole pressures ($P_{h1}$, $P_{h2}$), indicating a potentially dangerous operating condition. Additionally, the wellbore or hydrostatic pressures measured at the beginning and end of the pretest ($P_{h1}$, and $P_{h2}$) may differ if the mud pumps are running at one point but not at the other. The pressure comparison in Equation 26, therefore, provides an indication of a possible defect. In some cases, additional data and/or analysis (such as refined pressure comparison techniques) may provide sufficient information to conclude whether a defect has occurred in the pretest.

FIGS. 36A-36B show examples of pressure (P) versus time (t) pressure traces that may result from problems encountered during a pretest. These problems may cause the conditions in Equation 26 to be violated.

For example, FIG. 36A shows a pressure curve 2501 for a pretest in which the seal is lost. Following a drawdown cycle 2502, a buildup cycle 2503 is begun. During the buildup cycle 2503, the pressure has a quick rise 2504 to the wellbore or hydrostatic pressure 2505. This indicates that the seal established against the mudcake may have been lost, enabling the pressure of the borehole to leak into the flowline. In this circumstance, the pressure measured near what should be the buildup pressure would be essentially the same as the wellbore pressure measured before the test and would violate Equation 26.

FIG. 36B shows another pressure trace 2511 for a pretest. Following the drawdown cycle 2512, the pressure remains at the drawdown pressure 2514. This indicates that there is no flow from the formation into the tool. This may be a result of a blocked flowline or of the formation being devoid of moveable fluid. Again, the buildup pressure would be too low and would essentially be the same as the drawdown pressure, and would violate Equation 26.

A confidence token may be assigned to the pretests performed in FIGS. 36A and 36B. The traces of FIGS. 36A and 36B may also indicate a catastrophic failure. In such a case, it may be desirable to terminate the test before it proceeds to completion as discussed previously at least with respect to FIG. 7. In optional step 2308 of FIG. 34, the test is terminated. The tool may be reset and the test re-performed as desired.

Figure 37:
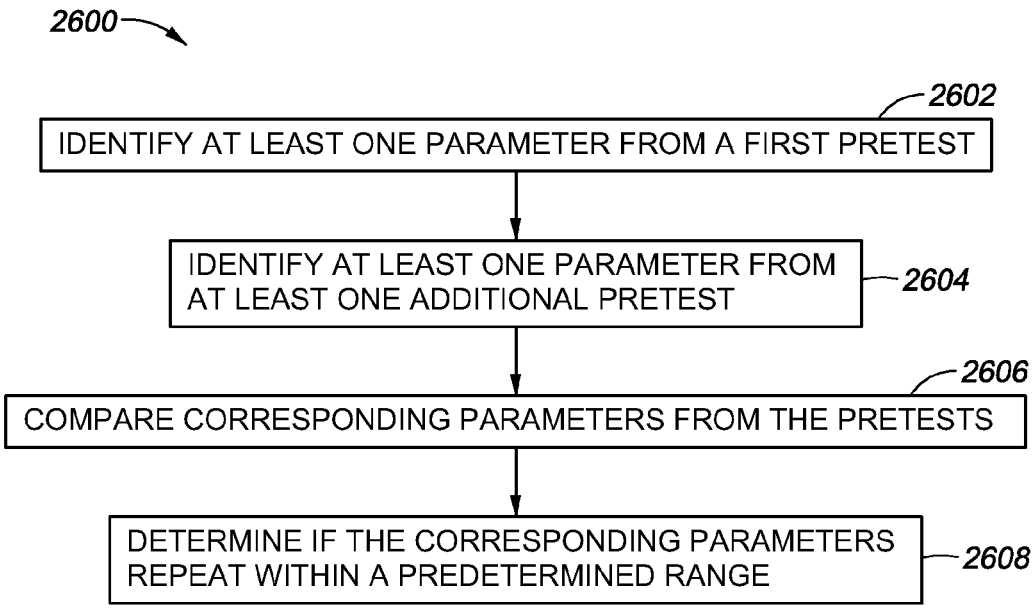
FIG. 37 is a flow chart depicting a method of determining a confidence using a parameter comparison technique.

FIG. 37 describes a method 2600 for determining a confidence token based on a parameter comparison technique. In this example, a relative comparison of the same measurement parameters across different pretests is made to verify that the pretests are performing within an expected range, such as noise.

In this method, at least one parameter from a first pretest is identified 2602. At least one parameter from at least one additional pretest is then identified 2604. Corresponding parameters from the various pretests are then compared 2606. It is then determined if the corresponding parameters repeat within a predetermined range 2608. For example, a noise range, or other sensor performance characteristic, is defined and corresponding parameters from different pretests are compared to verify that they repeat within the defined performance range.

When more than one pretest is performed, a comparison between the pretests may provide information about the confidence level to be associated with the pretest results. For example, if the first buildup pressure ($P_{b1}$) at 2216 (FIG. 22) is in close agreement with the second buildup pressure ($P_{b2}$) at 2231 (FIG. 22), that agreement may indicate a valid test. In this parameter comparison technique, a confidence token may be set based on the condition that the first and second buildup pressures are within an acceptable range, for example:

$$|P_{b1}-P_{b2}|\leqq m\max(\delta,\eta) \quad (27)$$

where m is a multiplication factor and max(δ, η) represents the maximum of the tool gauge repeatability (δ) and the noise associated with the measurement (η), which may be determined from other data acquired during operation of the tool. Because the measured noise is typically greater than the intrinsic noise of the sensor, it is generally necessary to measure the noise "on the fly" by methods known in the art.

The multiplication factor m may be set to an appropriate number for a particular test. For example, m may be set to a number greater than or equal to about 2 in those instances where the mud pumps are being run and the noise is high. If the noise is extremely high, m may be set to 3 or 4. In situations where the mud pumps are off and there is little noise, m may be set as low as 1. Those having skill in the art will appreciate that the multiplication factor may be modified depending on the particular testing situation. In addition, if more than two buildup cycles are performed, Equation 27 may be modified to include buildup pressures other than the first and second pretests. For example, if three buildups are performed, Equation 27 may include the first and third buildups or the second and third buildups. The particular pressures used in Equation 27 are not intended to limit the invention.

Another parameter comparison that may be made between two different pretests is a comparison of the drawdown response. The drawdown response for a first pretest is a ratio of the difference between the buildup pressure ($P_{b1}$) and the drawdown pressure ($P_{d1}$) to the drawdown rate ($q_1$). Thus in this second parameter comparison technique, a confidence token may be set based on a comparison between two drawdown responses, as expressed as follows:

$$1 - e_1 \le \left| \frac{(P_{b1} - P_{d1})}{q_1} \frac{q_2}{(P_{b2} - P_{d2})} \right| \le 1 + e_2 \tag{28}$$

where $e_1$ and $e_2$ represent acceptable variances that may be selected based on a particular testing situation. It is noted that the second half of the middle term in Equation 28 is the reciprocal of the second drawdown response. Ideally, the two drawdown responses will be close to equivalent, and the product of one and the reciprocal of the other will be close to unity. By multiplying one by the reciprocal of the other, the variance $e_1$, $e_2$ may be applied to the product to evaluate the confidence in the pretest results.

Yet another comparison that may be made between pretests is the comparison between the mobilities. As mentioned in the description of FIG. 22, the mobility during a first drawdown-buildup sequence $(K/\mu)_1$ and the mobility during a second drawdown-buildup sequence $(K/\mu)_2$ can be estimated using Equation 1. Thus, in this technique, another confidence token may be set, based on the violation or validity of the condition expressed in Equation 29:

$$1 - e_3 \le \left| \left(\frac{K}{\mu}\right)_1 \left(\frac{\mu}{K}\right)_2 \right| \le 1 + e_4 \tag{29}$$

Again, $e_3$ and $e_4$ represent acceptable variances that may be selected based on the desired results and the particular testing situation. It is noted that the reference numbers that denote the number of the drawdown-buildup sequence from which the mobility estimate was made are used as subscripts for the entire mobility term. The subscript numbers are not separately used to denote the permeability or viscosity because these parameters were not distinguished in this mobility estimate.

If a static flow is almost attained during the first and second pretests, for example, the ratios computed in Equations 28 and 29 may be very similar. In such cases, the ratios may be close to unity. A confidence token may then be selected to indicate a high confidence level. In contrast, a lower confidence token may be selected where the ratio is not close to unity. In the latter case several confidence tokens may be combined to select which value of the parameter best represents the true value. It will be readily apparent that tokens such as represented by Equations 28 and 29 may be applied pair wise to tests containing more than two pretests.

Figure 38:
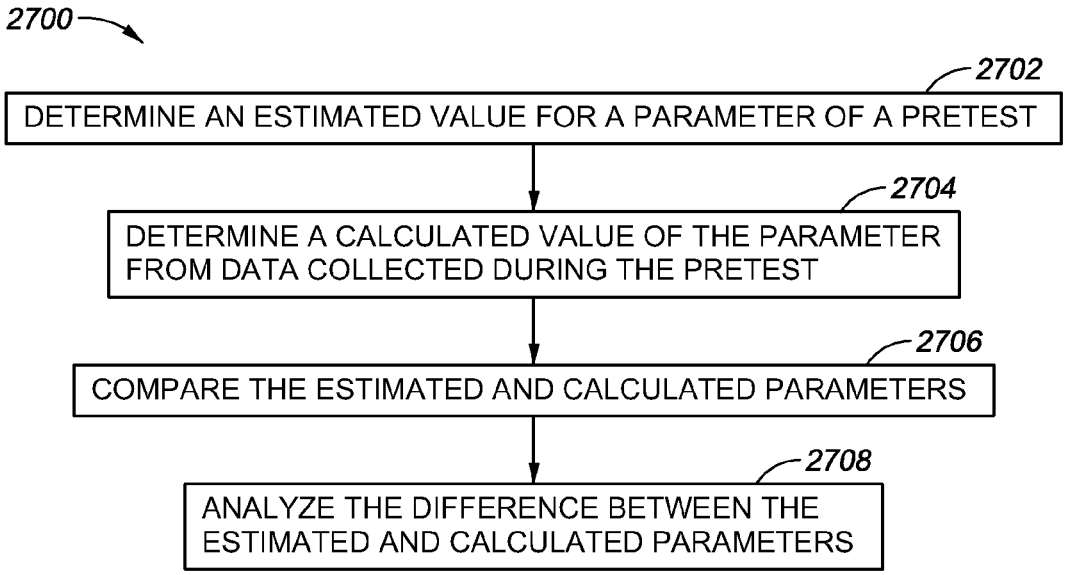
FIG. 38 is a flow chart depicting a method of determining a confidence using a parameter prediction technique.

FIG. 38 describes a method 2700 for determining a confidence token relating to parameter prediction technique. This technique is used to determine whether a pretest performs as predicted. In some cases, it may be desirable to use prior knowledge obtained from one or more of the tests to predict an estimated value for a parameter of a pretest. The estimated and/or calculated parameters determined in FIG. 38 may be also used to determine various downhole conditions.

The method 2700 involves predicting an estimated value for a parameter of a pretest 2702. Any parameter may be selected, such as mobility, change in pressure, etc. A calculated value for this parameter is then determined from data collected during the pretest 2704. The estimated and calculated parameters are then compared 2706. The difference between the compared parameters is then evaluated 2708. A confidence token may be assigned based on the evaluation.

In one example, the parameter prediction technique may be used to determine the presence of gas or other compressible fluid in the flowline that may affect test results. This example of parameter prediction technique may also be referred to as a flowline expansion technique. If the flowline (e.g., 119*a* in FIG. 4) in the tool contains a highly compressible fluid, such as a gas, the pressure measurement may be adversely affected. Thus, it may be advantageous to determine if such a fluid is present in the flowline. One indicator of gas in the flowline, for example, is obtained from the ratio of a predicted or estimated slope of the drawdown curve during flowline expansion to the actual slope of the drawdown curve. The predicted slope may be determined based on, for example, prior knowledge of the compressibility of the mud in the flowline. The mud compressibility may be known before the pretest from a database or correlation of mud properties with pressure and temperature, or it may be determined by a separate test of the drilling fluid, as is possible with the tool shown schematically in FIG. 4.

This comparison may be mathematically depicted using Equation 30 below. If, for example, gas is present in the flow line, the ratio of the predicted rate of change in pressure due to flowline fluid compressibility to the measured rate of change in pressure may be expressed as follows:

$$\left| \frac{\dot{p}_{meas}}{\dot{p}_{est}} \right| = \left| \frac{V_t C_m \dot{p}_{meas}}{q_p} \right| << 1 \text{ (if gas is present in the flowline)} \tag{30}$$

where $\dot{p}_{meas}$ represents the measured rate of change of pressure during the drawdown cycle, $\dot{p}_{est}$ represents the estimated rate of change in pressure, $V_t$ is an estimate of the volume of the flowline during the pretest, for example the initial total volume of the flowline plus half the volume used in the pretest, $C_m$ is the compressibility of the drilling fluid, and $q_p$ is the volumetric rate of change of the flowline (e.g., caused by moving a piston connected to the flowline, such as piston 118*a* in FIG. 4).

When the left hand quantity is close to unity, the compressibility of the fluid in the flowline is close to the expected compressibility of the drilling fluid. In that case, there is little, if any, gas in the flowline. If, however, there is a significant amount of gas in the flowline, the measured slope will be much less than the predicted slope. In that case, the ratio in Equation 30 will be significantly less than one. Thus, in this flowline expansion technique, a confidence token may be set based on the violation or validness of equation 30, or alternatively a confidence token may be set to the ratio of the predicted drawdown slope to the measured drawdown slope.

When gas is detected in the line, the expected confidence in the pretest results may be reduced. In some cases, a second pretest may be performed after the gas has been purged from the flowline. In other cases, it may be impractical or impossible to perform another pretest. In those cases, an operator may reduce the confidence in or reevaluate the results of a pretest that was performed with gas in the flowline. For example, if there is suspicion of gas in the flowline for one pretest in a series of tests at different vertical depths and the value of the formation pressure at that depth appears to be elevated, the operator may rely on the data from pretests at the other depths to evaluate the formation, rather than the data from the location where gas was detected in the flowline.

It should be understood that the method used for calculating the measured rate of pressure during the flow line expansion is not intended to limit the invention. The measured pressure rate may be determined from a pressure curve slope, pressures drops, etc. Known techniques comprise curve fitting, linear regression, algebraic calculations etc. Also, the technique is not limited to the expression of Equation 30. For example a confidence token may be determined from mathematically equivalent expressions of FIG. 30.

Figure 39:
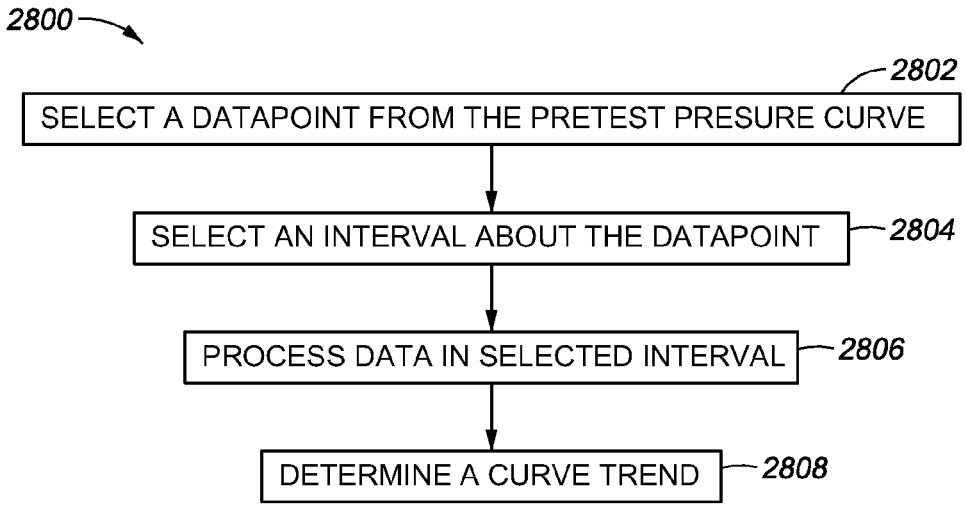
FIG. 39 is a flow chart depicting a method of determining a confidence using a curve analysis technique.

FIG. 39 describes a method 2800 for determining a confidence token using a trend analysis technique. The method involves selecting one or more data points along a portion of a pretest pressure curve at step 2802. For example, for an analysis of buildup, a data point near the end of the buildup curve may be used. Preferably, an interval about the data point is selected at step 2804. In some cases, the interval is positioned about the selected data point. In other cases, the interval is created by reflecting data from one side of the selected data point to the other side of the data point. The selection of the interval is described further below. At 2806, the data points in the interval may be processed, for example with the purpose of analyzing the noise level and/or removing the noise from the data in the selected interval. It should be noted that various processing techniques may be used without departing from the invention. At 2808, one or more trend characteristics of the pressure curve, such as slope, curvature, etc, are determined and may be then analyzed to determine confidence tokens.

With this technique, the characteristics of a portion of the pretest, such as the buildup are analyzed to determine whether the pressure trend at one or more data points in the pretest is behaving as expected. In one example, characteristics, such as the slope, and/or rate of change (increase) of pressure, about the last point of a portion of the test may be used to indicate stabilization. In another example, characteristics of data points distributed about this portion of the test may be analyzed.

For example, the pressure curve near the end of the buildup may in some cases be relatively horizontal or sufficiently flat, and/or the rate of change of pressure may be small or close to zero. This may indicate that the pressure has stabilized and reached formation pressure, and that the final pressure is a good estimate of the formation pressure. In other cases the rate of change of pressure may be large (increasing or decreasing) which may indicate that the formation pressure has not yet been reached. A confidence token may, therefore, be assigned to the pretest based on the pressure trend near the end of the buildup. In this exemplary trend analysis technique applied locally to the end of a buildup cycle, a confidence token is set to the slope of the buildup curve near the end of the buildup cycle. Alternatively, a confidence token could also be set based on the comparison between the slope of the buildup curve near the end of the buildup cycle and a threshold. This information may be used either to terminate or continue the test, for example, until stabilization is reached. This information may also be used to determine that the pretest has not reached stabilization and, therefore, has diminished quality.

Thus, it may be valuable to know the slope of the buildup curve at the last recorded data point in the buildup cycle (i.e. 2907 in FIG. 31). In some cases, the selected data point may be at the end of the curve. In such cases, it may be desirable to extend virtually the data to create an interval. One method for extending the data is to extend the data as an odd function.

Figure 40A:
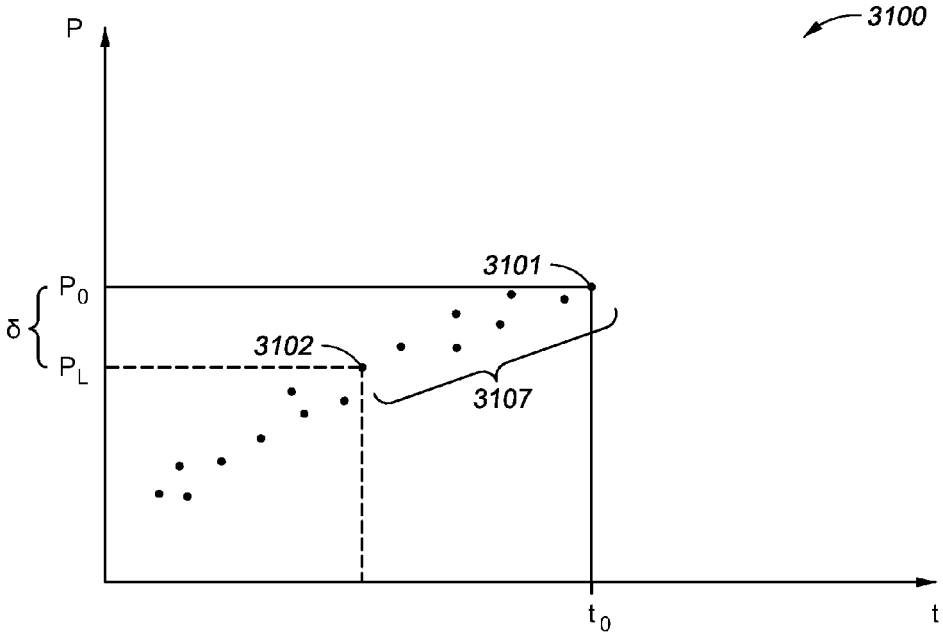
FIG. 40A is a graphical representation of a pressure measurements versus time plot generated by a formation tester for a non-extended interval.

FIGS. 40A, B and C show a portion 3100 of a buildup curve employing the method 2800. Included in the buildup portion 3100 is the last recorded data point 3101 of the buildup cycle. Data point 3101 corresponds to pressure $P_0$ at a time $t_0$. In this case, there are no data points that extend above the selected data point 3101. The data in the interval 3107 below the selected data point 3101 may be defined by defining a pressure range ($\delta$) about $P_0$. The upper and lower bounds of the pressure range to pressures $P_L$ and $P_0$ where $P_L=P_0-\delta$. A data point 3102 exists that corresponds substantially to $P_L$.

Figure 40B:
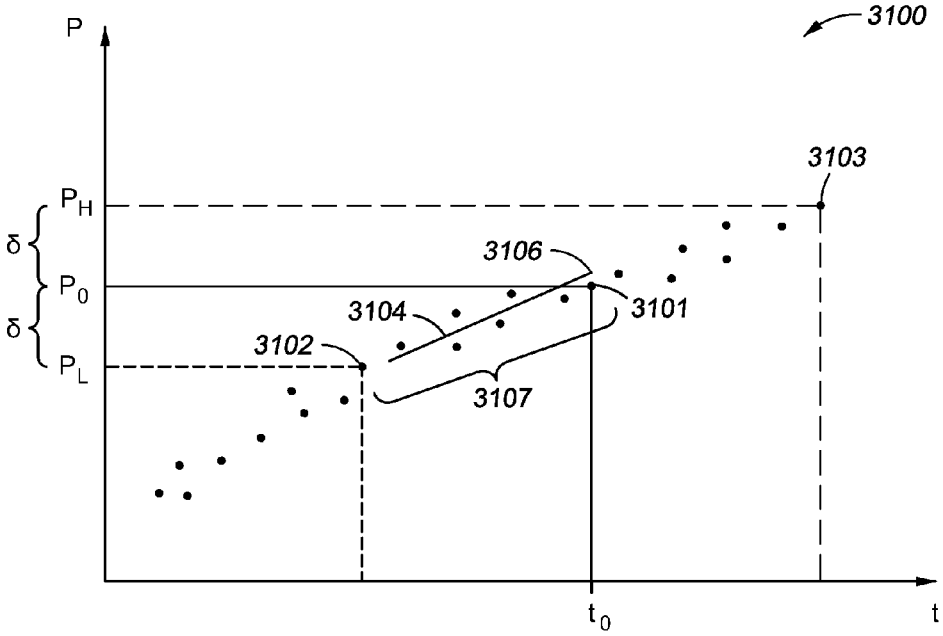
FIG. 40B is a graphical representation of a pressure measurements versus time plot generated by a formation tester for an extended interval.
Figure 40C:
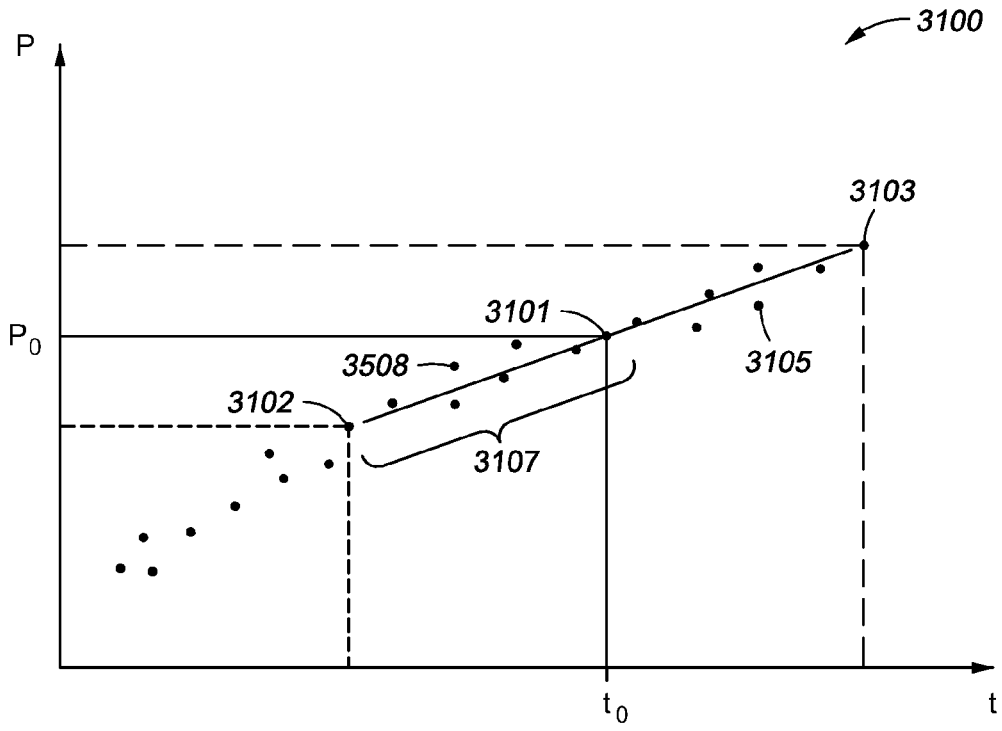
FIG. 40C is a graphical representation of a pressure measurements versus time plot generated by a formation tester depicting a virtual data set.

The buildup portion 3100 may be extended virtually beyond data point 3101 to create an interval about selected data point 3101 while properly accounting for the noise in the data. As shown in FIG. 40B, a pivot point 3106 is created. Preferably, the pivot point may be defined as a "smoothed" value of the pressure at time $t_0$. For example, a first tangent line 3104 may be formed about data point 3101 using an iterative least squares fit method. The data point 3102 is then reflected past the selected data point 3101 by symmetry about the pivot point 3106. The reflected data point 3103 defines a pressure $P_H$. A virtual set of data may then be created in the interval between data point 3101 and 3103 as shown in FIG. 40C. A virtual data point 3105, representing a reflection of data point 3108 at the lower end of the range, is now at the upper end of the range around the selected data point 3101.

Using one or more of the smoothing methods described above with respect to FIGS. 32 or 33A-B for example, the slope of the buildup may be estimated at the last data point 3101.

"Local" trend analysis techniques as discussed above can be naturally extended into "global" trend analysis techniques by analyzing the local trend at several data points, for example along a buildup portion of a pretest. Such a method may be as simple as observing the ordering of the pressures, as discussed above at least with respect to FIG. 7. In addition, such a method may comprise observing the ordering pressure derivatives with respect to time at selected points along the buildup or equivalent differences such as previously discussed at least with respect to Equation 4. In such cases, each may be obtained by a local trend analysis technique as discussed with respect to FIGS. 32, and 33A-B, and more particular with respect to FIGS. 40A-C for end points of the buildup portion.

For example, referring back to FIG. 31, it may advantageous to compute the pressure curve trend of the pressure buildup curve at selected points along its evolution. Any method for selecting specific points may be used. In FIG. 31, the first data point in the buildup cycle, at time zero, is selected as the first selected data point 2901. The remaining of the data points are selected based on various criteria, such as pressure, pressure increment, time, geometric time progression, etc. In this example, points 2902-2907 are selected using a geometric progression. A local trend analysis technique may then be applied to the selected data points 2901-2907, providing series of smoothed pressure values, and smoothed slope values for each data point.

If the smoothed pressures exhibit a monotonically increasing trend while the pressure derivatives at the corresponding points are positive and monotonically decreasing with a very small value at the end of the buildup, there would be good confidence that the final buildup pressure (e.g., $P_{b1}$) was a good representation of the stabilized sandface pressure ($P_{sf}$). One example of global trend analysis technique could be described mathematically as follows:

$$dp/dt\,(t_k)>0 \tag{49}$$

where $t_k$ are the selected times described above; and dp/dt are pressure derivative with respect to time computed with the data extension and smoothing method described with respect to FIGS. 32, 33A-B, 40A-C as well as equation 31, for example.

If, however, derivatives exhibited a positive and almost constant value, a leak may be suspected. The leak could be so small that it would not be easily detectable by visual inspection of the pressure trace. In this case little or no confidence may be assigned to the value of the final buildup pressure. Other situations representing anomalous behavior, for example cases in which the pressure rises to a maximum and then falls off with a constant negative slope, may be similarly diagnosed and evaluated.

Thus in these global trend techniques, a confidence token may be determined based on a set of local trends at selected points along a portion of the pretest. Alternatively, another confidence token may be set based on the increasing trend of the pressure during a portion of the pretest, and/or the decreasing trend of the pressure derivative during a portion of the pretest. The evaluation of the confidence token may take place at surface if the relatively few derivative data are transmitted or it may take place automatically in the downhole processor of the tool where more of the data is available for analysis.

Figure 41:
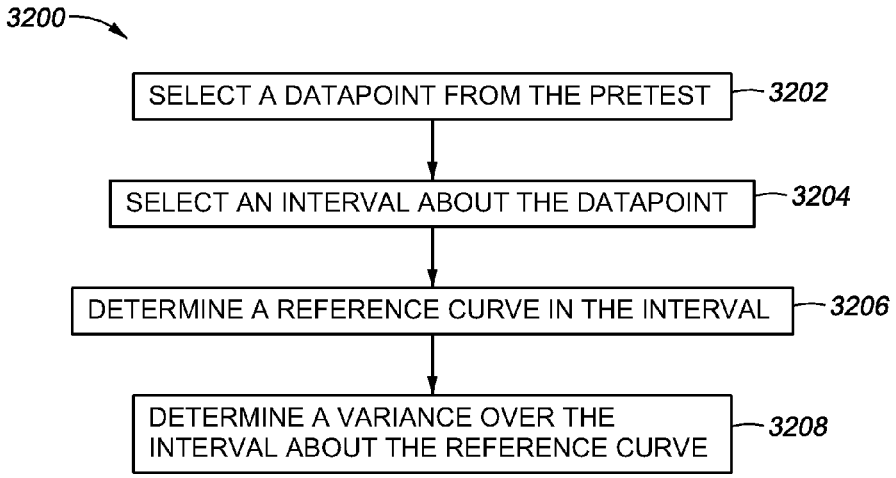
FIG. 41 is a flow chart depicting a method of determining a confidence using a data variance technique.

FIG. 41 depicts a method 3200 for determining a confidence token using a scattering analysis technique. The method involves selecting a data point along a portion of a pretest 3202. An interval about the data point is selected 3204. The pressure range or intervals selected in the methods may be selected arbitrarily. Additionally, the pressure range may be selected as an interval both above and below the selected data point, where the interval is based on either the noise of the pressure measurements or the gauge resolution. The pressure interval may be selected as a multiple of the maximum of the noise and the gauge resolution; for example the multiplier may be four. Other methods for selecting a pressure range about a selected data point may be used without departing from the scope of the invention. A reference curve in the interval is then determined 3206. The variance of the data points over the interval about the reference curve is determined 3208. In some cases, the variance is compared to a threshold or a noise level to determine whether it meets certain criteria, for example the criteria defined by Equation 33 below. The confidence token may be assigned based on whether or how well the criterion is met.

In an exemplary embodiment of method 3200, the reference curve is a straight horizontal line at the middle pressure level in the interval. A variance over the interval about the middle pressure level is then calculated for example with Equation 32 below. This variance is representative of the flatness of the curve around the selected data point. The variance of the data in the interval about the midpoint may be analyzed to determine a confidence token.

Equation 32 shows one method to compute variance $G_t o$ (N):

$$G_{t_0}(N) = \frac{\sum_{k=1}^{N} |p_k - p(t_0)|^2}{N} \tag{32}$$

where $p_k$ is the pressure at the kth point in the interval (i.e. a time interval centered about $t_0$), $p(t_0)$ is the middle pressure level, and N is the number of points in the interval, preferably an odd number.

Equation 33 shows one method to compare the variance to a threshold:

$$\sqrt{G_{t_0}(N)} \leq m \max(\delta,\eta) \tag{33}$$

where m is a multiplication factor and max(δ, η) represents the maximum of a multiple of the tool resolution (δ) and the noise associated with the measurement (η). The multiplication factor m may be set to an appropriate number for a particular test. In one example, m is set to 4. Those having skill in the art will realize that m may be selected to suit the particular application. Thus, a confidence token may be set based on the violation or the validity of Equation 33.

In particular, the variance over an interval selected near the end of the buildup curve (e.g., 350 on FIG. 7, or 2210, 2220 in FIG. 22) may be used as a confidence token. A relatively low variance indicates that the pressure is almost constant, and the buildup pressure (e.g., $P_{b1}$, $P_{b2}$) is close to being stabilized at the sandface pressure ($P_{sf}$) As mentioned above with respect to FIG. 7, this confidence token may be used for example for termination a buildup cycle.

In another exemplary embodiment of method 3200, the reference curve is obtained by fitting a polynomial function, such a quadratic polynomial function, to the data points in the selected interval. To do so, techniques described with respect to FIG. 32 or FIGS. 40A-C may be used. In yet another exemplary embodiment of method 3200, the reference curve is obtained by filtering the measured curve over the selected interval. To do so, filters discussed with respect to FIG. 33A may be used. Those skilled in the art will recognize that several methods may be used for smoothing or de-noising a portion of a curve and that these method can be used for determining a reference curve. The variance about the reference curve may then be calculated to determine a confidence token.

Here as well, "local" scattering analysis techniques as discussed above can be naturally extended into "global" trend analysis techniques by analyzing the local scattering at several data points, for example along a buildup portion of a pretest. Such a method may be as simple as observing the evolution of the variance as defined in Equation 32 along a portion of the pretest. For example, the variance is expected to monotonically decrease along the buildup cycle of a pretest. When this occurs, a confidence token may be set to indicate that the buildup behaved as expected and that the confidence in the pretest result may be high.

Figure 42:
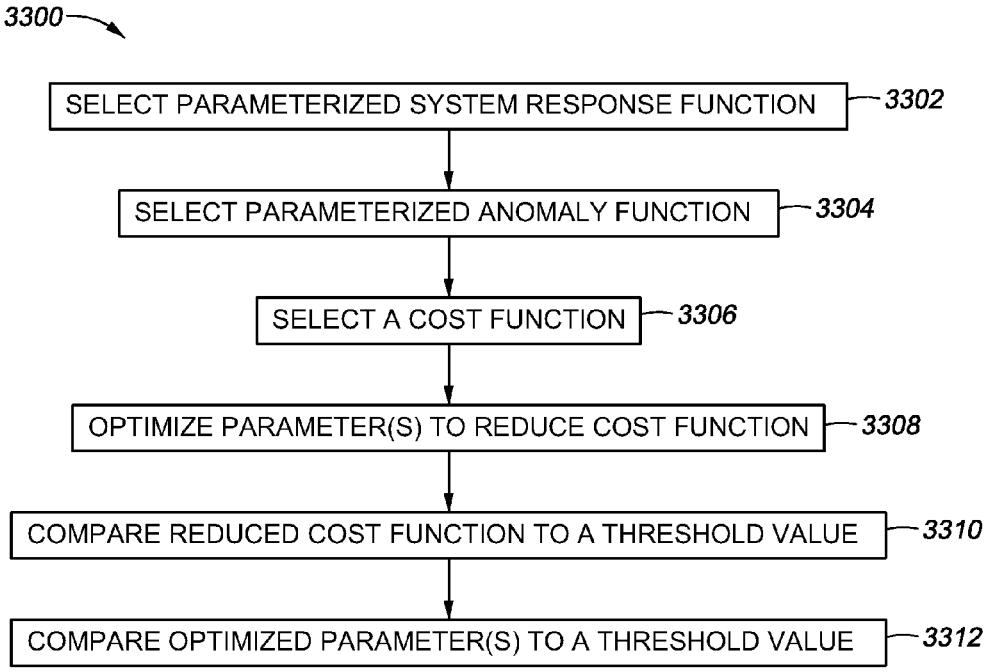
FIG. 42 is a flow chart depicting a method of determining a confidence using a model correlation technique.

FIG. 42 provides a method 3300 for determining a confidence token based on model correlation technique. The method involves selecting a parameterized system response function 3302. One or more parameterized anomaly functions may also be selected 3304. A desired parameterized anomaly function may be selected, for example, where an anomaly, such as a leak is suspected. A cost function is also selected 3306. The cost function, as described below, defines an error between the parameterized function and the data.

One or more of the parameters of the parameterized and/or anomaly functions may be optimized to reduce the cost function 3308. The optimized cost function may be compared to a predetermined value 3310. The optimized parameters may also be compared to a predetermined value 3312. One or both of these comparisons may be used to determine one or more confidence tokens.

If a parameterized function, for example, representing a pretest buildup can be derived such that it closely represents the behavior of the actual buildup, the parameters of the model function so derived may be interpreted in terms of confidence tokens.

Equation 34 shows one example of a parameterized function for modeling, for example, a buildup:

$$p(t)=P(t;\Lambda,\Gamma)=F(t;\Lambda)+A(t;\Gamma) \tag{34}$$

where F(t; Λ) represents a system (e.g., formation and tool) pressure response; Λ is a list of parameters representing the response of the system; A(t; Γ) represents a model of anomalous behavior, such as a leak, pressure drift, etc.; and Γ is a list of parameters describing the anomaly. For example F(t, Λ), may be a function representing the combined effects of spherical flow in the formation, a function which is well known in the art, and tool storage. Alternately, a simple, and not necessarily accurate, function for the system pressure response may be written as:

$$F(t;\Lambda) = p_{sf} - (p_{sf} - p_o)\exp\left(-\frac{t-t_\beta}{\beta}\right) \tag{35}$$

A parameterized anomaly function may also be selected. A model for an anomaly such as a progressive leak, in one example, may be written as:

$$A(t;\Gamma)=\gamma(t-t_\gamma)H(t-t_\gamma) \tag{36}$$

where H is the Heaviside step function that has a value of zero if its argument is negative and a value of unity if its argument is non-negative.

Parameters for the parameterized and anomaly functions may be determined. For Equations 35 and 36, the lists of parameters Λ, Γ are defined as follows:

$$\Lambda=\{p_{sf}, p_o, t_\beta, \beta\}$$

$$\Gamma=\{\gamma, t_\gamma\}$$

where $p_{sf}$ is the estimated stabilized sandface pressure; $p_0$ is the pressure at the beginning of the buildup cycle; $t_\beta$ is the time at which the buildup cycle begins; γ is the slope of the leakage term (described in more detail below); $t_\gamma$ is the time at which the estimation begins to account for leakage; and β is a buildup time constant that is related to formation and tool parameters. The buildup time β may be determined from the following equation:

$$\beta = \frac{\Omega_s}{4r_p}\left(\frac{C_m V_t}{k/\mu}\right) \tag{37}$$

where: $\Omega_s$ is a shape factor that accounts for the effect of the curvature of the wellbore on the pressure response (see Equation 2); $r_p$ is the radius of the probe; $V_t$ is the total effective volume of the tool and the flowline volume plus half of the volume of the pretest; (K/μ) is the mobility of the fluid in the formation; and $C_m$ is the compressibility of the fluid occupying the tool flowline.

In some cases, it may be useful to include both a buildup term and a leakage term. In such cases, the parameterized function may more closely match the buildup pressure data when the probe in the downhole tool does not make a complete seal with the formation at some point during the buildup. In those cases, the pressure ($P_h$) in the borehole causes mud to leak into the flowline. This may artificially increase the pressure in the flowline from a source other than the sandface pressure ($P_{sf}$), which is being measured. In those cases where a probe makes an effective seal with the borehole wall, the leakage parameter (γ) may be reduced to zero.

Other anomalous behavior may be similarly identified and accounted for. For example, identifying a dynamic filtration situation where a pressure decline during the buildup is observed as the result of stopping circulation before or during the test. In this case, the leakage parameter (γ) in Equation 36 is negative.

Once a parameterized function is selected (e.g., Equations 34-37), the curve of pressure as a function of time generated by the parameterized function may be compared to the measured pressure data. The parameters in the parameterized function may be adjusted so that the curve of the function more closely matches the pressure data. Preferably, the parameters are optimized so that the parameterized function matches the data as closely as possible.

One example of a parameter optimization algorithm is to minimize the error between the value of the parameterized function and the actual data points, at the times when the data was recorded. The optimization procedure for obtaining the response parameters may be described as in Equation 38:

$$\min_{\Lambda,\Gamma}\sum_{k=1}^{N} O_k(\Lambda,\Gamma) \tag{38}$$

where $O_k(\Lambda, \Gamma)$ is a cost function further described below, and N is the number of recorded data.

Optimization may include varying one of the parameters within a feasible or predicted range to determine which value of the parameter will result in the smallest error. This process may be repeated for all of the parameters to further reduce the error. In some cases, optimization may include varying all parameters simultaneously, and the optimization may be repeated until all of the parameters are within a specified range from previously optimized values. Preferably the optimization is performed using standard techniques such as the Levenberg-Marquardt procedure. The parameters of the model function may also be determined by other optimization techniques estimation methods well known in the art.

One example of a cost function that may be used to optimize the parameters is shown in Equation 39:

$$O_k(\Lambda,\Gamma)=\ln(1+\sqrt{|p_k-P(t_k;\Lambda,\Gamma)|w(t_k)}) \tag{39}$$

where the example of a cost function in Equation 39 is a function of both the data ($p_k$ represents the $k^{th}$ pressure data point and $t_k$ represents its associated time relative to the beginning of a test portion) and the parameterized function ($P(t_k; \Lambda, \Gamma)$ represents the value of the parameterized function at the same time that the $k^{th}$ pressure data point was recorded). The example of cost function in Equation 39 also includes a weighting term $w(t_k)$. The difference term (the difference between the measured pressure and the parameterized function prediction) is multiplied by the weighting term. In Equation 39, the weighting term may be chosen to give greater weight to certain portions of the data, for example, the choice $w(t_k)=(1+t_k)$ places more emphasis on the variance of the parameterized function near the end of, say, a buildup. The weighting term allows for some misfit in the early part of the data, but places emphasis on the fit of the parameterized function near the end of the buildup. The final value of the cost function is calculated by adding the terms $(O_k(\Lambda,\Gamma))$ over the token k to cover a desired portion of the pretest, such as the buildup cycle.

For example, FIG. 43 shows a graph 3400. The data that was collected during a pretest is shown as curve 3401. The best fit for the parameterized function is shown as curve 3403. The curve 3403 does not fit the data well in the early part of the data, but it fits very closely in the latter part of the data. By using a weighting term, the fit near the end of the data is more significant than near the beginning of the data.

In these model correlation techniques, a confidence token may be set based on the minimum value of the cost function as indicated by step 3310. For example, when the optimized value of the cost function is small, the measured data points and the parameterized functions chosen in steps 3302, and possibly 3304, match closely. This may indicate that the portion of the pretest that is being investigated does behave according to expected functions. In these cases, a confidence token may be set to inform that the shape of the portion of the pretest has been recognize with some confidence. Otherwise, a large value of the optimized value of the cost function may indicate that the shape of the portion of the pretest is not recognized, and accordingly, a confidence token may also be set to a different value.

Alternatively, other confidence tokens may be set based on the values of the optimized parameters that best describe the actual buildup as indicated by step 3312. For example, the final pressure of the buildup may be questionable when a leak is detected during the build up. An indication of a leak could be the amplitude of the optimized value of the parameter ($\gamma$) in Equation 36. Accordingly, a confidence token may be set based on the optimized value of the parameter ($\gamma$).

In addition, this method may be used for determining a refined value of the formation pressure. In some cases, the optimization of the parameterized function enables a more accurate prediction the stabilized sandface pressure than the recorded pressure at the end of the buildup. For example, the optimized value of $p_{sf}$ of Equation (35) may be a more accurate value formation pressure than the buildup pressures $P_{b1}$ or $P_{b2}$.

Figure 44A:
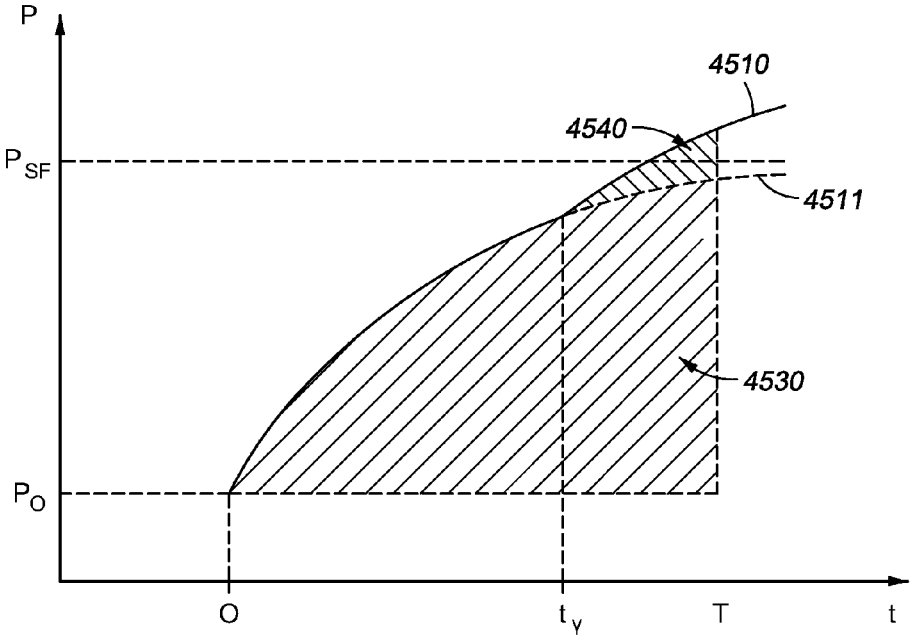
FIG. 44A is a graphical representation of a pressure measurements versus time plot generated by a formation tester depicting a leak during a build up.
Figure 44B:
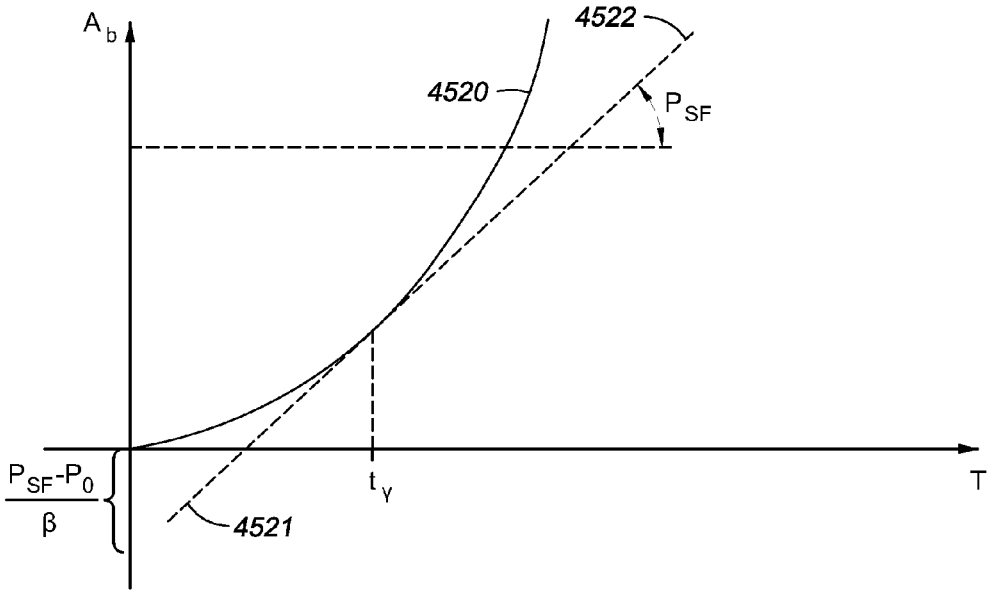
FIG. 44B is a graphical representation of an area below a pressure curve of FIG. 44A versus time.

In yet another embodiment of method 3300, the area below the curve build from the measured pressure data points is analyzed, as illustrated in FIGS. 44A and 44B. This alternative method 3300 may be advantageous to analyze anomalies that have a bias with respect to a system response that is negative or positive for a significant duration. With this method, perturbations of the system that fluctuate around the system response may have a reduced impact on the analysis.

FIG. 44A shows a pressure curve 4510 obtained by a formation tester, for example during a buildup cycle. In this Figure, it is assumed that at time ($t_\gamma$) a leak is occurring across the packer. Without leak, the pressure curve 4510 would have stabilized toward the sandface pressure $P_{sf}$ as indicated by the dashed line 4511. In this embodiment of method 3300, the area below the curve 4510 is analyzed. More specifically, a plurality of buildup durations T are selected. For each of the plurality of durations T, the area $A_b(T)$ below the curve 4510 that spans between the beginning of the buildup (assumed to be t=0) and the duration T is computed. For example, FIG. 44A shows the area below the curve 4510 for a particular value of the duration T, greater than the time ($t_\gamma$) at which the leak is assumed to have occurred. This area is the sum of area $A_1$ 4530 and the area $A_2$ 4540. The area 4530 is the area that would have been computed in the absence of the leak at the time ($t_\gamma$). The area 4540 is the additional area computed because of the presence of the leak at the time ($t_\gamma$).

A curve may then be constructed by plotting the calculated area $A_b(T)$ as a function of the duration T for each the plurality of duration T. An example of such a curve is shown in FIG. 44B. Curve 4520 is a curve constructed in the presence of a leak, and dashed curve 4522 is a curve created in the absence of leak (or at least when the leak is negligible or not detectable). As indicated in FIG. 44B, when no leak is detectable in the buildup cycle, the curve will asymptotically approach a straight line 4521 having a slope $p_{sf}$ and an intersect given by $$\frac{p_{sf}-p_0}{\beta}.$$

As also shown in FIG. 44B, when a detectable leak occurs in the buildup cycle, the curve 4520 diverges from the asymptotical straight line 4521. Thus, a leak may be detected by analyzing the curve obtained by plotting the calculated area $A_b(T)$ as a function of the duration T.

At step 3302, the parameterized system response function may be selected for example according to Equation 45:

$$A_1(T, p_{sf}, p_0, \beta) = p_{sf}T + (p_{sf}-p_0)\frac{\exp(-\beta T)-1}{\beta} \tag{45}$$

where $p_{sf}$ is the estimated stabilized sandface pressure; $p_0$ is the pressure at the beginning of the buildup cycle; T is a buildup duration referenced with respect to the beginning of the buildup; and $\beta$ is a buildup time constant.

At step 3304, the parameterized anomaly function may be selected for example according to Equation 46:

$$A_2(T, T_\gamma, \gamma) = \gamma\frac{(T-T_\gamma)^2}{2}H(T-T_\gamma) \tag{46}$$

where $\gamma$ is the slope of the leakage term; and $T_\gamma$ is the time at which the estimation begins to account for leakage.

At step 3306, a cost function O is selected, for example:

$$O(p_{sf}, p_0, \beta, T_\gamma, \gamma)=\Sigma_T(A_b(T)-A_1(T, p_{sf}, p_0, \beta)-A_2(T, T_\gamma, \gamma))^2 \tag{47}$$

where $p_{sf}$, $p_0$ and $\beta$ are parameters representing the response of the system; $\gamma$ and $T_\gamma$ are parameters describing the anomaly; $A_b(T)$ are areas computed from measured pressure values during a test; and $A_1$ and $A_2$ are functions selected in step 3302 and 3304 respectively.

At step 3308, the value of the parameters $p_{sf}$, $p_0$ $\beta$ $\gamma$ and $T_\gamma$ is optimized to reduce the cost function. Any optimization algorithm may be used. In some cases, the function $A_1+A_2$ computed with the optimized values of the parameters will closely match the curve 4520 of FIG. 44B.

Figure 45:
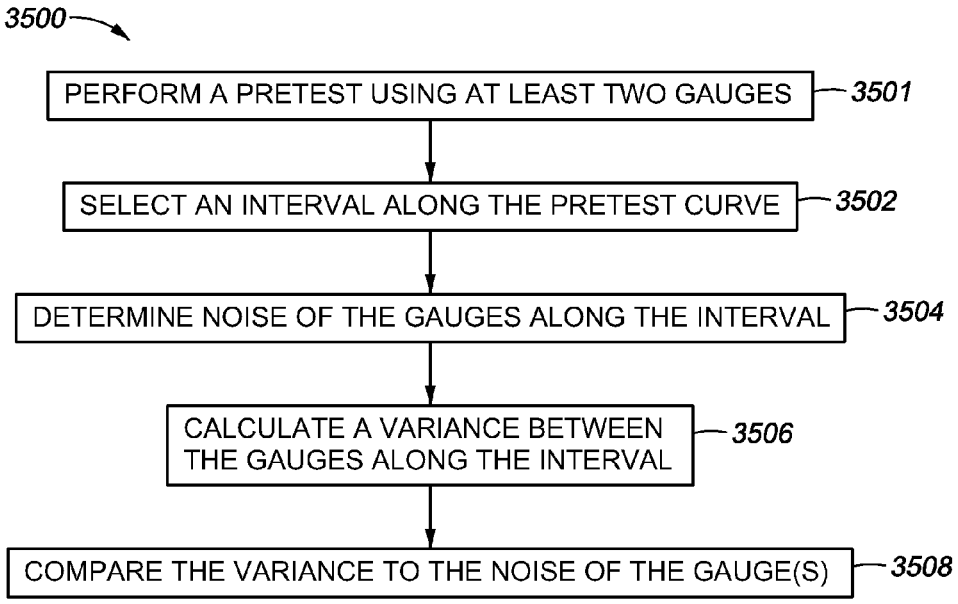
FIG. 45 is a flow chart depicting a method of determining a confidence using a gauge comparison technique.

Method 3500 in FIG. 45 describes another technique for determining the confidence in the pretest using a gauge comparison technique. This method involves using at least two gauges to perform a pretest 3501. An interval along a curve generated by the pretest is selected 3502. Noise in each of the gauges is determined 3504. The noise may be determined along the interval. The noise from one or both gauges may be used. A variance between the gauges is determined 3506. The variance is compared to the noise of the gauges 3508. A confidence token may be assigned based on the results. Optionally, if there is a significant total variance, the method may include identifying a downhole phenomenon that is causing the variance, such as for example, a change in temperature.

In one example, a typical formation testing tool for performing pretests may include both a strain pressure gauge and a quartz pressure gauge (e.g., 123*a*, 120*a* in FIG. 4 may include a strain pressure gauge and a quartz pressure gauge). These two types of pressure gauges have different principles of operation and, therefore, the gauges may have different responses to the same situation. In particular, a strain pressure gauge tends to react more quickly to pressure changes, but it may have a poorer absolute accuracy and may be generally noisier than a quartz pressure gauge. In addition, a strain pressure gauge may be less affected by changes in temperature. Conversely, a quartz pressure gauge may be more accurate than a strain gauge, but it may be more affected by temperature changes; moreover, a quartz pressure gauge may react more slowly to pressure changes than a strain pressure gauge. Other types of pressure gauges, as are known in the art, may be used with this method instead of quartz and/or strain gauges.

The variance between the strain pressure gauge and the quartz pressure gauge may be computed at step 3506. For example, the difference $C_{S,Q}^{n}$ between the two gauges may be defined as:

$$C_{S,Q} = \sqrt[n]{\frac{1}{N}\sum_{k=1}^{N} w(t_k)|p_k(Q) - p_k(S)|^n} \tag{40}$$

where $p_k(Q)$ is the $k^{th}$ pressure data point measured by the quartz pressure gauge, $p_k(S)$ is the corresponding pressure data point measured by the strain pressure gauge, n is an exponent that may be selected by the operator (e.g., n may be 2), $w(t_k)$ is a weighting function that is usually chosen to give greater weight to late-time data, and N is the number of data points in the interval selected at step 3502, for example at the end of buildup.

Optionally, an offset may be applied to one of the sets of data points before step 3506. The offset may be applied to either the data from the first pressure gauge or the second pressure gauge to better align or overlay the measured responses of the gauges. The offset may be a measure of the pressure difference between the gauges. The offset may alternatively be a measure of a time delay between the gauges. Thus, if the first gauge data is offset, the total offset variance is computed in the same manner as is shown in Equation 40, but using the offset pressure data for the first gauge in place of the actual first gauge pressure data. Any method may be employed to automatically determine the optimal offsets, such as cross correlations or other methods known in the art. Which data are offset and how they are offset is not intended to limit the invention.

Identifying different responses from different gauges may help to determine gauge failure downhole. In addition, if the responses of the pressure gauges are similar over a particular interval, that will add to the confidence in the final results of the pretest. Thus, the variance between the strain pressure gauge and the quartz pressure gauge can be used as an indicator of the confidence in the pretest results. If the value of $c_{S,Q}$ is below a selected value (e.g., below a small multiple of the local noise computed at step 3504 or the gauge resolution of the "worst" gauge, typically the strain gauge), the pretest results may be considered to be independent of the gauge and therefore may be considered to be more reliable. Thus, in this situation, a higher confidence may be placed in the pretest results. In other cases, it may be determined that there is a cause for a discrepancy between the pressure measurement made by the different pressure gauges. If that cause can be determined, more confidence may be placed in the pretest results.

Figure 46:
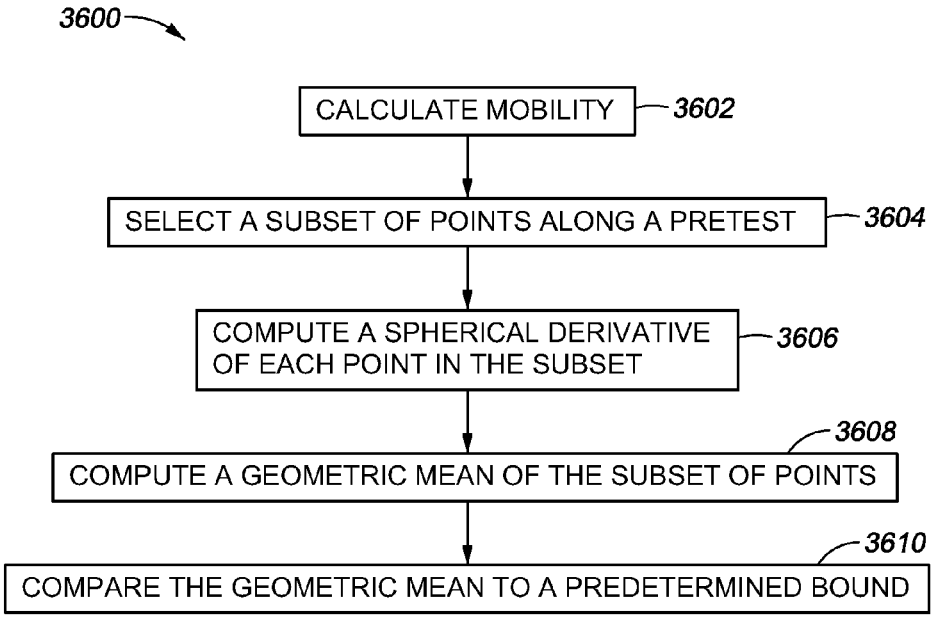
FIG. 46 is a flow chart depicting a method of determining a confidence using a supercharging technique.

FIG. 46 describes another method for determining a confidence token using a supercharging technique. The method involves calculating mobility 3602 using, for example, Equation 1. If the mobility is below a certain level, it may be desirable to check for supercharging. Alternatively, the test may be performed regardless of the level of mobility. A subset of points along a pretest is then selected 3604. A spherical derivative at each point in the subset is determined 3606. A geometric mean of the subset is also determined 3608. The geometric mean may be utilized to determine if the buildup pressure is supercharged. For example, the geometric mean may then be compared to a predetermined bound 3610.

This method is used to assess whether the stabilized sandface pressure is a good representation of the formation pressure. There are several reasons for the sandface pressure to be different from the formation pressure, for example, the effect of a continuous leakage of mud filtrate into the formation through an imperfect mudcake, known as supercharging. This phenomenon is most often associated with "low" formation mobilities where the definition of low depends on drilling practices, the mud type and its characteristics and the conditions under which the pretest was performed, for example, whether the mud was being circulated during the test or not and, if so, at what rate. Measurements which are assessed to be supercharged may be considered to be of lower quality than measurements which are not considered to be supercharged.

In one example, a determination of whether a buildup pressure is supercharged is made. Preferably, the mobility is first calculated using any pretest cycle, for example by using techniques discussed with respect to FIG. 7 and/or Equation 1. This mobility may be compared to threshold:

$$\left(\frac{K}{\mu}\right) < M_S \tag{48}$$

where $M_S$ is a bound for the mobility above which supercharging is expected, typically below 1 to 10 mD/cP.

Data points may be selected along a buildup cycle, for example as discussed with respect to FIG. 26. Preferably, N data points are selected at least two time constants β (see Equation 35 and Equation 37) beyond the start of buildup, as expressed mathematically below:

$$\text{for } k=1, \ldots, N,\ t_k \geqq M_t\beta$$

where $M_t \geqq 2$.

The "ordinary" pressure derivative may be computed for example with the data extension and smoothing method described with respect to FIGS. 32, 33A-B, 40A-C as well as equation 31. Preferably, the global trend analysis of the buildup is first performed to insure that the pressure curve is behaving as expected, typically by insuring that Equation 49 is satisfied.

The spherical time derivative of the pressure, $dp/df_S$, at these points, as defined further below in Equation 41, is also computed. The spherical derivative is given for a single drawdown period of duration $t_p$, by:

$$dp/df_S(t)=2t^{3/2}dp/dt(t)\{(1-\tau_p)^{3/2}/(1-(1-\tau_p)^{3/2})\} \quad (41)$$

where $\tau_p \equiv t_p/t$; and dp/dt, is the "ordinary" pressure derivative determined as described above.

The geometric mean of the accumulated spherical derivatives may then be computed. A confidence token may be assigned based on the results. In some cases, the geometric mean may be compared to a threshold value. In particular, a confidence token may be set based on the violation or the validity of the Equation system 42. The stabilized sandface pressure (as represented by the final buildup pressure, $P_{b1}$ or $P_{b2}$) is said to be supercharged if:

$$(\pi_{k+1}^{N} dp/df_S(t_k))^{1/N} > D_S \quad (42)$$

where $D_S$ is a bound on the geometric mean of the spherical derivatives, typically taken as 100 psi $\sqrt{\text{sec}}$.

Figure 47:
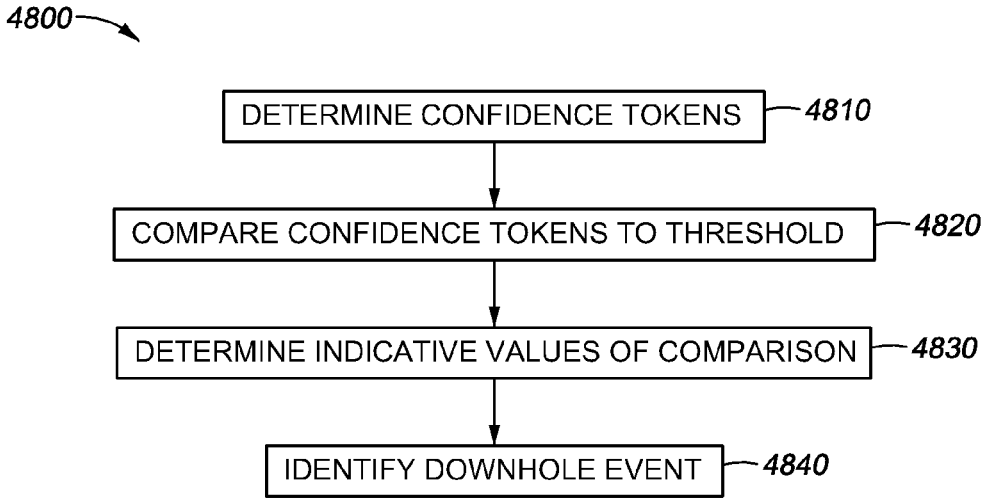
FIG. 47 is a flow chart detailing a method of analyzing the confidence tokens as set forth in FIG. 34.

FIG. 47 describes in more details a method 4800 for analyzing the confidence tokens as set forth in step 2310 in FIG. 34. The method comprises determining confidence tokens in step 4810. The method may utilize the confidence tokens that have been determined in step 2304 in FIG. 34. The method further comprises comparing a plurality of confidence tokens to threshold values at step 4820; determining a plurality of indicative values from the comparison at step 4830, and identifying at least one downhole event from the plurality of indicative values at step 4840.

At step 4820, previously determined confidence token are compared to threshold values, for example noise levels, or characteristic values. These thresholds may be determined from prior knowledge of the testing condition, such as from drilling mud composition, from a database of previous tests in the same or other reservoirs, etc. These thresholds may alternatively be determined by modeling, such as the limit of formation mobility at which supercharging may be expected for particular testing conditions. These thresholds may also be determined by experiments, such as the gauge noise. Finally the thresholds may be computed from the pretest data, such as the noise measurement or pressure levels at particular events. Various comparison have been discussed above with respect to pressure comparison techniques (see for example Equation 26 and its refinements), parameter comparison techniques (see for example Equations 27, 28 or 29), parameter prediction techniques (see for example Equation 30), trend analysis techniques (see for example Equation 49), scattering analysis techniques (see for example Equation 33), supercharging techniques (see for example Equation 42 and 48), and other techniques discussed in this disclosure. Alternatively, other confidence token known in the art may be compared to threshold values in this step.

At step 4830, indicative values are determined based on the comparison. In one example of step 4830, the indicative value may be a Boolean number based of the validity of the comparison. More generally, any Boolean-valued function of at least one confidence token may be used. In another example, the indicative value may be derived using fuzzy logic principles known in the art. The value is then a number between 0 and 1, 0 indicating for example that the confidence token is well below a threshold, 1 indicating that the confidence token is well above the threshold, and a value between 0 and 1 indicating that the confidence token is somewhat close to the threshold.

At step 4840, a downhole condition is identified. A downhole condition may be any information of interest from the point of view of an operator. In one example, downhole conditions may be related to drilling operations. They comprise conditions such as "the well is underbalanced" and "the well is overbalanced". In another example, downhole conditions may be related to the tool status. In this case, they comprise conditions such as "the flow line is intermittently plugged", "the probe did not reach the wellbore wall", etc. In yet another example, downhole conditions may be related to the formation and the wellbore. They comprise conditions such as "the formation is impermeable", "the mud cake is leaking", "the sandface pressure is supercharged", "gas is detected in the flow line", etc. In yet another example, downhole conditions may be related to the pretest cycle. They comprise conditions such as "the investigation phase has been terminated before the end of the test", "the investigation phase has been terminated based on a volume criterion", "the test parameters computed from the investigation phase to design a measurement phase are out of range", etc. In yet another example, downhole conditions may be related the pressure measurement. In this case, they comprise conditions such as "the drawdown pressure was sufficient for measuring the sand face pressure", "the measurement phase build up cycle reached stabilization", "the measurement is noisy", etc. Some of these and other downhole conditions will be discussed more in detail below.

It will be appreciated that the various confidence tokens or their associated indicative values, if considered individually, may be interpreted ambiguously as more than one downhole condition. For example, a pressure level corresponding to a end of buildup event, i.e. $P_{b1}$ or $P_{b2}$ that is not below the hydrostatic or wellbore pressure as required by Equation 26 may be interpreted, among other tings, as a lost seal during the pretest cycle, as the probe not having extended enough to reach the wellbore wall, or as a well drilled underbalanced. Similarly, a pressure level corresponding to a end of buildup event that is almost equal to a pressure level corresponding to the respective end of drawdown, i.e. $P_{d1}$ or $P_{d2}$ may be interpreted, among other tings, as a dry test (impermeable formation) or as an insufficient drawdown. To identify a downhole condition with a greater level of certainty, it may be advantageous to analyze a plurality of indicative values.

More specifically, each downhole event may be associated to a truth table having the indicatives values determined at step 4830 as inputs. In some cases, only one indicative value may be sufficient to identify a downhole condition. In other cases, a plurality of indicative values may be required to identify a downhole condition. Referring back to the examples above, a global trend analysis of the buildup cycle may distinguish between a well drilled underbalanced and a lost or inexistent seal. Typically, if a buildup cycle is detected and it has proper progression of pressure levels and/or pressure curve slope, the downhole conditions of lost seal may be ruled out. Thus, the downhole event "the well is underbalanced" may be identified using a truth table having a first indicator value associated to the comparison of the pressure level of the end of buildup event and the pressure level at the wellbore pressure event, and a second indicator value associated to a global trend analysis technique applied to the buildup cycle.

Those skilled in the art will appreciate that other truth tables associated to different downhole conditions may also be utilized in step 4840. For example, a leaking mudcake may be identified using a model correlation technique and a pressure comparison technique. Moreover, gas in the flow line may be identified using a parameter prediction technique, as well as a global trend analysis technique identifying a lazy buildup cycle.

It will also be appreciated that the use of a truth table is only an exemplary technique for performing the step 4840 and that other techniques may be used instead. In particular, fuzzy logic may be used.

Figure 48:
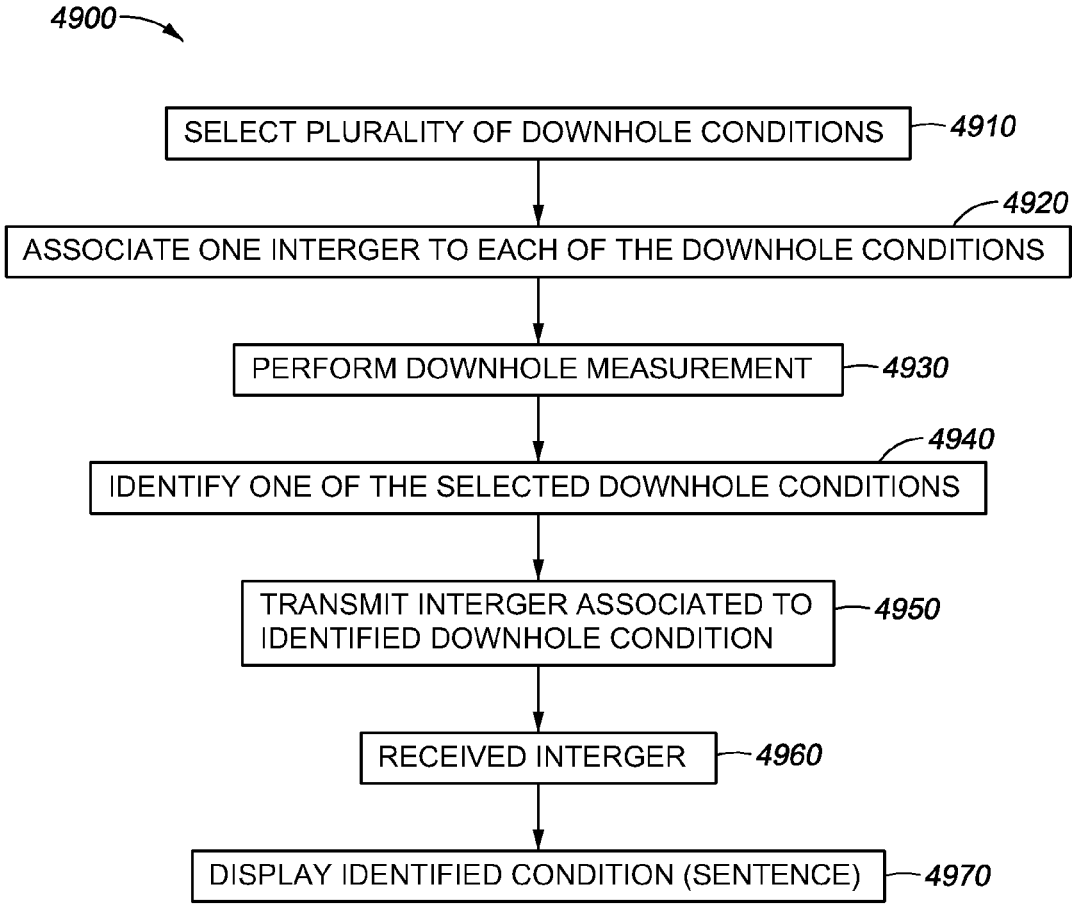
FIG. 48 is a flow chart depicting a method of displaying a downhole condition identified for example with the method detailed in FIG. 47.

FIG. 48 illustrates a method 4900 for displaying an identified downhole condition. The method comprises selecting a plurality of downhole conditions that are preferably mutually exclusive at step 4910, and associating a different integer to each of the plurality of the downhole conditions at step 4920. This step may be performed before the downhole testing tool is located in the wellbore. These steps may also be repeated several times for example to include sets of downhole conditions that may occur independently from the previous sets. The method 4900 further comprises performing a downhole measurement at step 4930, identifying one of the plurality of downhole conditions at step 4940, transmitting to a display the integer associated to the condition at step 4950, receiving the transmitted integer at step 4960, and displaying indicia, for example a sentence indicative of the downhole condition that is associated with the received integer at step 4970.

In one example implementation, the downhole conditions selected at 4910 includes:

the pressure test is normal, the well is overbalanced;

the pressure test is normal, the well is underbalanced;

the pressure test is normal, the overbalance is uncertain;

the pressure test is a dry test;

no seal has been achieved during the pressure test (the probe is in a wellbore washout);

the seal has been lost during the pressure test; and/or the pressure test is unrecognizable.

These downhole conditions are preferably mutually exclusive.

As an example implementation of step 4920, the first condition of the above list may be associated with the integer 0, the second condition with the integer 1, and so forth. Thus, when one of the downhole conditions listed above is identified to be true, it can be coded by an integer between 0 and 6. This integer may be converted into a binary word fitting on 3 bits or more.

At step 4930, any measurement may be performed. In particular, pressure measurements using testing tools and methods as disclosed above may be used. The type of measurement does not limit the present invention.

At step 4940, one of the plurality of downhole conditions may be identified as being true. To do so, a method such as the method 4800 may be used. Other method may be used instead.

At step 4950, the integer associated with the condition identified at step 4940 is transmitted. For example, when the condition "the pressure test is normal, the well is overbalanced" is identified, the number 0 would be transmitted, when the condition "the pressure test is normal, the well is underbalanced" is identified, the number 1 would be transmitted. It will be appreciated that if the plurality of conditions are mutually exclusive, only one is identified to be true and, therefore, only one integer is transmitted. This coding method is therefore advantageous when the telemetry bandwidth is limited. Indeed, information of importance for a surface operator may be detected by analyzing a large amount of data collected downhole and transmitted in a compact form. The surface display may be any system capable of receiving data and display it, for example on a screen or a printed log.

The transmitted integer is then received. It is decoded and a sentence indicative of the downhole condition associated to it is displayed. Referring back the example above, if the integer 0 is received, the sentence "the pressure test is normal, the well is overbalanced" may be displayed to the surface operator. Alternatively, other sentences having a similar meaning may be displayed instead.

As mentioned before, a second set of downhole conditions, for example conditions that are not predictable from the first set may also be selected at step 4910. A second set of downhole conditions related to the buildup cycle of a pretest may include:

decreasing pressure variance and decreasing positive slope along the buildup curve;

decreasing pressure variance and decreasing negative slope along the buildup curve;

negligible pressure variance and negligible slope all along the buildup curve;

almost constant pressure variance and positive slope along the buildup curve;

almost constant pressure variance and negative slope along the buildup curve;

increasing pressure variance and positive slope along the buildup curve; and/or shape not recognized (none of the above).

At step 4920, the integer associated to this second set of conditions may be between 0 and 6.

At step 4940, one of the conditions associated to the second set may be identified, for example using a global trend analysis technique and a global scattering analysis technique as describe therein.

At step 4950, the integer associated to the identified condition of the second set may be coded in a second 3 bits (or more) binary word. In some cases, it may be advantageous to concatenate the binary word corresponding to the first set of conditions with the binary word corresponding to the second set of conditions.

At step 4960, a surface decoder may de-concatenate the two received words. In some cases, one sentence corresponding to each word may be displayed at step 4970. In other cases, less or more sentences may be displayed.

Note that the conditions may also be recombined at will in different sets. Note also that other sets of downhole conditions may be added to the examples described above.

Configurations have been described herein with reference to examples setting forth formation pretest data having pressure and time values. However, it should be appreciated that the concepts of the present invention are not limited with respect to the particular data, the source of the data, or the media through which the data is transmitted. In addition, the data need not be pressure data. For example, the data may be comprised of temperatures from one of the pressure sensors, or from voltages from a strain gauge. While temperatures and voltages are not pressure data per se, they may be related to pressure measurements and, thus, may be applied to that data as well.

Moreover, the present invention is not limited to the particular steps, order of steps, or configurations set forth in the above examples. Accordingly, additional and/or alternative steps may be added or deleted. One or more of the methods provided herein may be used alone or in combination. For example, it may be desirable to use one or more of the confidence token methods to generate an overall confidence token for one or more pretests. The results of the confidence token may then be used to adjust the pretest operations. In some cases, the confidence token of a first pretest may be used to assist in designing one or more subsequent pretests. Other pretest design criteria may also be used.

It should also be appreciated that concept of the present invention are not limited to particular manual, visual or automated implementations. In addition, if an automated implementation is desired, this implementation may be supported by downhole tool hardware, uphole rig hardware, client office hardware, or any combinations thereof.

It should be appreciated that, using the concepts of the present invention, data may be compressed and transmitted in real-time or near real-time. For example, where the data comprises formation pretest data, compression and transmission may be performed prior to completion of the pretest, such as after an appropriate number of event data points (e.g., one or more event data points) and additional data points (e.g., a series of data points prior or subsequent to an event data point) are captured. The methods may involve obtaining data from a pretest that was previously performed, and/or currently tested.

What is claimed is:

1. A method for determining a confidence in measurements taken by a while drilling testing tool positioned in a wellbore penetrating a subterranean formation, the method comprising:

establishing a pressure coupling between a pressure sensor conveyed by the testing tool and the formation;

performing a first drawdown with the testing tool;

measuring data indicative of pressure with the pressure sensor;

determining at least one confidence token based on the pressure data;

identifying a downhole condition based on the measured data and the at least one confidence token; and displaying at the surface the measured data, the at least one confidence token, and the identified downhole condition.

2. The method of claim 1 further including a second drawdown.

3. The method of claim 2 wherein the second drawdown parameters are based at least in part on the at least one confidence token.

4. The method of claim 2 wherein the confidence token is determined using a parameter comparison technique.

5. The method of claim 1 further including terminating the pressure coupling.

6. The method of claim 1 wherein determining the at least one confidence token comprises determining the at least one confidence token based on the measured data using a trend analysis technique.

7. The method of claim 6 wherein the trend analysis technique is a global trend analysis technique.

8. The method of claim 6 wherein the trend analysis technique comprises reflecting pressure data beyond the end of a buildup cycle.

9. The method of claim 8 wherein the at least one confidence token is representative of a slope of a pressure curve at an end of a buildup cycle.

10. The method of claim 1 wherein determining the at least one confidence token comprises determining the at least one confidence token based on the measured data using a scattering analysis technique.

11. The method of claim 10 wherein the scattering analysis technique is a global scattering analysis technique.

12. The method of claim 1 further comprising determining a second confidence token based on the measured data using a pressure comparison technique.

13. The method of claim 1 further comprising determining a second confidence token based on the measured data using a parameter prediction technique.

14. The method of claim 1 further comprising determining a second confidence token based on the measured data using a model correlation technique.

15. The method of claim 1 further comprising determining a second confidence token based on the measured data using a gauge comparison technique.

16. The method of claim 1 further comprising determining a second confidence token based on the measured data using a supercharging technique.

17. The method of claim 1 further comprising:

selecting a plurality of downhole conditions;

associating a different value to each of the plurality of the downhole conditions; and transmitting to the surface display a value associated with the identified downhole condition;

wherein displaying the identified downhole condition at the surface comprises displaying indicia indicative of the identified downhole condition, and wherein the indicia comprises or is based on the value associated with the identified downhole condition.

18. A method for determining a confidence in measurements taken by a while drilling testing tool positioned in a wellbore penetrating a subterranean formation, the method comprising:

establishing a pressure coupling between a pressure sensor conveyed by the testing tool and the formation;

performing a first drawdown with the testing tool;

measuring data indicative of pressure with the pressure sensor;

determining at least one confidence token based on the pressure data;

identifying a downhole condition based on the measured data and the at least one confidence token;

selecting a plurality of downhole conditions;

associating a different value to each of the plurality of the downhole conditions;

identifying a plurality of events associated with operation of the testing tool;

selecting data points for transmission by the testing tool, the data points being selected as a function of the plurality of events and a growth function;

determining values associated with the plurality of events and the data points selected for transmission by the testing tool; and transmitting to the surface, and displaying on a well log at the surface, the measured data, the at least one confidence token, the identified downhole condition, the determined values associated with the plurality of events and the selected data points, and a value associated with the identified downhole condition;

wherein transmitting and displaying the identified downhole condition comprises transmitting and displaying indicia indicative of the identified downhole condition, and wherein the indicia comprises or is based on the value associated with the identified downhole condition.

19. A method for determining a confidence in measurements taken by a while drilling testing tool positioned in a wellbore penetrating a subterranean formation, the method comprising:

establishing a pressure coupling between a pressure sensor conveyed by the testing tool and the formation;

performing a first drawdown with the testing tool;

measuring data indicative of pressure with the pressure sensor;

determining at least one confidence token based on the pressure data;

identifying a downhole condition based on the measured data and the at least one confidence token;

selecting data points for transmission by the testing tool, the data points being selected as a function of a growth function and a plurality of events associated with operation of the testing tool;

determining values associated with the plurality of events and the data points for transmission by the testing tool; and transmitting to and displaying at the surface the measured data, the at least one confidence token, the identified downhole condition, and the determined values.

20. The method of claim 19 wherein displaying at the surface the measured data, the at least one confidence token, the identified downhole condition, and the determined values comprises displaying on a well log.

* * * * *